US012000257B2

(12) United States Patent
Foster et al.

(10) Patent No.: US 12,000,257 B2
(45) Date of Patent: Jun. 4, 2024

(54) FLUID END

(71) Applicant: Kerr Machine Co., Sulphur, OK (US)

(72) Inventors: Kelcy Jake Foster, Sulphur, OK (US); Micheal Cole Thomas, Ardmore, OK (US); Christopher Todd Barnett, Stratford, OK (US); Nicholas Son, Davis, OK (US); John Keith, Ardmore, OK (US)

(73) Assignee: Kerr Machine Co., Sulphur, OK (US)

( * ) Notice: Subject to any disclaimer, the term of this patent is extended or adjusted under 35 U.S.C. 154(b) by 0 days.

(21) Appl. No.: 18/488,435

(22) Filed: Oct. 17, 2023

(65) Prior Publication Data

US 2024/0125222 A1 Apr. 18, 2024

Related U.S. Application Data

(60) Provisional application No. 63/508,577, filed on Jun. 16, 2023, provisional application No. 63/506,222, filed on Jun. 5, 2023, provisional application No. 63/422,637, filed on Nov. 4, 2022, provisional application No. 63/416,644, filed on Oct. 17, 2022.

(51) Int. Cl.

| | |
|---|---|
| ***F04B 53/16*** | (2006.01) |
| ***E21B 43/26*** | (2006.01) |
| ***F04B 53/22*** | (2006.01) |

(52) U.S. Cl.

CPC ..... *E21B 43/2607* (2020.05); *F04B 53/164* (2013.01); *F04B 53/22* (2013.01)

(58) Field of Classification Search

CPC ..... F04B 53/16; F04B 53/162; F04B 53/164; F04B 53/22; E21B 43/2607

See application file for complete search history.

(56) References Cited

U.S. PATENT DOCUMENTS

| | | | |
|---|---|---|---|
| 677,137 | A | 6/1901 | Leavitt |
| 2,771,846 | A | 11/1956 | Horton et al. |
| 2,828,696 | A | 4/1958 | Wright |
| 3,062,198 | A | 11/1962 | Richardson |
| 3,181,473 | A | 5/1965 | Duron |
| 3,309,013 | A | 3/1967 | Bauer |
| 3,370,545 | A | 2/1968 | Waibel |
| 3,508,849 | A | 4/1970 | Weber |

(Continued)

FOREIGN PATENT DOCUMENTS

| | | | |
|---|---|---|---|
| CN | 105756880 | A | 7/2016 |
| CN | 108843531 | A | 11/2018 |

(Continued)

*Primary Examiner* — Thomas E Lazo

(74) *Attorney, Agent, or Firm* — Tomlinson McKinstry, P.C.

(57) ABSTRACT

A fluid end assembly made of a plurality of fluid end sections positioned in a side-by-side relationship. Each fluid end section comprises a plurality of individual components joined together in a row. Two sets of fasteners are used to secure various components of each fluid end section together. When the fluid end section is assembled, a first set of fasteners is in a spaced relationship with and faces a second set of fasteners. At least one component making up the multi-piece fluid end section is configured to have a plurality of stay rods attached thereto. The stay rods interconnect the fluid end assembly and a power end assembly.

20 Claims, 70 Drawing Sheets

(56) References Cited

U.S. PATENT DOCUMENTS

| | | | | |
|---|---|---|---|---|
| 3,528,613 | A | 9/1970 | Berlyn | |
| 3,531,052 | A | 9/1970 | Berlyn | |
| 3,702,624 | A | 11/1972 | Fries | |
| 3,746,483 | A | 7/1973 | Hindel et al. | |
| 3,777,779 | A | 12/1973 | Schwaller | |
| 4,078,574 | A | 3/1978 | Kosarzecki | |
| 4,174,194 | A | 11/1979 | Hammelmann | |
| 4,412,792 | A | 11/1983 | LaBorde et al. | |
| 4,551,077 | A * | 11/1985 | Pacht | F04B 53/109 417/454 |
| 4,616,983 | A | 10/1986 | Hanafi | |
| 4,878,815 | A | 11/1989 | Stachowiak | |
| 4,960,039 | A | 10/1990 | Robertson | |
| 5,037,276 | A | 8/1991 | Tremoulet, Jr. | |
| 5,059,101 | A | 10/1991 | Valavaara | |
| 5,064,354 | A | 11/1991 | Robertson et al. | |
| 5,127,807 | A * | 7/1992 | Eslinger | F04B 53/147 417/539 |
| 5,230,363 | A | 7/1993 | Winn et al. | |
| 5,253,987 | A | 10/1993 | Harrison | |
| 5,302,087 | A | 4/1994 | Pacht | |
| 5,382,057 | A | 1/1995 | Richter | |
| 5,605,449 | A | 2/1997 | Reed | |
| 5,636,975 | A | 6/1997 | Tiffany et al. | |
| 5,924,853 | A | 7/1999 | Pacht | |
| 6,231,323 | B1 | 5/2001 | Jezek | |
| 6,341,950 | B1 | 1/2002 | Schuller et al. | |
| 8,240,634 | B2 | 8/2012 | Jarchau et al. | |
| 9,188,122 | B1 * | 11/2015 | Reed | F16K 15/066 |
| 9,328,745 | B2 | 5/2016 | Bartlok et al. | |
| 9,371,919 | B2 | 6/2016 | Forrest et al. | |
| 9,670,922 | B2 | 6/2017 | Pacht | |
| 10,184,470 | B2 | 1/2019 | Barnett, Jr. | |
| D916,240 | S | 4/2021 | Nowell et al. | |
| 11,859,601 | B2 * | 1/2024 | Son | F04B 1/0452 |
| 2012/0272764 | A1 | 11/2012 | Pendleton | |
| 2013/0045123 | A1 | 2/2013 | Roman et al. | |
| 2013/0263932 | A1 | 10/2013 | Baxter et al. | |
| 2014/0127062 | A1 | 5/2014 | Buckley et al. | |
| 2014/0348677 | A1 | 11/2014 | Moeller et al. | |
| 2015/0071803 | A1 | 3/2015 | Huang | |
| 2015/0147194 | A1 | 5/2015 | Foote | |
| 2016/0090980 | A1 | 3/2016 | Howard et al. | |
| 2018/0306150 | A1 | 10/2018 | Stecklein et al. | |
| 2019/0017503 | A1 | 1/2019 | Foster et al. | |
| 2019/0032685 | A1 | 1/2019 | Foster et al. | |
| 2019/0063427 | A1 | 2/2019 | Nowell et al. | |
| 2019/0128104 | A1 | 5/2019 | Graham et al. | |
| 2019/0178243 | A1 * | 6/2019 | Nowell | F04B 53/007 |
| 2020/0182240 | A1 | 6/2020 | Nowell et al. | |
| 2021/0148349 | A1 * | 5/2021 | Nowell | F04B 15/02 |
| 2022/0243724 | A1 | 8/2022 | Li et al. | |
| 2022/0260161 | A1 | 8/2022 | Nowell et al. | |
| 2022/0412346 | A1 | 12/2022 | Nowell et al. | |

FOREIGN PATENT DOCUMENTS

| | | | |
|---|---|---|---|
| CN | 109989912 | A | 7/2019 |
| CN | 111255677 | A | 6/2020 |

* cited by examiner

FLUID END

RELATED APPLICATIONS

This application also claims the benefit of the following U.S. provisional patent applications: Ser. No. 63/416,644, authored by Foster et al., and filed on Oct. 17, 2022; Ser. No. 63/422,637, authored by Foster et al., and filed on Nov. 4, 2022; Ser. No. 63/506,222, authored by Foster et al., and filed on Jun. 5, 2023; and Ser. No. 63/508,577, authored by Foster et al., and filed on Jun. 16, 2023. The entire contents of all of the above listed provisional patent applications are incorporated herein by reference.

BACKGROUND

Various industrial applications may require the delivery of high volumes of highly pressurized fluids. For example, hydraulic fracturing (commonly referred to as "fracking") is a well stimulation technique used in oil and gas production, in which highly pressurized fluid is injected into a cased wellbore. As shown for example in FIG. 1, the pressured fluid flows through perforations 10 in a casing 12 and creates fractures 14 in deep rock formations 16. Pressurized fluid is delivered to the casing 12 through a wellhead 18 supported on the ground surface 20. Sand or other small particles (commonly referred to as "proppants") are normally delivered with the fluid into the rock formations 16. The proppants help hold the fractures 14 open after the fluid is withdrawn. The resulting fractures 14 facilitate the extraction of oil, gas, brine, or other fluid trapped within the rock formations 16.

Fluid ends are devices used in conjunction with a power source to pressurize the fluid used during hydraulic fracturing operations. A single fracking operation may require the use of two or more fluid ends at one time. For example, six fluid ends 22 are shown operating at a wellsite 24 in FIG. 2. Each of the fluid ends 22 is attached to a power end 26 in a one-to-one relationship. The power end 26 serves as an engine or motor for the fluid end 22. Together, the fluid end 22 and power end 26 function as a high-pressure pump.

Continuing with FIG. 2, a single fluid end 22 and its corresponding power end 26 are typically positioned on a truck bed 28 at the wellsite 24 so that they may be easily moved, as needed. The fluid and proppant mixture to be pressurized is normally held in large tanks 30 at the wellsite 24. An intake piping system 32 delivers the fluid and proppant mixture from the tanks 30 to each fluid end 22. A discharge piping system 33 transfers the pressurized fluid from each fluid end 22 to the wellhead 18, where it is delivered into the casing 12 shown in FIG. 1.

Fluid ends operate under notoriously extreme conditions, enduring the same pressures, vibrations, and abrasives that are needed to fracture the deep rock formations 16, shown in FIG. 1. Fluid ends may operate at pressures of 5,000-15,000 pounds per square inch (psi) or greater. Fluid used in hydraulic fracturing operations is typically pumped through the fluid end at a pressure of at least 8,000 psi, and more typically between 10,000 and 15,000 psi. However, the pressure may reach up to 22,500 psi. The power end used with the fluid end typically has a power output of at least 2,250 horsepower during hydraulic fracturing operations. A single fluid end typically produces a fluid volume of about 400 gallons, or 10 barrels, per minute during a fracking operation. A single fluid end may operate in flow ranges from 170 to 630 gallons per minute, or approximately 4 to 15 barrels per minute. When a plurality of fluid ends are used together, the fluid ends collectively may deliver as much as 4,200 gallons per minute or 100 barrels per minute to the wellbore.

In contrast, mud pumps known in the art typically operate at a pressure of less than 8,000 psi. Mud pumps are used to deliver drilling mud to a rotating drill bit within the wellbore during drilling operations. Thus, the drilling mud does not need to have as high of fluid pressure as fracking fluid. A fluid end does not pump drilling mud. A power end used with mud pumps typically has a power output of less than 2,250 horsepower. Mud pumps generally produce a fluid volume of about 150-600 gallons per minute, depending on the size of pump used.

In further contrast, a fluid jetting pump known in the art typically operates at pressures of 30,000-90,000 psi. Jet pumps are used to deliver a highly concentrated stream of fluid to a desired area. Jet pumps typically deliver fluid through a wand. Fluid ends do not deliver fluid through a wand. Unlike fluid ends, jet pumps are not used in concert with a plurality of other jet pumps. Rather, only a single jet pump is used to pressurize fluid. A power end used with a jet pump typically has a power output of about 1,000 horsepower. Jet pumps generally produce a fluid volume of about 10 gallons per minute.

High operational pressures may cause a fluid end to expand or crack. Such a structural failure may lead to fluid leakage, which leaves the fluid end unable to produce and maintain adequate fluid pressures. Moreover, if proppants are included in the pressurized fluid, those proppants may cause erosion at weak points within the fluid end, resulting in additional failures.

It is not uncommon for conventional fluid ends to experience failure after only several hundred operating hours. Yet, a single fracking operation may require as many as fifty (50) hours of fluid end operation. Thus, a traditional fluid end may require replacement after use on as few as two fracking jobs. There is a need in the industry for a fluid end configured to avoid or significantly delay the structures or conditions that cause wear or failures within a fluid end.

BRIEF DESCRIPTION OF THE DRAWINGS

First Embodiment

FIG. 99 is a cross-sectional view of the fluid end section shown in FIG. 94, taken along line AF-AF.

FIG. 119 is a rear perspective view of the retention plate shown in FIG. 118.

FIG. 120 is a front perspective and exploded view of the fluid end section shown in FIG. 94.

DETAILED DESCRIPTION

Fluid End Assembly

Figure 3:
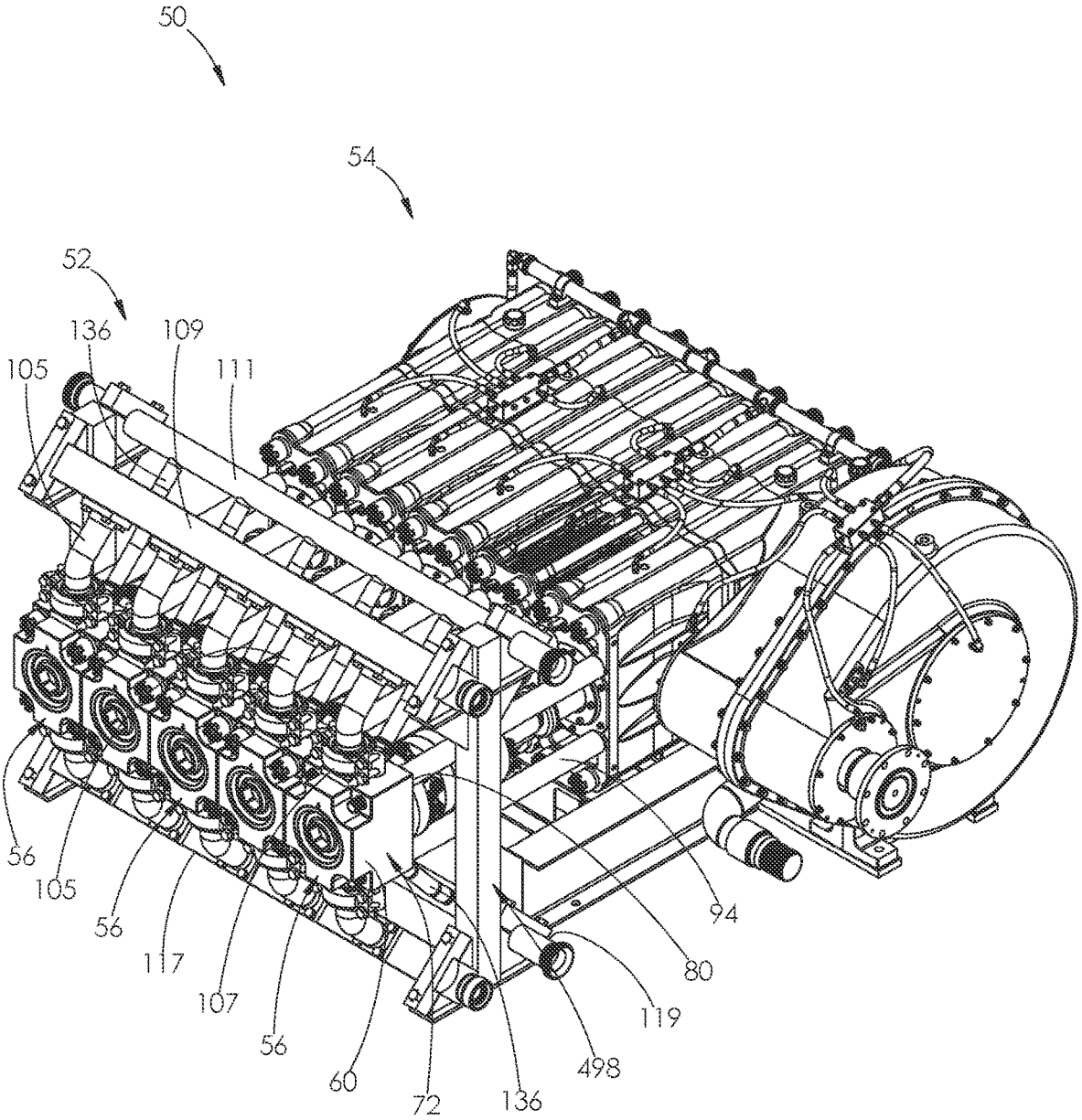
FIG. 3 is a front perspective view of one embodiment of a high pressure pump disclosed herein.
Figure 85:
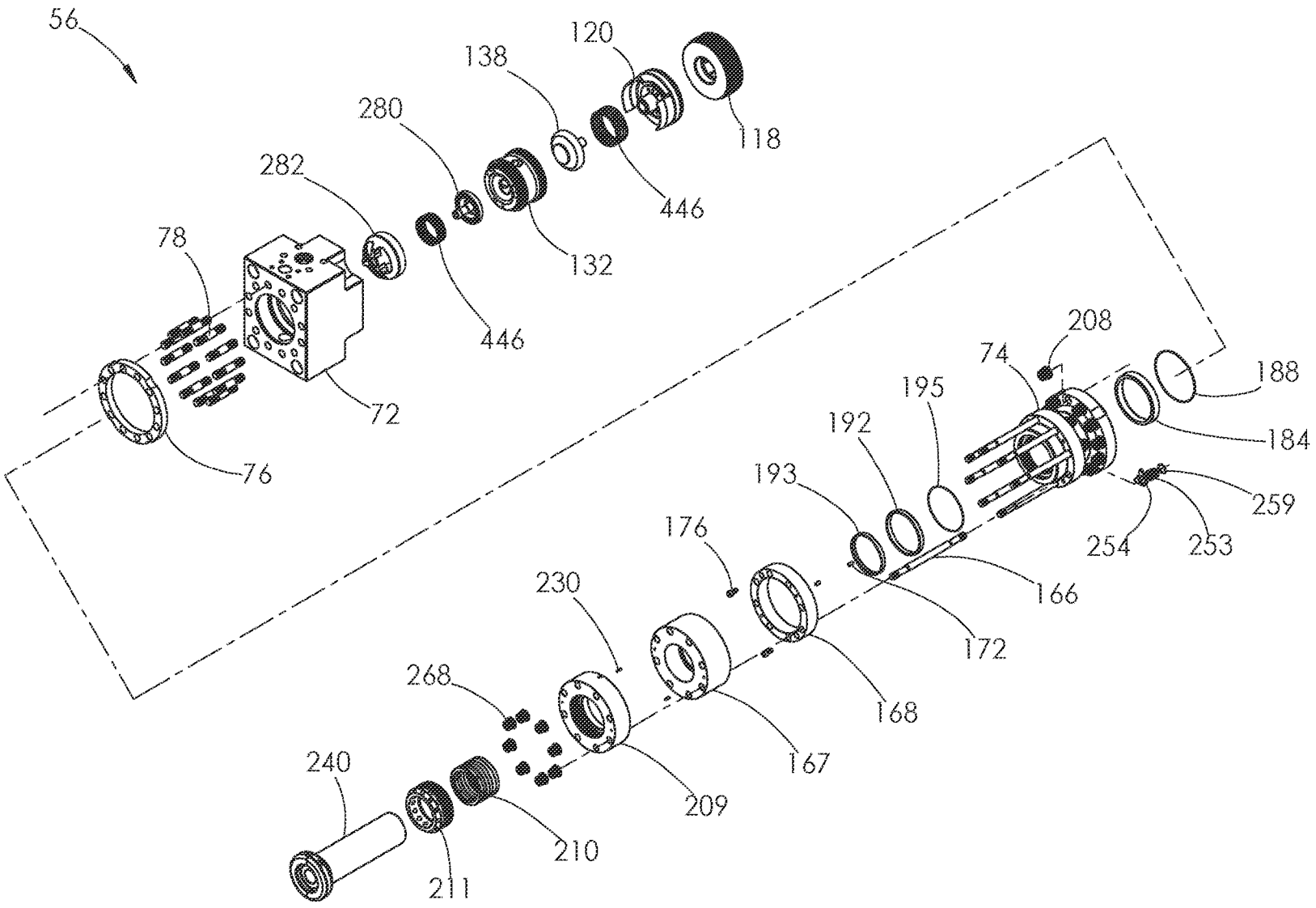
FIG. 85 is a rear perspective and exploded view of the fluid end section shown in FIG. 9.

Turning now to FIGS. 3-85, a high pressure pump 50 is shown in FIG. 3. The pump 50 comprises a fluid end assembly 52 joined to a power end assembly 54. The power end assembly 54 is described in more detail in U.S. patent application Ser. No. 17/884,691, authored by Keith et al., and filed on Aug. 10, 2022, the entire contents of which are incorporated herein by reference (hereinafter "the '691 application"). In alternative embodiments, the fluid end assembly 52 may be attached to other power end designs known in the art. The fluid end assembly 52 and its various embodiments are described herein.

Fluid End Section

Figure 4:
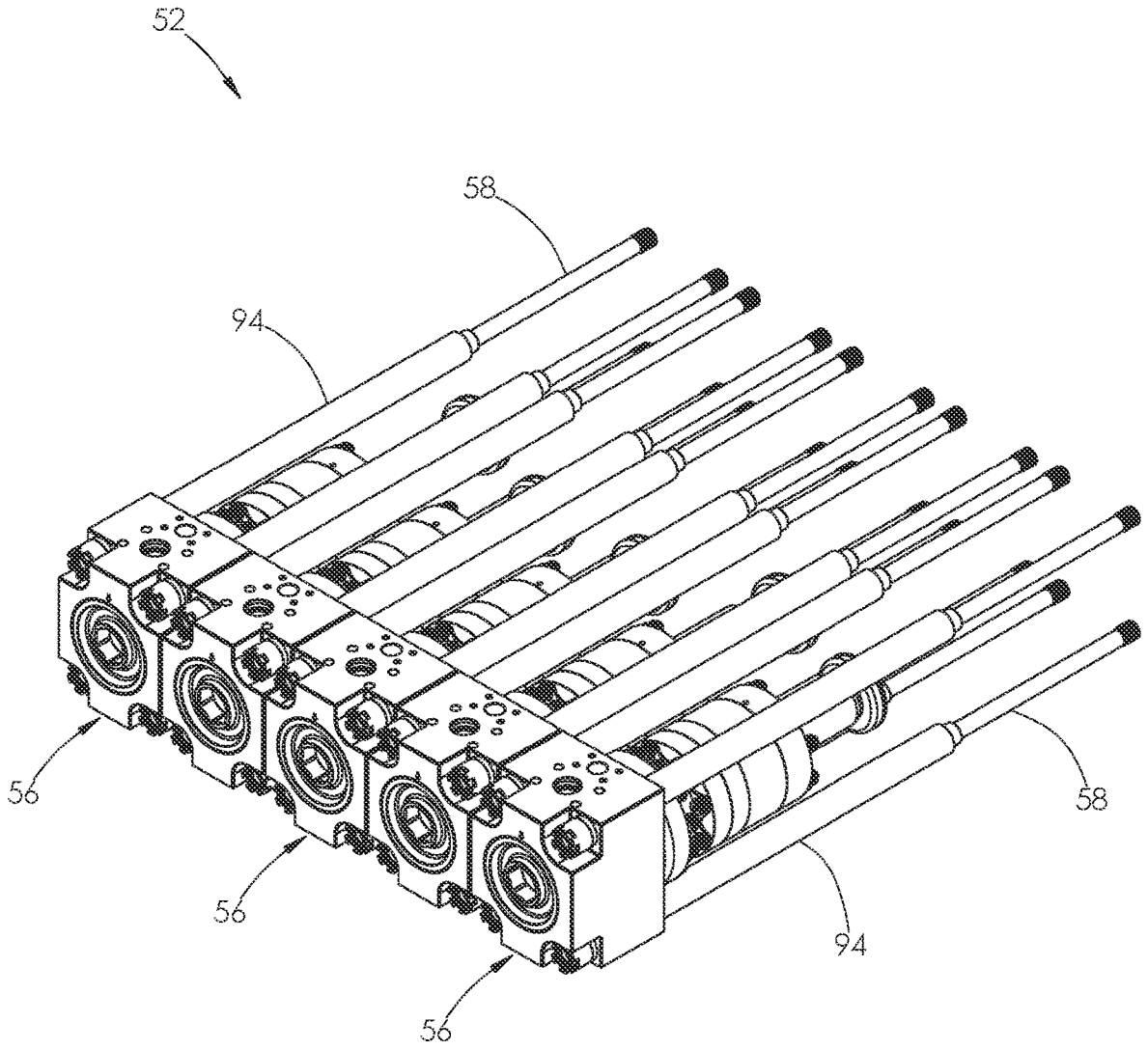
FIG. 4 is a front perspective view of the fluid end assembly shown in FIG. 3 attached to a plurality of stay rods.
Figure 5:
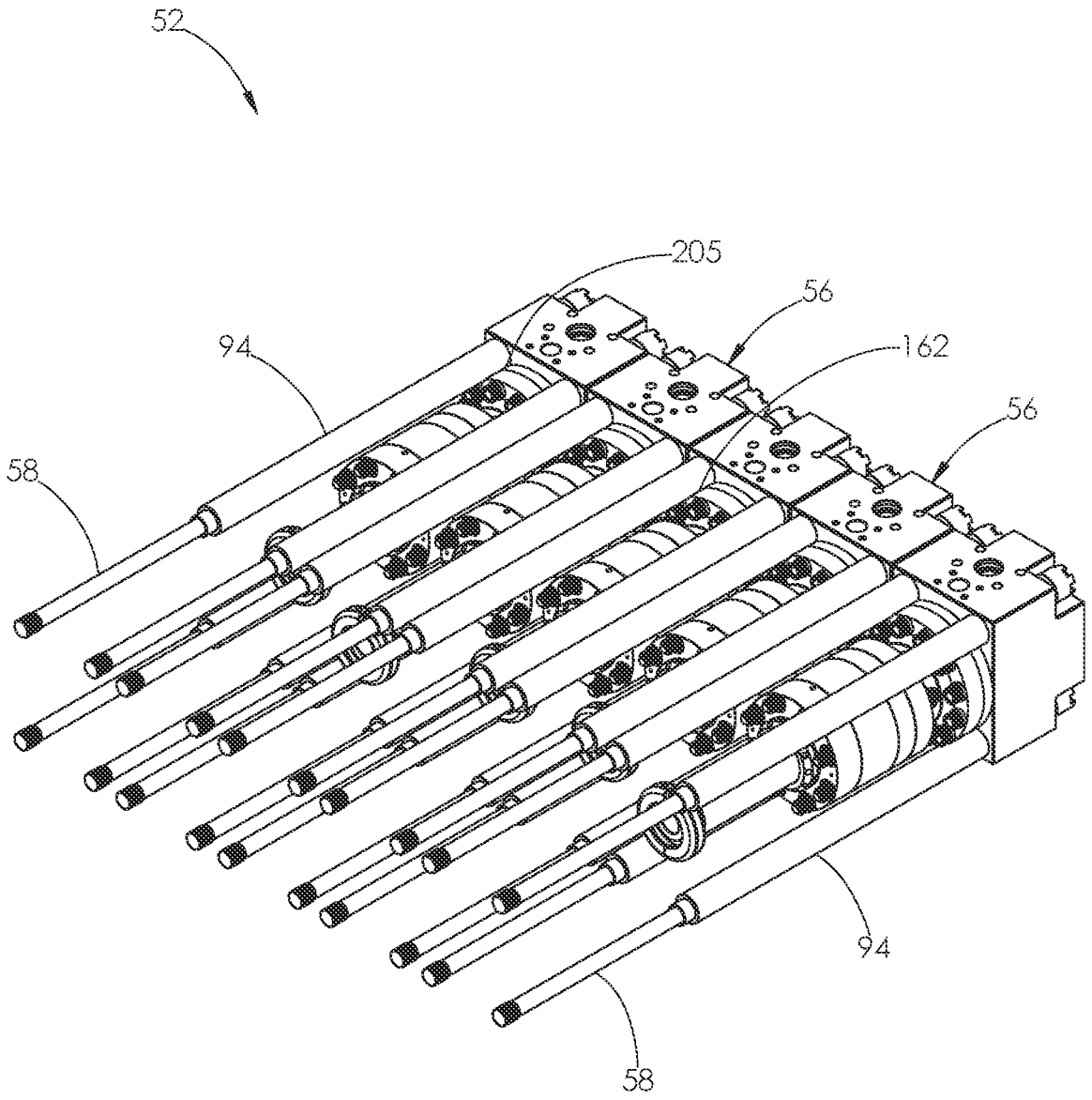
FIG. 5 is a rear perspective view of the fluid end assembly and stay rods shown in FIG. 4.
Figure 6:
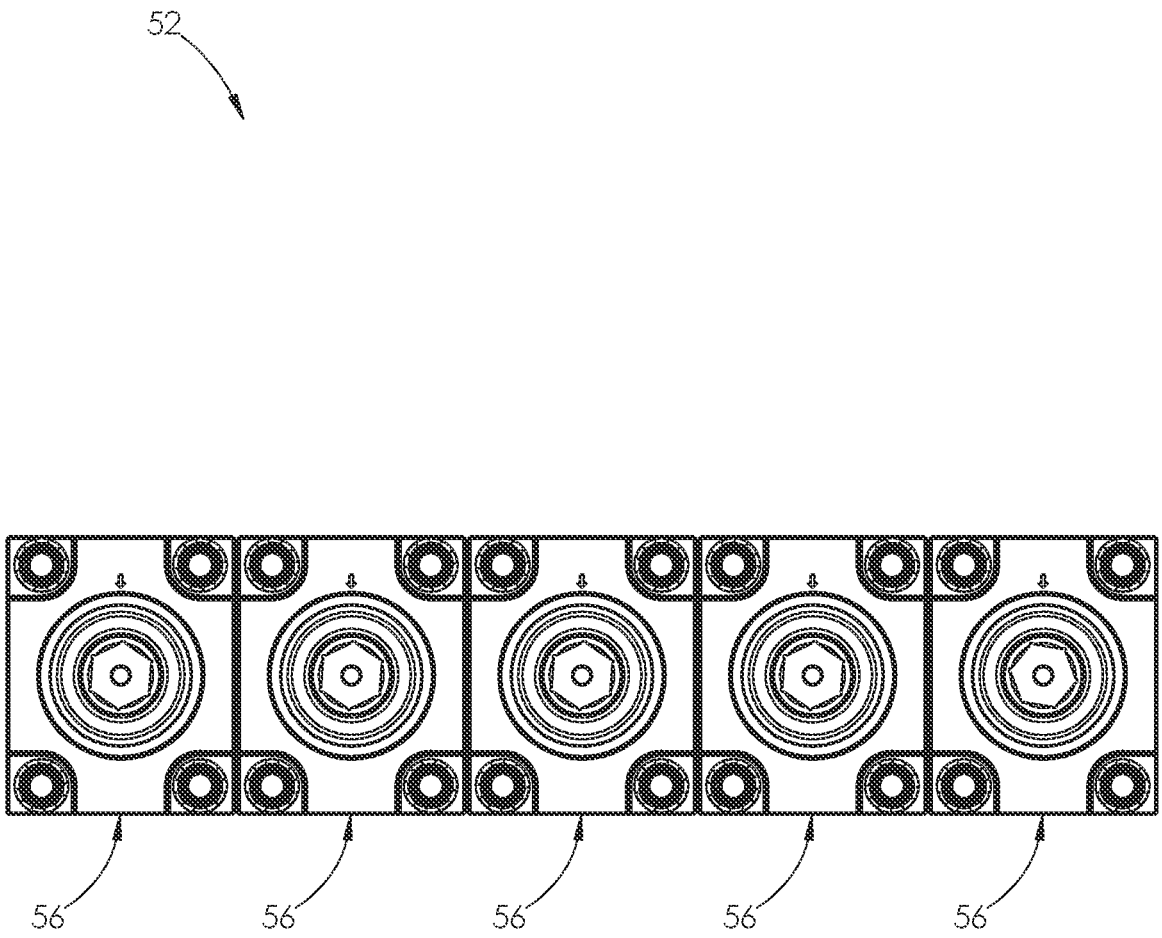
FIG. 6 is a front elevational view of the fluid end assembly and stay rods shown in FIG. 4.
Figure 7:
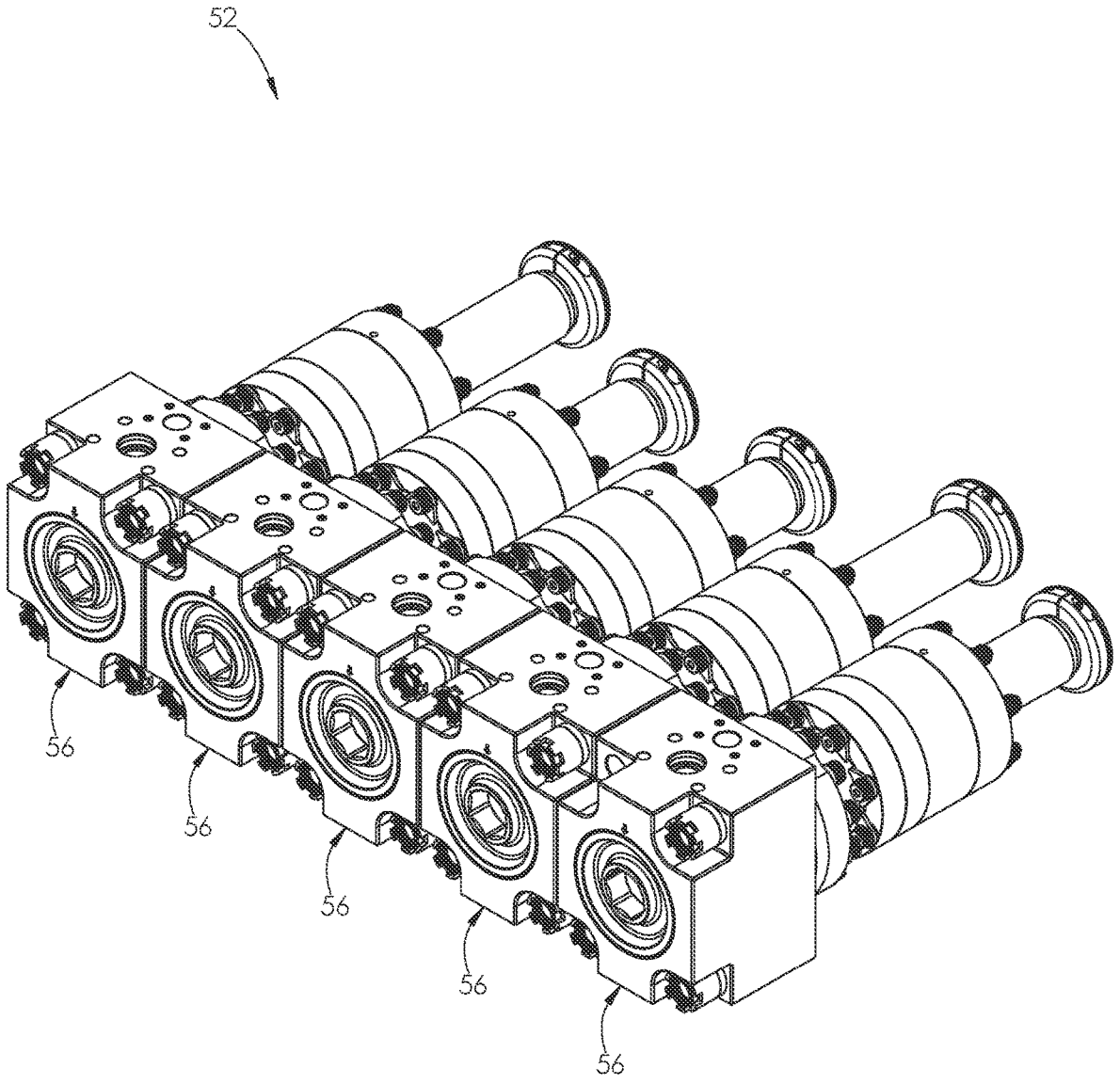
FIG. 7 is a front perspective view of the fluid end assembly shown in FIGS. 3 and 4.
Figure 8:
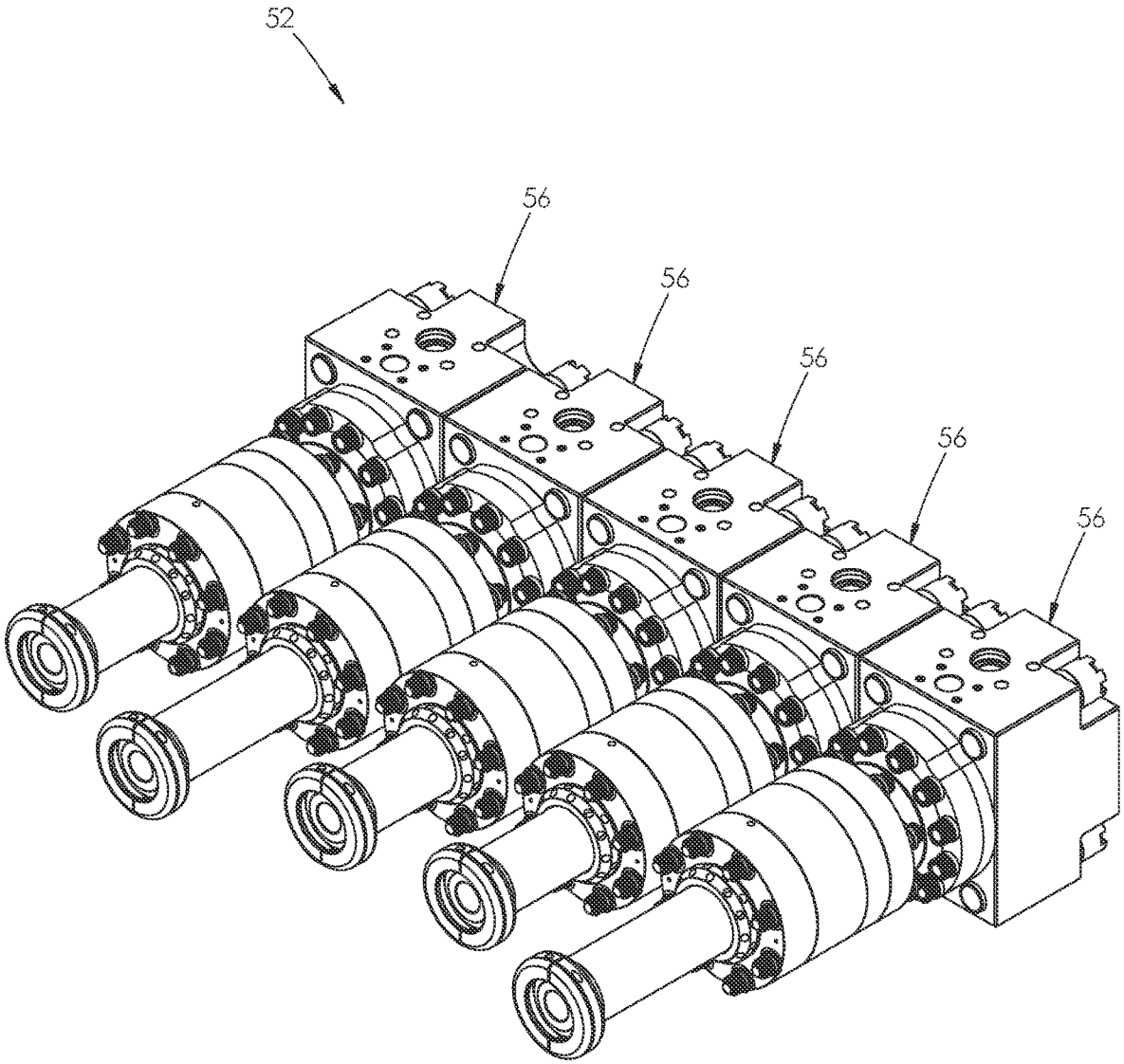
FIG. 8 is a rear perspective view of the fluid end assembly shown in FIG. 7.

Turning to FIGS. 4-10, the fluid end assembly 52 comprises a plurality of fluid end sections 56 positioned in a side-by-side relationship, as shown in FIGS. 6-8. Each fluid end section 56 is attached to the power end assembly 54 using a plurality of stay rods 58, each surrounded by a sleeve 94, as shown in FIGS. 4 and 5. Preferably, the fluid end assembly 52 comprises five fluid end sections 56 positioned adjacent one another. In alternative embodiments, the fluid end assembly 52 may comprise more or less than five fluid end sections 56. In operation, a single fluid end section 56 may be removed and replaced without removing the other fluid end sections 56 from the fluid end assembly 52.

Housing of Fluid End Section

Figure 11:
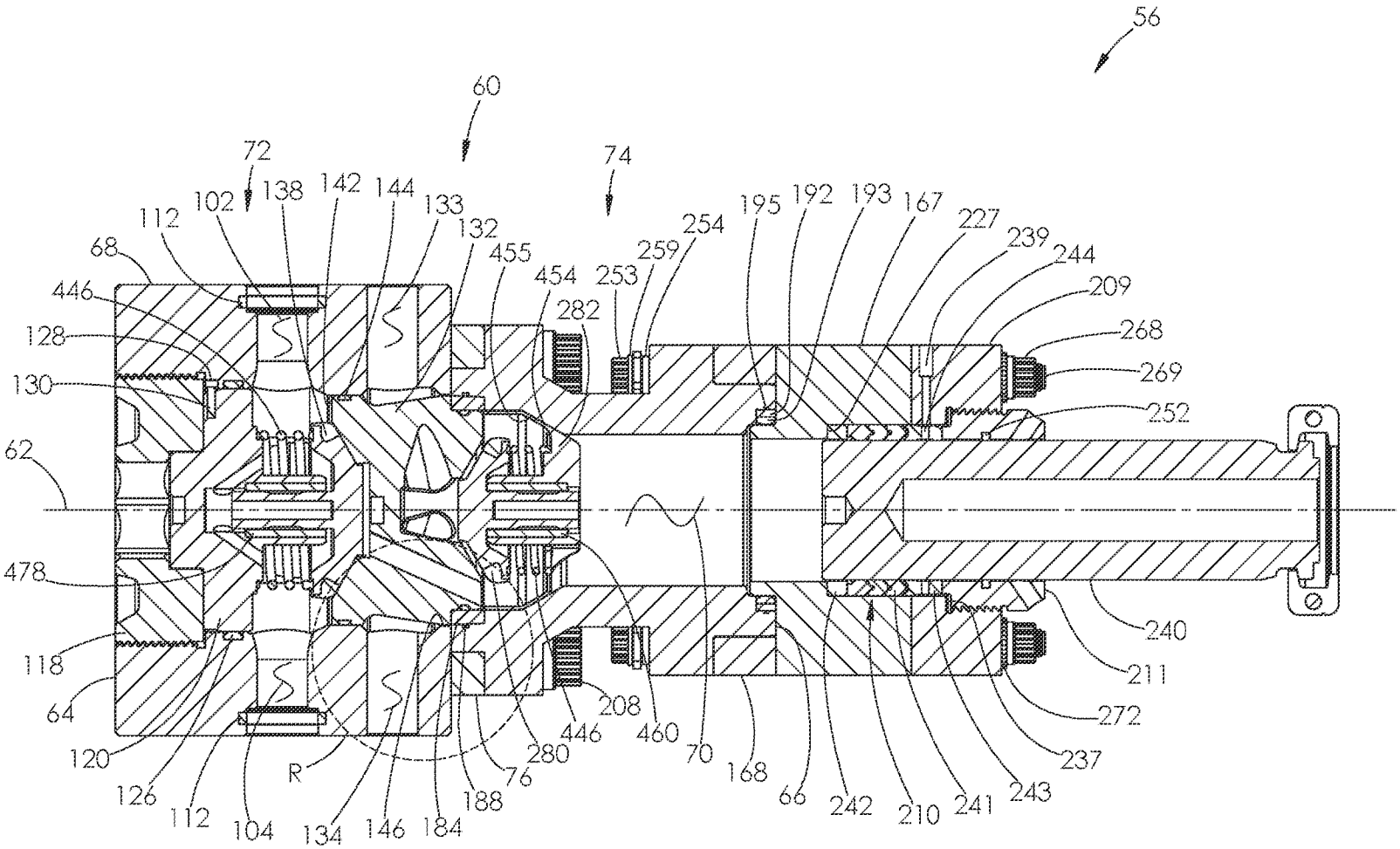
FIG. 11 is a cross-sectional view of the fluid end section shown in FIG. 9, taken along lines A-A, but the plunger is shown retracted.
Figure 12:
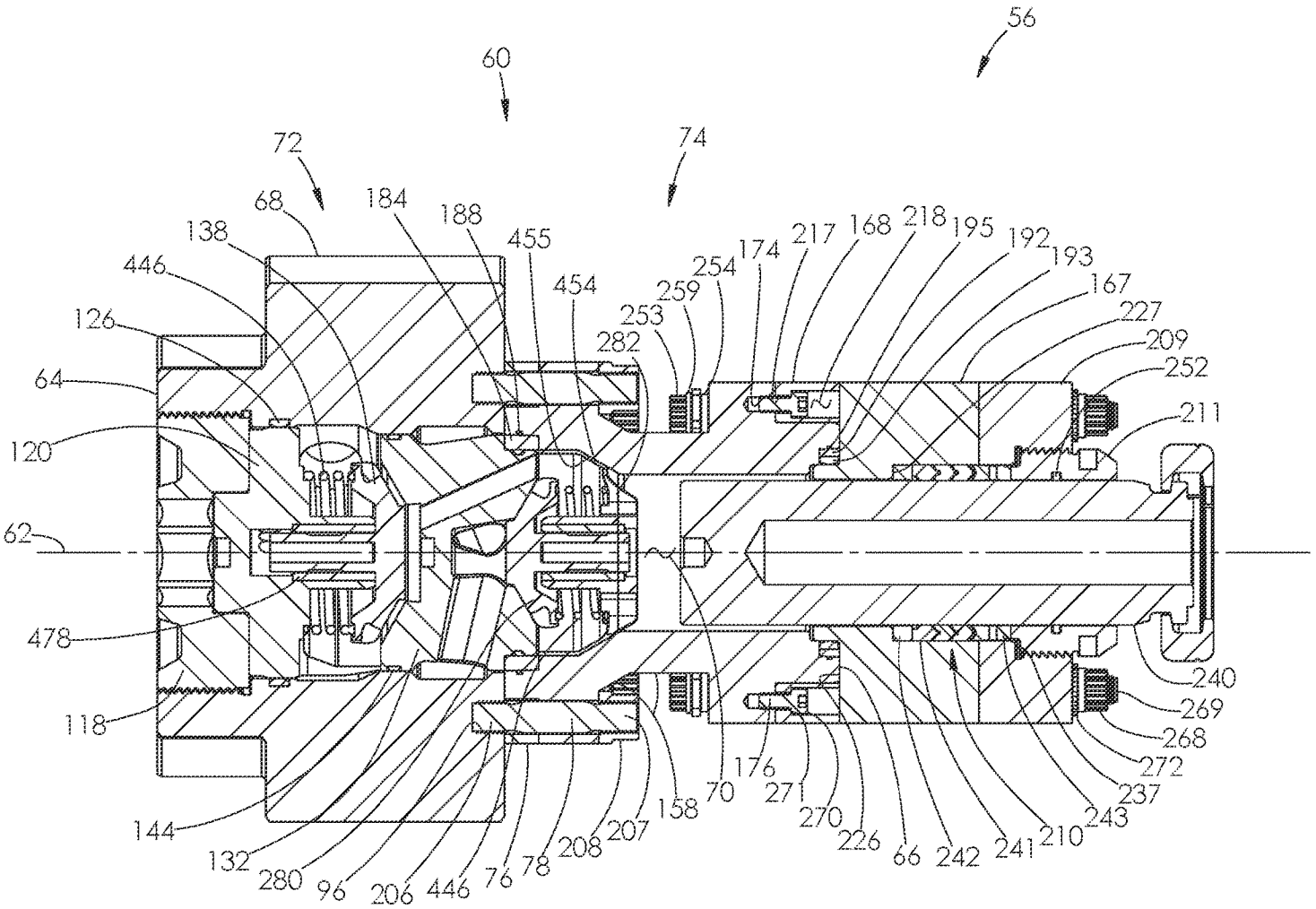
FIG. 12 is a cross-sectional view of the fluid end section shown in FIG. 9, taken along lines B-B.
Figure 13:
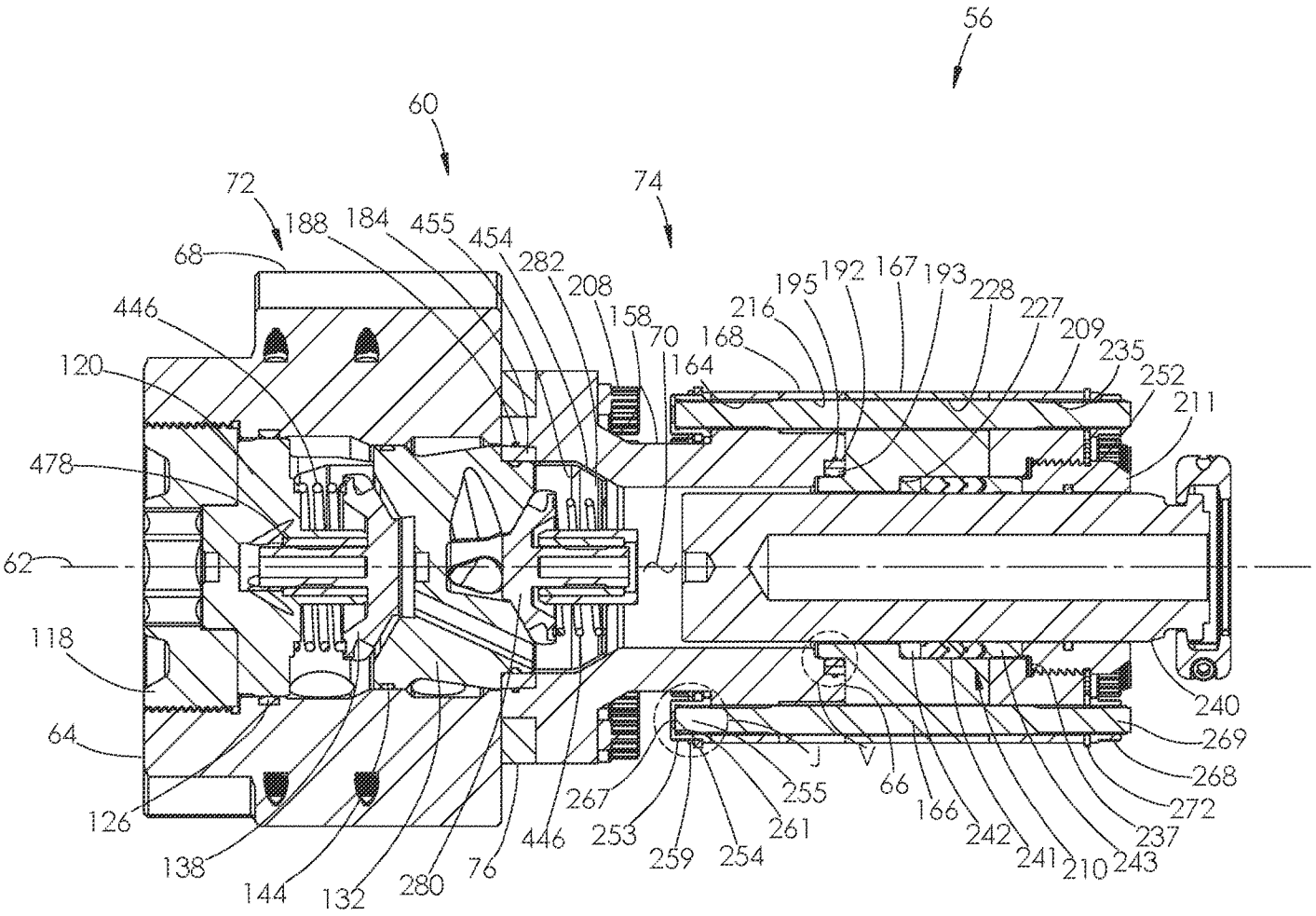
FIG. 13 is a cross-sectional view of the fluid end section shown in FIG. 9, taken along lines C-C.
Figure 14:
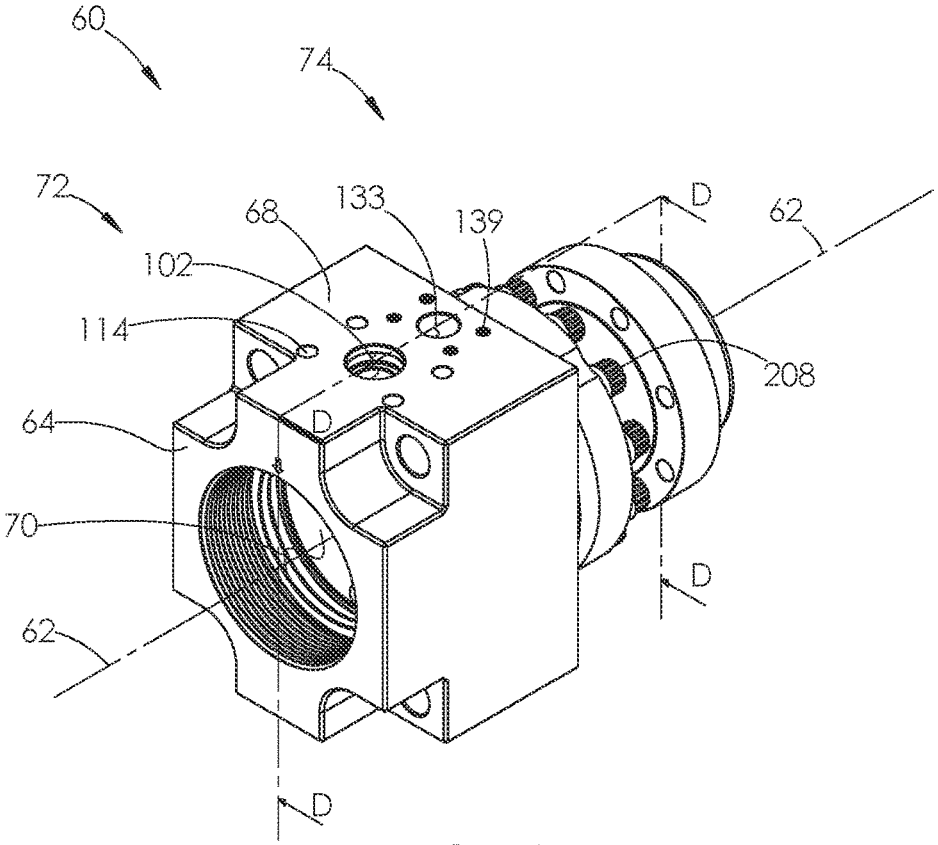
FIG. 14 is a front perspective view of the housing of the fluid end section shown in FIG. 9.
Figure 15:
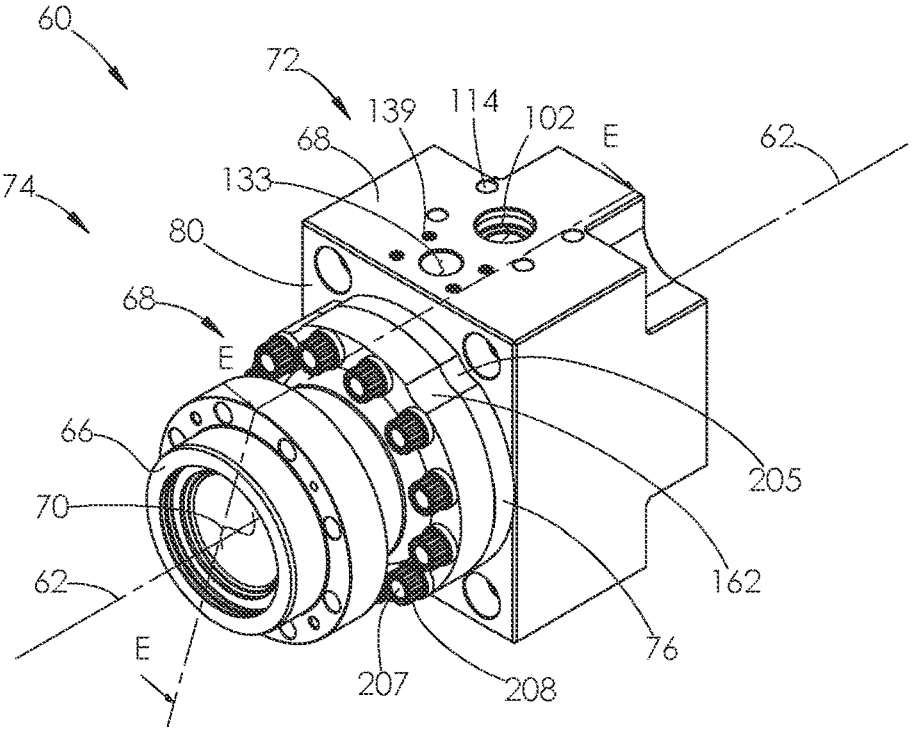
FIG. 15 is a rear perspective view of the housing shown in FIG. 14.
Figure 16:
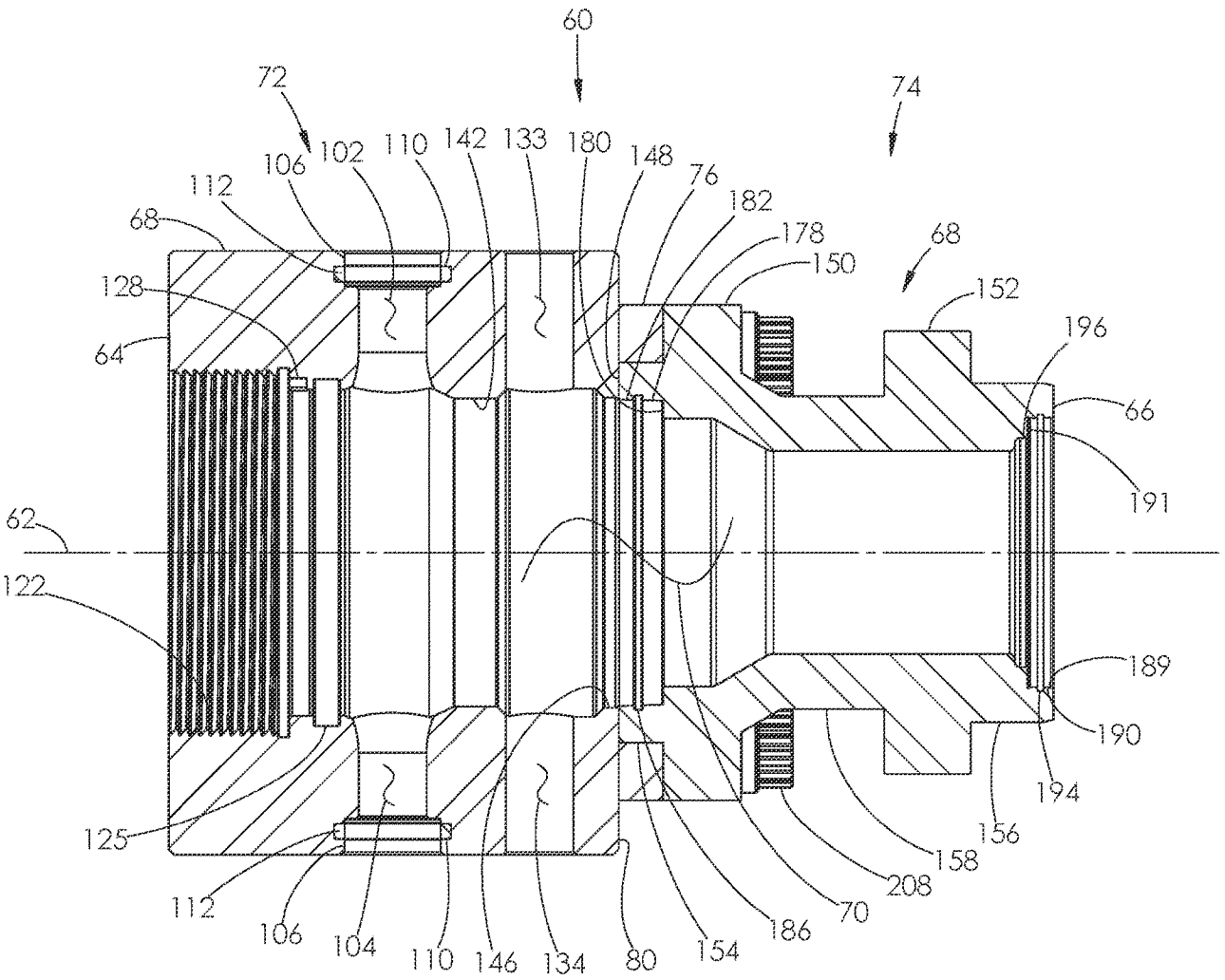
FIG. 16 is a cross-sectional view of the housing shown in FIG. 14, taken along line D-D.
Figure 17:
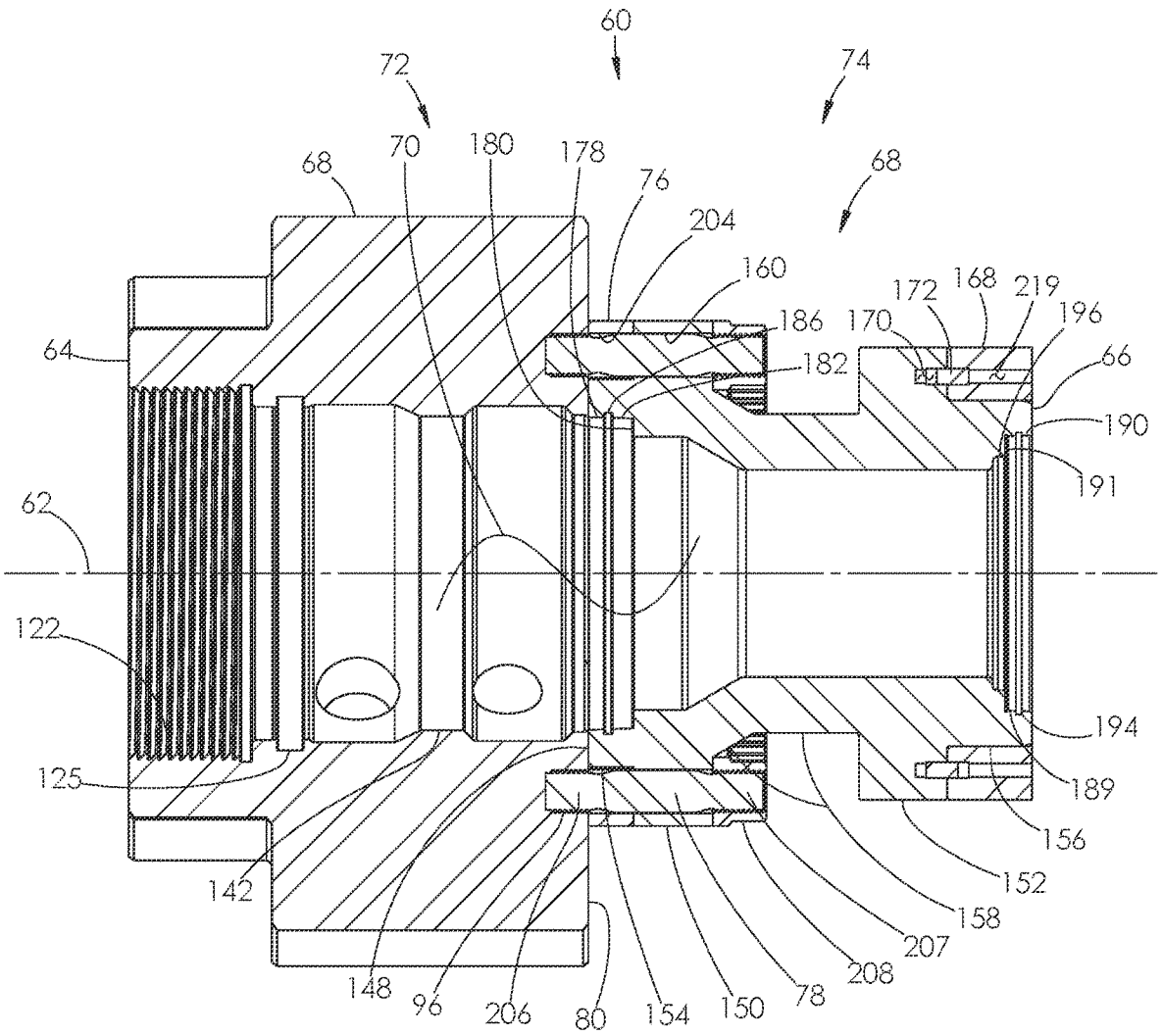
FIG. 17 is a cross-sectional view of the housing shown in FIG. 14, taken along line E-E. The rear spacer sleeve is also shown installed on the second section of the housing.

With reference to FIGS. 11-17, each fluid end section 56 comprises a horizontally positioned housing 60 having a longitudinal axis 62 extending therethrough, as shown in FIGS. 14 and 15. The housing 60 has opposed front and rear surfaces 64 and 66 joined by an outer intermediate surface 68. A horizontal bore 70 is formed within the housing 60 and interconnects the front and rear surfaces 64 and 66, as shown in FIGS. 16 and 17. The horizontal bore 70 is sized to receive various components configured to route fluid throughout the housing 60, as shown in FIGS. 11-13. The various components will be described in more detail later herein.

The housing 60 is of multi-piece construction. The housing 60 comprises a first section 72 joined to a second section 74 by a plurality of first fasteners 78, as shown in FIG. 17. Positioned intermediate the first and second sections 72 and 74 is a front spacer sleeve 76. The first fasteners 78 also extend through the front spacer sleeve 76. By making the housing 60 out of multiple pieces rather than a single, integral piece, either one of the sections 72 and 74 may be removed and replaced with a new section 72 and 74, without replacing the other sections. For example, if a portion of the second section 74 begins to erode or crack, the second section 74 can be replaced without having to replace the first section 72. Likewise, the front spacer sleeve 76 may be removed and replaced with a new spacer sleeve 76, without replacing the sections 72 or 74. In contrast, if the housing 60 were one single piece, the entire housing would need to be replaced, resulting in much more costly repair to the fluid end assembly 52.

First Section of Housing

Figure 18:
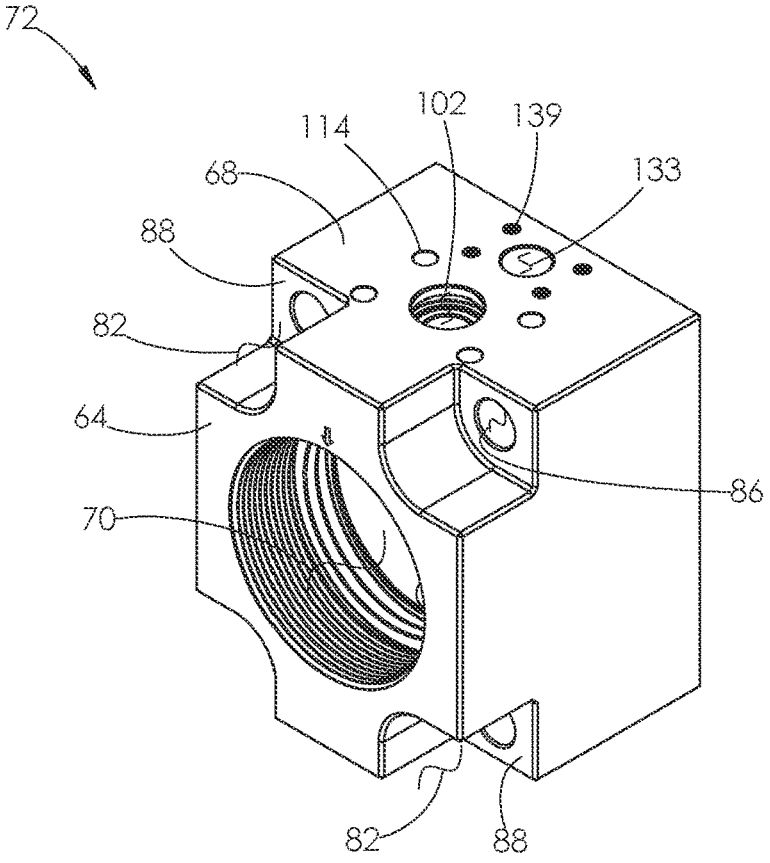
FIG. 18 is a front perspective view of the first section of the housing shown in FIG. 14.
Figure 19:
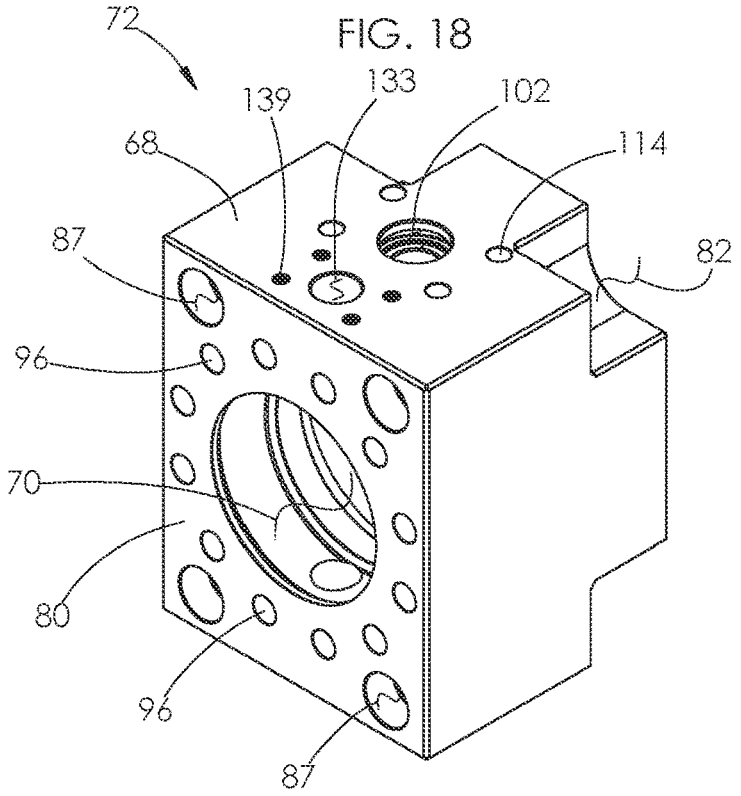
FIG. 19 is a rear perspective view of the first section shown in FIG. 18.
Figure 20:
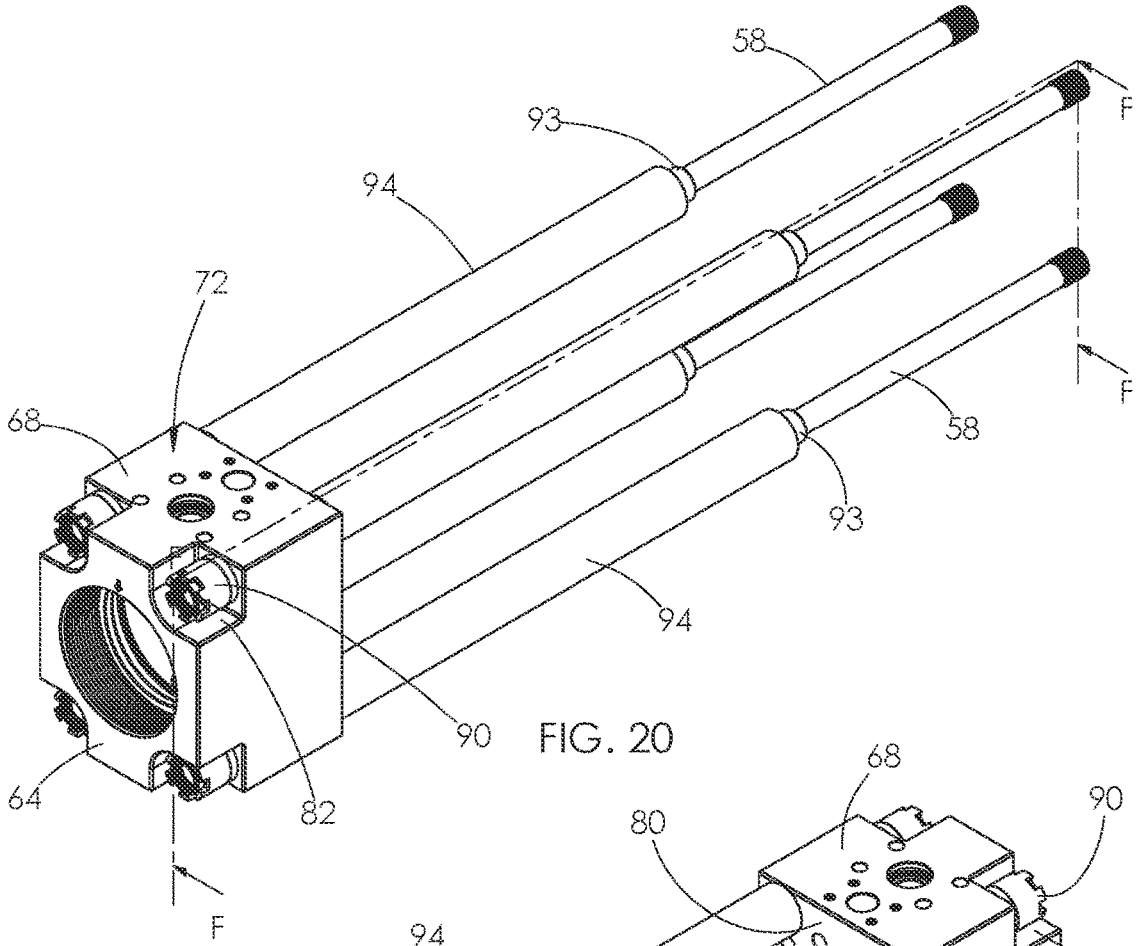
FIG. 20 is a front perspective view of the first section shown in FIG. 18, but a plurality of stay rods are attached thereto.
Figure 21:
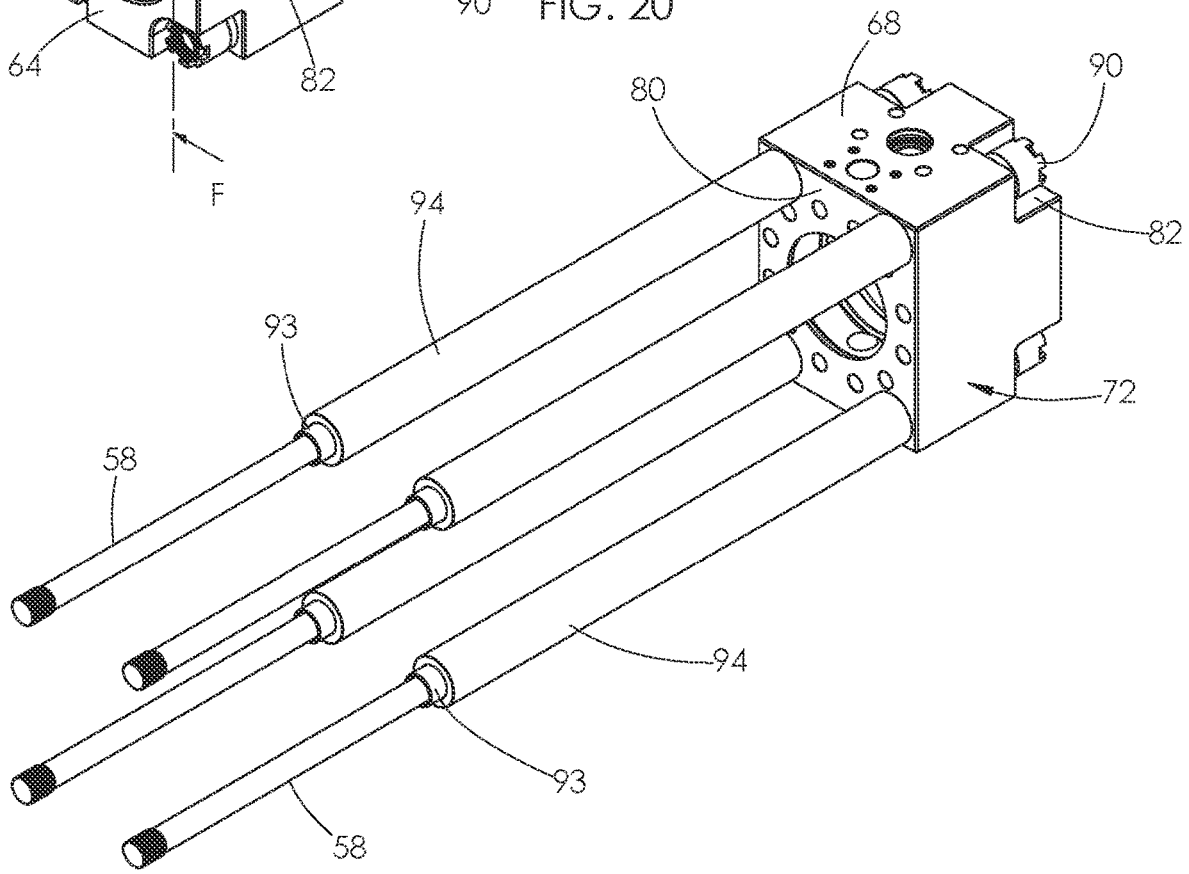
FIG. 21 is a rear perspective view of the first section and stay rods shown in FIG. 20.

Turning to FIGS. 18-21, the first section 72 is positioned at the front end of the housing 60 and includes the front surface 64. The first section 72 is configured to be attached to a plurality of the stay rods 58, as shown in FIGS. 20 and 21. Thus, each fluid end section 56 is attached to the power end assembly 54 via the first section 72 of the housing 60.

Figure 22:
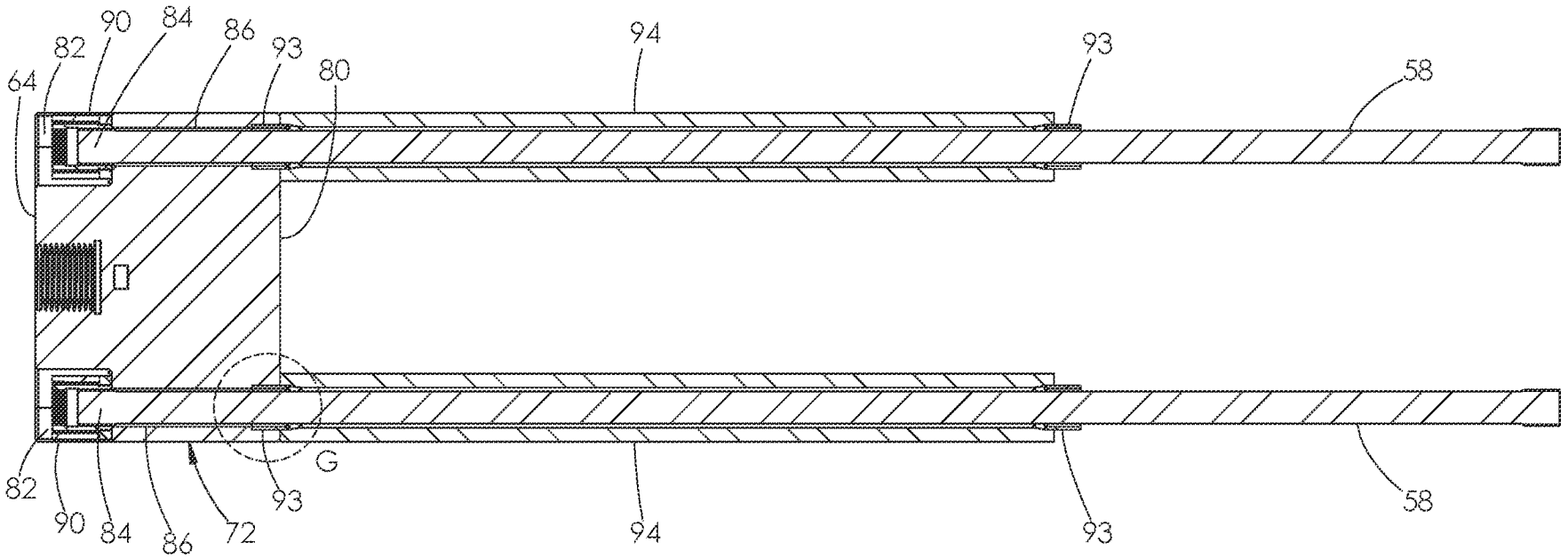
FIG. 22 is a cross-sectional view of the first section and stay rods shown in FIG. 20, taken along line F-F.

Continuing with FIGS. 18 and 19, each first section 72 comprises the front surface 64 joined to a rear surface 80. The surfaces 64 and 80 are interconnected by a portion of the outer intermediate surface 68 and a portion of the horizontal bore 70. The outer intermediate surface 68 of the first section 72 has the shape of a rectangular prism with a plurality of notches 82 formed within the front surface 64. A notch 82 is formed within each corner of the first section 72 such that the front surface 64 has a cross-sectional shape of a cross sign having radiused corners. The notches 82 are configured to receive a first end 84 of each stay rod 58, as shown in FIG. 22.

Figure 23:
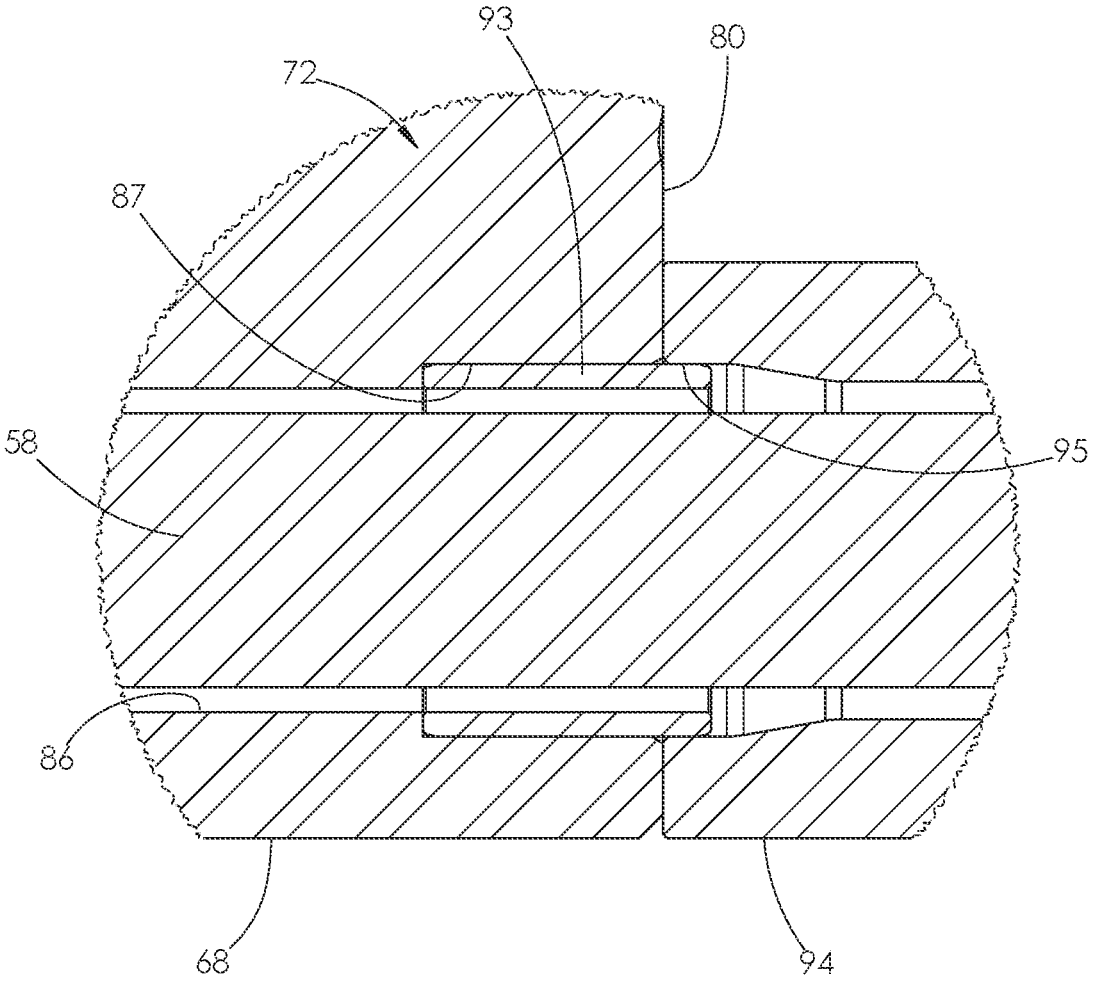
FIG. 23 is an enlarged view of area G shown in FIG. 22.

A plurality of passages 86 are formed in the first section 72. Each passage 86 interconnects the rear surface 80 and a medial surface 88 of the first section 72. The medial surface 88 is defined by the plurality of notches 82. Each passage 86 comprises a counterbore 87 that opens on the rear surface 80 and is configured to receive a corresponding one of the stay rods 58, as shown in FIG. 23. When installed within the first section 72, the first end 84 of each stay rod 58 projects from the medial surface 88 and into the corresponding notch 82, as shown in FIG. 22.

A threaded nut 90 is installed on the first end 84 of each stay rod 58 within each notch 82. The nut 90 is a three-piece nut, also known as a torque nut, which facilitates the application of high torque required to properly fasten the fluid end section 56 to the power end assembly 54. The nut 90 is described in more detail in the '691 application. In alternative embodiments, a traditional 12-point flange nut similar to the nut 208, shown in FIG. 28, may be installed on the first end 84 of each stay rod 58 instead of the nut 90.

Disposed around a portion of each stay rod 58 is a sleeve 94 that extends between the rear surface 80 of the first section 72 and the power end assembly 54, as shown in FIG. 3. A dowel sleeve 93 is inserted into each counterbore 87 formed in each passage 86, as shown in FIGS. 22 and 23. When installed therein, a portion of the dowel sleeve 93 projects from the rear surface 80 of the first section 72. A counterbore 95 is formed within the hollow interior of the sleeve 94 for receiving the projecting end of the dowel sleeve 93, as shown in FIG. 23. The dowel sleeve 93 aligns the sleeve 94 and the passage 86 concentrically. Such alignment maintains a planar engagement between the rear surface 80 of the first section 72 and the sleeve 94. When the nut 90 is torqued against the medial surface 88 of the first section 72, the sleeve 94 abuts the rear surface 80 of the first section 72, rigidly securing the first section 72 to the stay rod 58.

Turning back to FIGS. 17 and 19, a plurality of threaded openings 96 are formed in the rear surface 80 of the first section 72. The openings 96 surround an opening of the horizontal bore 70, as shown in FIG. 19. Each opening 96 is configured to receive a corresponding one of the first fasteners 78 used to secure the sections 72 and 74 and the front spacer sleeve 76 together, as shown in FIG. 17.

Turning back to FIG. 16, a pair of upper and lower discharge bores 102 and 104 are formed within the first section 72 and interconnect the intermediate surface 68 and the horizontal bore 70. The upper and lower discharge bores 102 and 104 shown in FIG. 16 are collinear. In alternative embodiments, the bores 102 and 104 may be offset from one another and not collinear. Each bore 102 and 104 is configured to interface with a discharge conduit 105, as shown in FIG. 3. Each discharge conduit 105 is in fluid communication with an upper or lower discharge manifold 109 or 117, as shown in FIG. 3.

The discharge conduits 105 may be connected to the corresponding bore 102 or 104 by a discharge fitting 107, as also shown in FIG. 3. Each discharge fitting 107 may be installed within a counterbore 106 formed in the corresponding bore 102 and 104, as shown for example in FIG. 16. A groove 110 may be formed in the side walls of the counterbore 106 for receiving a seal 112, as shown in FIG. 16. The seal 112 is configured to engage an outer surface of the discharge fitting 107 to prevent fluid from leaking between the components, as shown for example the embodiment shown in FIG. 96.

With reference to FIGS. 14 and 15, a plurality of threaded openings 114 are formed in the intermediate surface 68 and surrounding the openings of the upper and lower discharge bores 102 and 104. The threaded openings 114 are configured to receive a plurality of threaded fasteners 115 configured to secure the discharge fitting 107 to the first section 72, as shown for example in the embodiment shown in FIG. 94.

Figure 9:
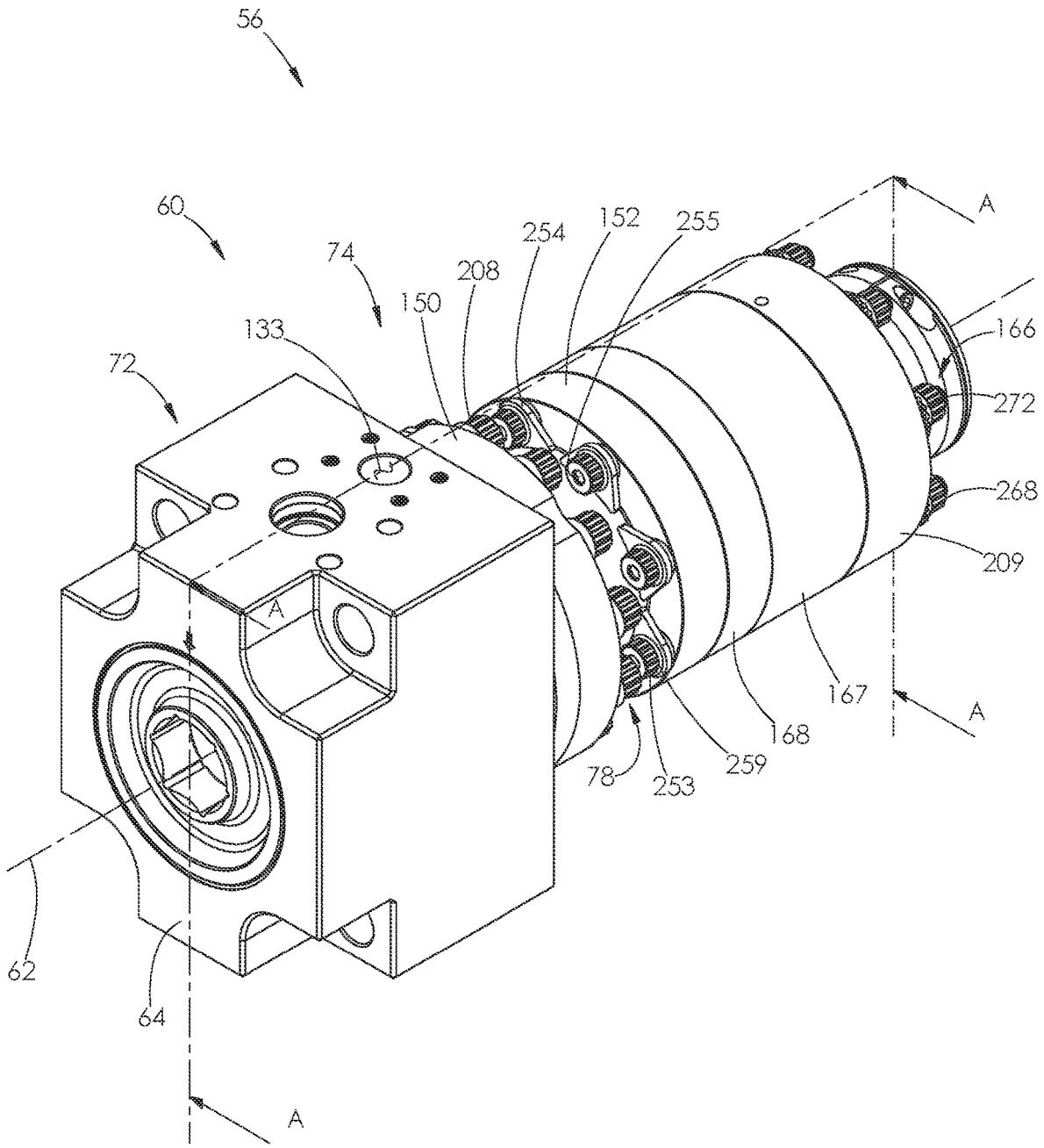
FIG. 9 is a front perspective view of one of the fluid end sections shown in FIG. 6.

Turning back to FIG. 16, a pair of upper and lower suction bores 133 and 134 are also formed within the first section 72 of the housing 60, each suction bore 133 and 134 interconnecting the intermediate surface 68 and the horizontal bore 70. The upper and lower suction bores 133 and 134 shown in FIG. 9 are collinear. In alternative embodiments, the bores 133 and 134 may be offset from one another and not collinear.

The suction bores 133 and 134 are each configured to interface with a suction conduit 136, as shown in FIG. 3. Each suction conduit 136 is in fluid communication with a an upper or lower suction manifold 111 or 119, as shown in FIG. 3. The suction conduits 136 may be attached to the intermediate surface 68 of housing 60 using a plurality of threaded openings 139, as shown in FIGS. 14 and 15. In alternative embodiments, the suction conduits may thread into a portion of the suction bores, as shown for example in the embodiment shown in FIG. 96.

Continuing with FIGS. 16 and 17, the walls surrounding the horizontal bore 70 within the first section 72 and positioned between the front surface 64 and the upper and lower discharge bores 102 and 104 are sized to receive a front retainer 118 and a discharge plug 120, as shown in FIGS. 11-13. As will be described in more detail later herein, the discharge plug 120 seals fluid from leaking from the front surface 64 of the housing 60, and the front retainer 118 secures the discharge plug 120 within the first section 72 of the housing 60.

Internal threads 122 are formed in the walls of the first section 72 for mating with external threads 124 formed on an outer surface of the front retainer 118, as shown in FIGS.

82 and 83. In contrast, an outer surface of the discharge plug 120 faces the smooth walls of the first section 72. A small amount of clearance may exist between the plug 120 and the walls of the first section 72, as shown in FIGS. 11-13.

Continuing with FIGS. 16 and 17, a groove 125 is formed in the walls surrounding the discharge plug 120. The groove 125 is sized to receive an annular seal 126 configured to engage an outer surface of the discharge plug 120, as shown in FIGS. 11-13. The seal 126 prevents fluid from leaking around the discharge plug 120 during operation. A locating cutout 128 is further formed in the walls that are configured to receive a locating dowel pin 130, as shown in FIG. 11. As will be described later herein, the locating dowel pin 130 is used to properly align the discharge plug 120 within the housing 60.

Staying with FIGS. 11-13, the walls surrounding the horizontal bore 70 within the first section 72 of the housing 60 are configured to receive a majority of a fluid routing plug 132 as well as a discharge valve 138, both of which will be described in more detail later herein. The fluid routing plug 132 is configured to route fluid throughout the housing 60. Portions of the fluid routing plug 132 may engage or closely face the wall of the horizontal bore 70 to the front and rear of each upper and lower suction bore 133 and 134.

More specifically, a first portion 142 of the wall of the horizontal bore 70 positioned between the upper and lower discharge bores 102 and 104 and the upper and lower suction bores 133 and 134 may be characterized as a sealing surface 142. As will be described herein, the sealing surface 142 is configured to engage a seal 144 carried by the fluid routing plug 132. A second portion 146 of the wall of the horizontal bore 70 is positioned between the upper and lower suction bores 133 and 134 and the rear surface 80 of the first section 72. The second portion 146 is configured to closely face a portion of the fluid routing plug 132. A small amount of clearance may exist between the second portion 146 of the walls and an outer surface of the fluid routing plug 132.

Second Section of Housing

Figure 24:
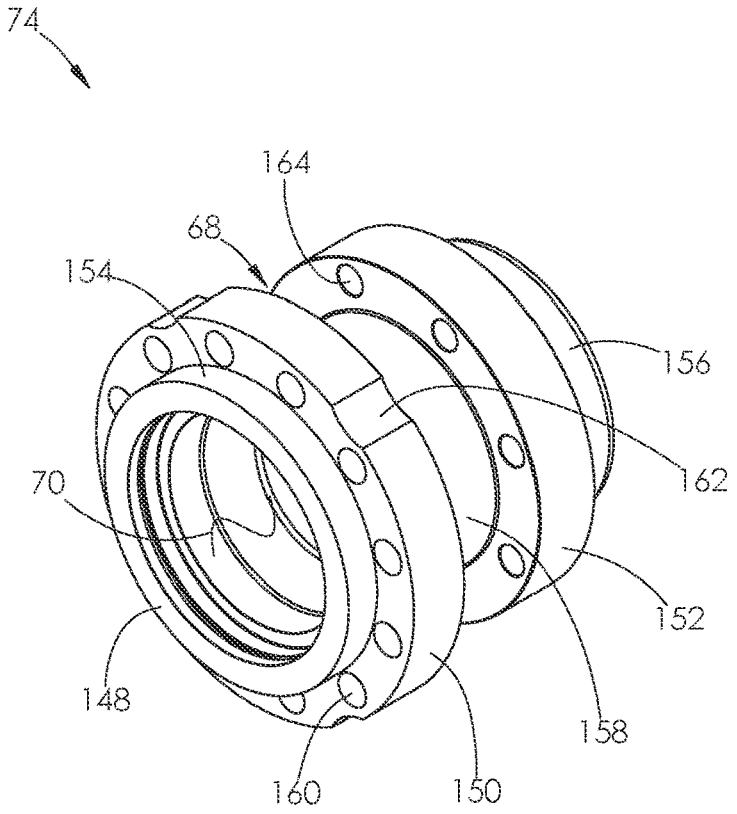
FIG. 24 is a front perspective view of the second section of the housing shown in FIG. 14.
Figure 25:
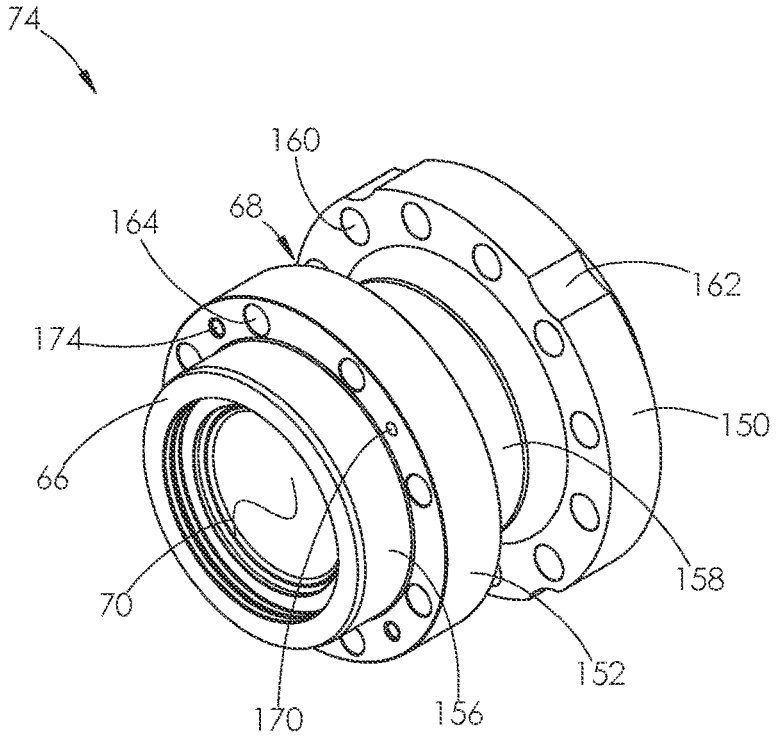
FIG. 25 is a rear perspective view of the second section of the housing shown in FIG. 24.

Turning to FIGS. 24 and 25, the second section 74 of the housing 60 includes the rear surface 66 of the housing 60. The second section 74 comprises a front surface 148 joined to the rear surface 66 by a portion of the outer intermediate surface 68 and a portion of the horizontal bore 70. The outer intermediate surface 68 comprises a front mounting flange 150 positioned adjacent the front surface 148 and a rear mounting flange 152 positioned adjacent the rear surface 66.

The front and rear mounting flanges 150 and 152 break up the intermediate surface 68 of the second section 74 such that a front projecting portion 154 of the intermediate surface 68 exists between the front surface 148 and the front mounting flange 150, and a rear projecting portion 156 of the intermediate surface 68 exists between the rear surface 66 and the rear mounting flange 152. Finally, a medial portion 158 of the intermediate surface 68 exists between the front and rear mounting flanges 150 and 152. The front and rear mounting flanges 150 and 152 each have a greater outer diameter than that of the front, rear, and medial portions 154, 156, and 158 of the intermediate surface 68, as shown in FIGS. 16 and 17. The front mounting flange 150 further has a greater outer diameter than the rear mounting flange 152.

Continuing with FIGS. 24 and 25, a plurality of first passages 160 are formed within the front mounting flange 150. The first passages 160 surround the horizontal bore 70. Each first passage 160 is configured to receive one of the first fasteners 78, as shown in FIG. 17. When the first and second sections 72 and 74 are joined together, a space exists around the front portion 154 and between the rear surface 80 of the first section 72 and the front mounting flange 150. As will be described herein, the space is sized to receive the front spacer sleeve 76. A plurality of clearance notches 162 are also formed in the outer intermediate surface 68 of the front mounting flange 150. Each clearance notch 162 is sized to partially surround a corresponding sleeve 94 and stay rod 58 when the fluid end 52 is assembled, as shown in FIG. 5.

Continuing with FIGS. 24 and 25, a plurality of second passages 164 are formed within the rear mounting flange 152. As will be described herein, the second passages 164 are configured to receive a plurality of second fasteners 166 in a one-to-one relationship, as shown in FIG. 13. When a stuffing box 167, described later herein, is attached to the second section 74, a space exists around the rear portion 156 of the second section 74 and between the rear surface 66 and the rear mounting flange 152. As will be described herein, the space is sized to receive a rear spacer sleeve 168, as shown in FIGS. 11-13.

A plurality of dowel openings 170 are also formed with the rear mounting flange 152, each opening facing the rear surface 66 of the housing 60 and is configured to receive a portion of a first dowel pin 172, as shown in FIG. 17. Each first dowel pin 172 is configured to extend between the rear mounting flange 152 and the rear spacer sleeve 168. A plurality of threaded openings 174 are further formed in the rear mounting flange 152, each opening facing the rear surface 66 of the housing 60. The threaded openings 174 are preferably diametrically opposed to one another and are each configured to receive one of a plurality of third fasteners 176, as shown in FIG. 12. The third fasteners 176 are configured to secure the rear spacer sleeve 168 to the second section 74 of the housing 60.

Turning back to FIGS. 16 and 17, a first counterbore or first annular groove 178 is formed in the wall of the horizontal bore 70 of the second section 74. The first counterbore 178 opens at the front surface 148 of the second section 74 and is characterized by a base 180 joined to a side wall 182. The side wall 182 tapers slightly between the base 180 and the front surface 148 of the second section 74. As will be described herein, the first counterbore 178 is sized to receive an annular and hardened insert 184 configured to engage a portion of the fluid routing plug 132, as shown in FIGS. 11-13. The second section 74 further comprises a first seal groove 186 formed within a center of the side wall 182 of the first counterbore 178. The first seal groove 186 is sized to receive an annular seal 188 configured to engage the annular insert 184, as shown in FIGS. 11-13.

A second counterbore or second annular groove 189 is also formed in the wall of the horizontal bore 70 of the second section 74, as shown in FIGS. 16 and 17. The second counterbore 189 opens at the rear surface 66 of the housing 60 and is characterized by a side wall 190 joined to a base 191. The side wall 190 tapers slightly between the base 191 and the rear surface 66 of the second section 74. As will be described herein, the second counterbore 189 is sized to receive an annular wear ring 192 and an annular seal 193, as shown in FIGS. 11-13. The second section 74 further comprises a second seal groove 194 formed within a center of the side wall 190 of the second counterbore 189. The second seal groove 194 is sized to receive an annular seal 195 configured to engage the wear ring 192, as shown in FIGS. 11-13. The second counterbore 189 further opens into a stuffing box counterbore 196 positioned farther within the horizontal bore 70. The stuffing box counterbore 196 is sized to receive a portion of the stuffing box 167, as shown in FIGS. 11-13.

Staying with FIGS. 11-13, the wall of the horizontal bore 70 of the second section 74 adjacent the front surface 148 is configured to receive a portion of the fluid routing plug 132, a suction valve guide 282, and a suction valve 280. The wall of the horizontal bore 70 of the second section 74 adjacent the rear surface 66 is configured to 2*s* receive a portion of the stuffing box 167 and a portion of a reciprocating plunger 240.

Front Spacer Sleeve

Figure 26:
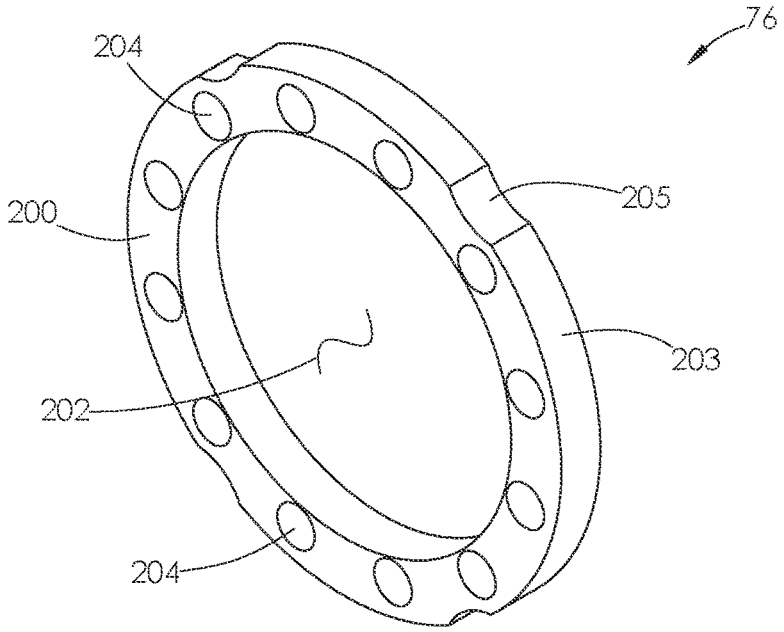
FIG. 26 is a front perspective view of the front spacer sleeve of the housing shown in FIG. 14.
Figure 27:
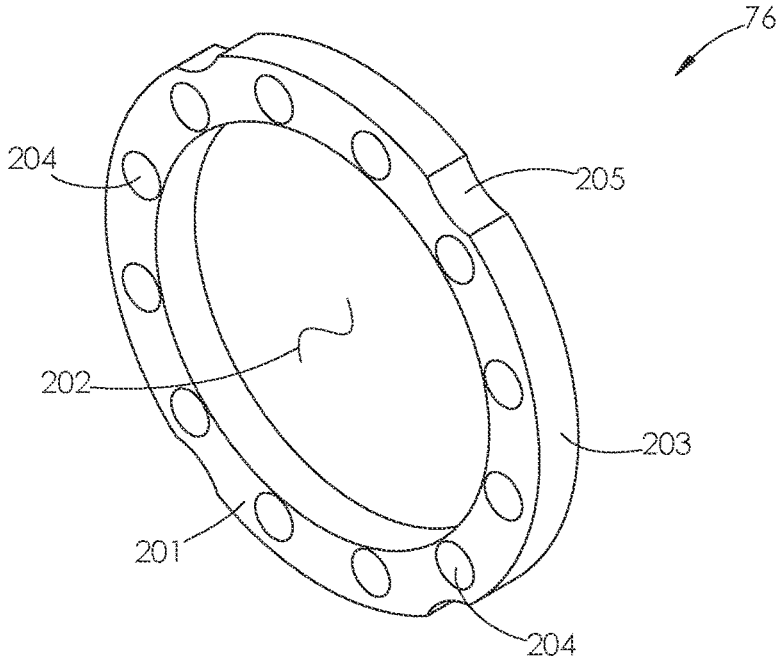
FIG. 27 is a rear perspective view of the front spacer sleeve shown in FIG. 26.

With reference to FIGS. 26 and 27, the front spacer sleeve 76 comprises opposed front and rear surfaces 200 and 201 joined by a central opening 202 and an outer intermediate surface 203. A plurality of passages 204 are formed in the front spacer sleeve 76 surrounding the central opening 202. The plurality of passages 204 are each sized to receive one of the first fasteners 78 and are positioned to correspond with the passages 96 formed in the rear surface 80 of the first section 72, as shown in FIG. 17.

Figure 10:
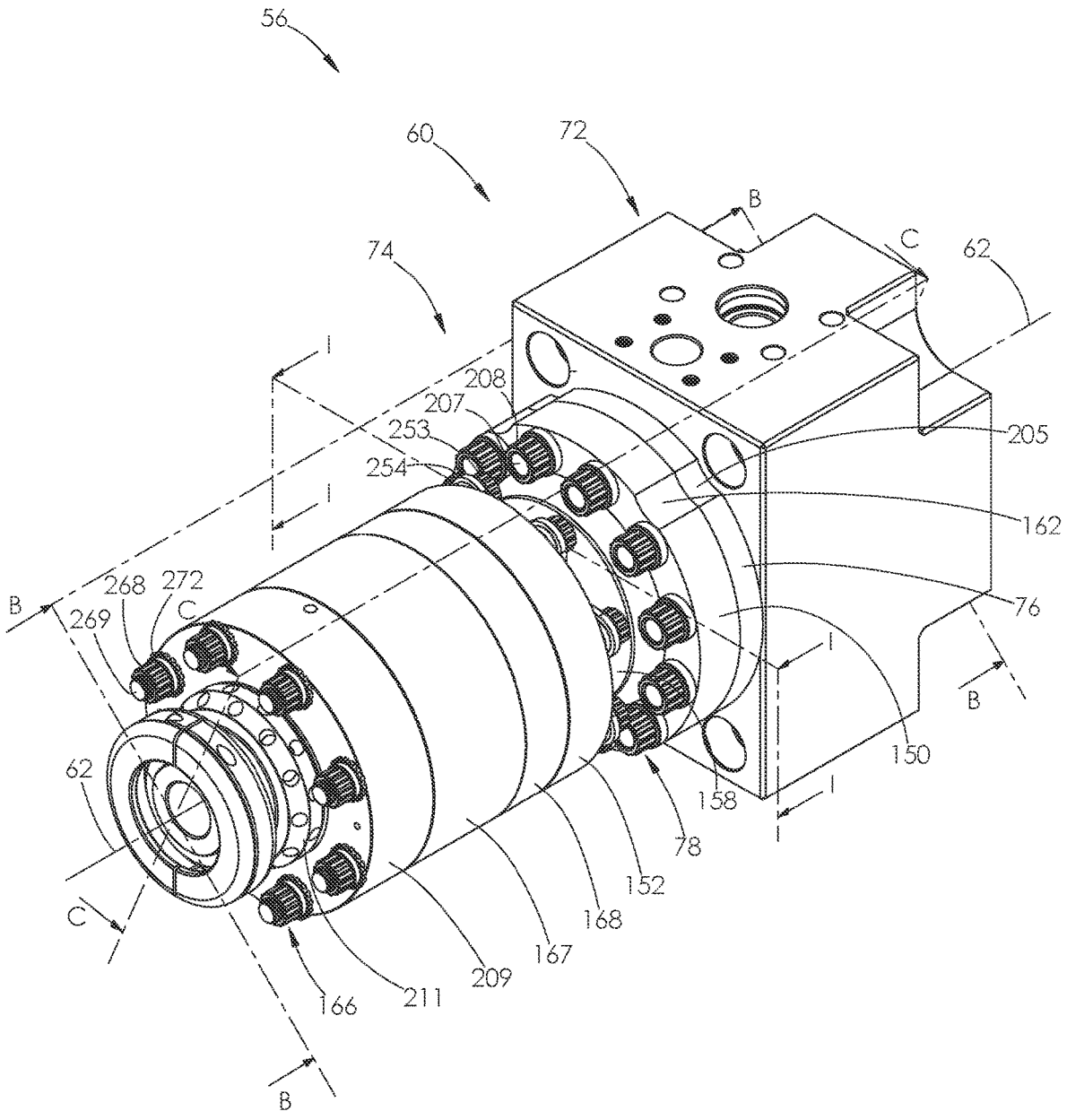
FIG. 10 is a rear perspective view of the fluid end section shown in FIG. 9.

A plurality of clearance notches 205 are formed in the outer intermediate surface 203 of the front spacer sleeve 76. Each clearance notch 205 is sized to partially surround a corresponding sleeve 94 and stay rod 58 when the fluid end 52 is assembled, as shown in FIG. 5. The clearance notches 205 align with the clearance notches 162 formed in the front mounting flange 150 of the second section 74 of the housing 60 when the fluid end 52 is assembled, as shown in FIG. 10.

The central opening 202 of the front spacer sleeve 76 is sized to receive the front portion 154 of the second section 74 of the housing 60 such that the front spacer sleeve 76 surrounds the front portion 154 of the second section 74, as shown in FIGS. 16 and 17. When the front portion 154 is installed within the central opening 202, an outer diameter of the front spacer sleeve 76 is equal or substantially equal to and aligned with an outer diameter of the front mounting flange 150.

During operation, the central opening 202 of the front spacer sleeve 76 is sized so that it never applies any meaningful compressive force to the front portion 154 of the second section 74 of the housing 60. Specifically, the front spacer sleeve 76 does not constrain the expansion of the front portion 154 of the second section 74 when the annular insert 184 is pressed into the first counterbore 178. This results in more uniform deflection of the insert 184 during installation. The stress resulting from such deflection is therefore also more uniform. As a result, stress concentration areas within the insert 184 are eliminated or significantly reduced, thereby increasing the life of the insert and extending the time between maintenance intervals for the fluid end section 56.

The front spacer sleeve 76 is also sized so that the front surface 200 of the spacer sleeve 76 shares the compressive load with the front surface 148 of the second section 74 of the housing 60. Sharing of the compressive load between the two components reduces the stress on the front surface 148 of the second section 74. The rear surface 201 of the front spacer sleeve 76 provides a reactionary surface for the front surface of the front mounting flange 150. Providing such surface reduces the bending deflection of the front mounting flange 150 and consequently the bending stress on the front mounting flange 150. The benefits provided by the front spacer sleeve 76 increase the life of the corresponding components, thereby extending the time between maintenance intervals for the fluid end section 56.

Assembly of Housing

With reference to FIG. 12, prior to assembling the housing 60, the seal 188 is installed within the first seal groove 186 formed in the second section 74 and the insert 184 is press-fit or interference fit into the first counterbore 178. The seal 188 shown in the figures is an O-ring seal, but other types of seals known in the art may also be used. The insert 184 will be described in more detail later herein.

Figure 28:
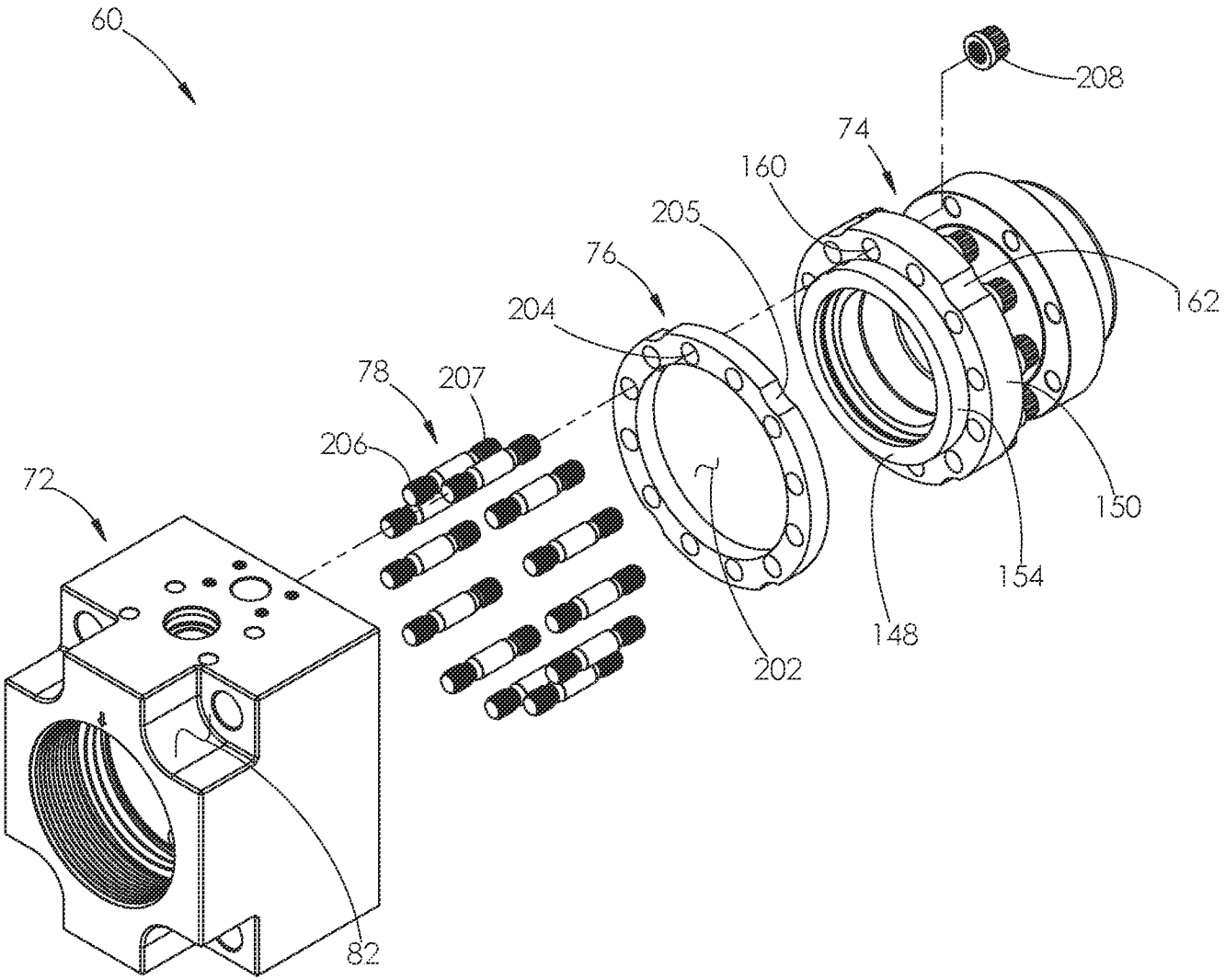
FIG. 28 is a front perspective and exploded view of the housing shown in FIG. 14.
Figure 29:
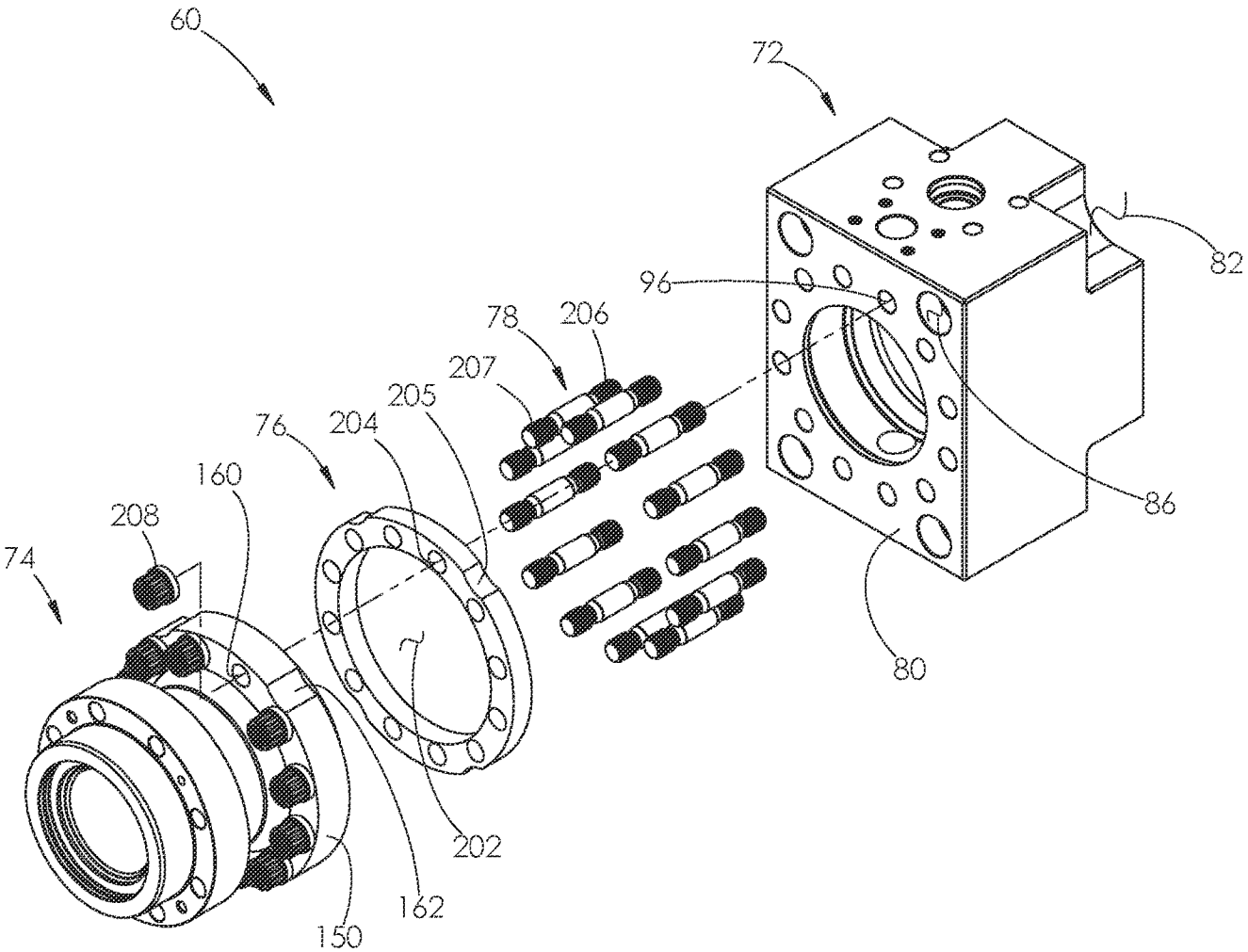
FIG. 29 is a rear perspective and exploded view of the housing shown in FIG. 14.

Following installation of the seal 188 and the insert 184, the housing 60 is assembled by threading a first threaded end 206 of each of the first fasteners 78 into a corresponding one of the threaded openings 96 formed in the first section 72, as shown in FIGS. 12 and 17. Once installed therein, the first fasteners 78 project from the rear surface 80 of the first section 72. The front spacer sleeve 76 is then slid onto the first fasteners 78 using the corresponding passages 204, as shown in FIGS. 28 and 29. The front spacer sleeve 76 is aligned such that the clearance notches 205 correspond with the stay rod passages 86 formed within the first section 72.

After the front spacer sleeve 76 is in place, the second section 74 of the housing 60 is slid onto the first fasteners 78 using the corresponding passages 160 formed in the front mounting flange 150, as shown in FIGS. 28 and 29. At the same time, the front portion 154 of the second section 74 is inserted into the central opening 202 of the front spacer sleeve 76 until the front surface 148 of the second section 74 abuts the rear surface 80 of the first section 72, as shown in FIG. 17.

When the second section 74 is brought together with the first section 72, a second threaded end 207 of each first fastener 78 projects from the front mounting flange 150 and extends over the medial portion 158 of the intermediate surface 68. At the same time, the front spacer sleeve 76 is sandwiched between the rear surface 80 of the first section 72 and the front mounting flange 150 such that the front and rear surfaces 200 and 201 of the front spacer sleeve 76 abut the corresponding surfaces. The second section 74 of the housing 60 is aligned on the first fasteners 78 such that the clearance notches 162 formed in the front mounting flange 150 align with the clearance notches 205 formed in the front spacer sleeve 76, as shown in FIG. 10.

The assembled sections 72 and 74 are secured together by installing a threaded nut 208 onto the second end 207 of each first fastener 78, as shown in FIGS. 14 and 15. The nut 208 shown in the figures is a flanged nut having a 12-point drive section. The nut 208 is turned on the second end 207 of the fastener 78 to the desired specification or until it tightly engages the front mounting flange 150. When installed thereon, each nut 208 overlaps the medial portion 158 and is positioned intermediate the front and rear mounting flanges 150 and 152 of the second section 74 of the housing 60.

Twelve first fasteners 78 and corresponding threaded openings 96, passages 160 and 204, and nuts 208 are shown in the figures. In alternative embodiments, more or less than twelve first fasteners 78 and corresponding openings 96, passages 160 and 204, and nuts 208 may be used to assemble the housing 60. When the housing 60 is assembled, the first fasteners 78 are each positioned along an axis that is parallel to the longitudinal axis 62 of the housing 60, as shown in FIG. 17.

The first fastener 78 shown in the figures is a threaded stud. In alternative embodiments, other types of fasteners known in the art may be used instead of a threaded stud. For example, screws or bolts may be used to secure the sections together. In further alternative embodiments, the nut 208 may comprise the three-piece nut 90, shown in FIG. 20, or other types of threaded nuts known in the art.

To remove a section 72 or 74 or remove the front spacer sleeve 76, the nut 208 is unthreaded from the second end 207 of each first fastener 78. The sections 72 and 74 and the rear spacer sleeve 76 may then be pulled apart, as needed. If the first section 72 is being replaced, the first fasteners 78 are also unthreaded from the threaded openings 96. The components installed within the housing 60 may also be removed, as needed, prior to disassembling the housing 60.

Components Attached to Rear Surface of Housing

Turning back to FIGS. 9-13, in addition to the housing 60, the fluid end section 56 comprises a plurality of components attached to the rear surface 66 of the housing 60. Such components are configured to receive the plunger 240. The various components include the stuffing box 167 and the rear spacer sleeve 168, previously mentioned. The components further comprise a rear retainer 209, plunger packing 210, and a packing nut 211.

Rear Spacer Sleeve

Figure 30:
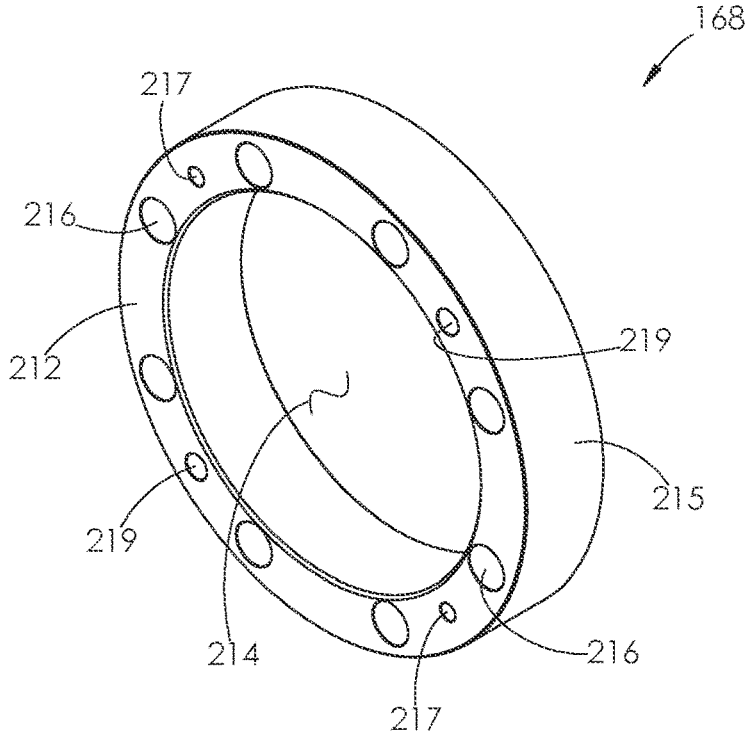
FIG. 30 is a front perspective view of the rear spacer sleeve used with the fluid end section shown in FIG. 9.
Figure 31:
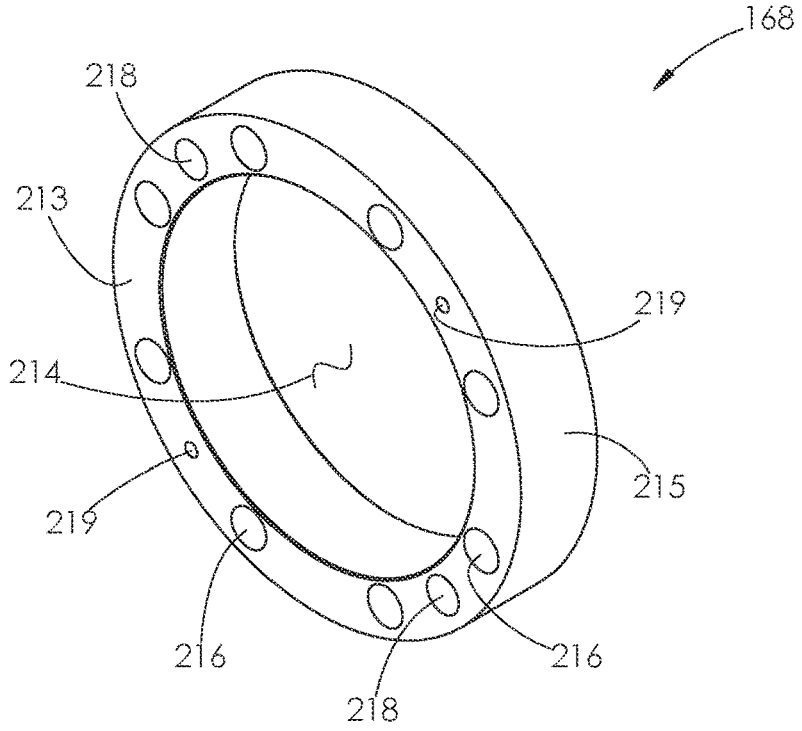
FIG. 31 is a rear perspective view of the rear spacer sleeve shown in FIG. 30.

With reference to FIGS. 30 and 31, the rear spacer sleeve 168 comprises opposed front and rear surfaces 212 and 213 joined by a central opening 214 and an outer intermediate surface 215. A plurality of first passages 216 are formed in the rear spacer sleeve 168 surrounding the central opening 214. The plurality of first passages 216 are each sized to receive one of the second fasteners 166, as shown in FIG. 13. A plurality of counterbored passages 217 are also formed within the rear spacer sleeve 168, as shown in FIG. 12. The counterbored passages 217 are positioned to align with the threaded openings 174 formed in the rear mounting flange 152 and are configured to receive a corresponding third fastener 176. A counterbore 218 of each counterbored passage 217 opens on the rear surface 213 of the rear spacer sleeve 168. Finally, a plurality of dowel passages 219 are formed within the rear spacer sleeve 168. Each dowel passage 219 is positioned to align with a corresponding dowel opening 170 formed in the rear mounting flange 152, as shown in FIG. 17.

The central opening 214 of the rear spacer sleeve 168 is sized to receive the rear portion 156 of the second section 74 of the housing 60 such that the rear spacer sleeve 168 surrounds the rear portion 156 of the second section 74, as shown in FIG. 17. When the rear portion 156 is installed within the central opening 214, an outer diameter of the rear spacer sleeve 168 is equal to or substantially equal to and aligned with an outer diameter of the rear mounting flange 152.

Like the front spacer sleeve 76, the central opening 214 of the rear spacer sleeve 168 is sized so that it never applies any meaningful compressive force to the rear portion 156 of the second section 74 of the housing 60. Specifically, the rear spacer sleeve 168 does not constrain the expansion of the rear portion 156 of the second section 74 when the wear ring 192 is pressed into the second counterbore 189. This results in more uniform deflection of the wear ring 192 during installation. The stress resulting from such deflection is therefore also more uniform. As a result, stress concentration areas within the wear ring 192 are eliminated or significantly reduced, thereby increasing the life of the wear ring 192 and extending the time between maintenance intervals for the fluid end section 56.

Like the front spacer sleeve 76, the rear spacer sleeve 168 is also sized so that the rear surface 213 of the spacer sleeve 168 shares the compressive load with the rear surface 66 of the housing 60. Sharing of the compressive load between the two components reduces the stress on the rear surface 66 of the housing 60. The front surface 212 of the rear spacer sleeve 168 provides a reactionary surface for the rear surface of the rear mounting flange 152. Providing such surface reduces the bending deflection of the rear mounting flange 152 and consequently the bending stress on the rear mounting flange 152. The benefits provided by the rear spacer sleeve 168 increase of the life of the corresponding components, thereby extending the time between maintenance intervals for the fluid end section 56.

Stuffing Box

Figure 32:
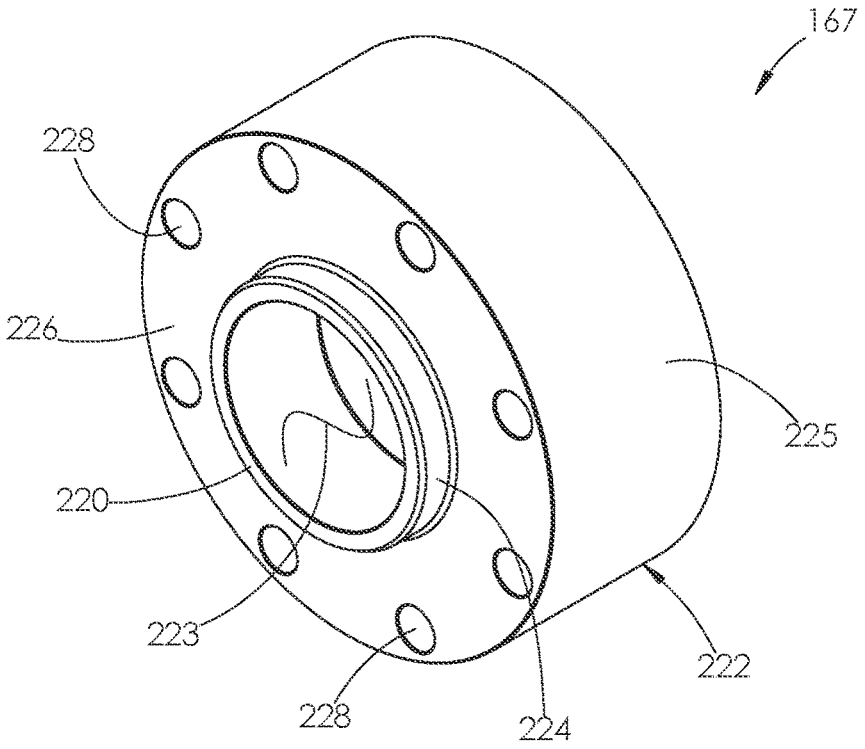
FIG. 32 is a front perspective view of the stuffing box used with the fluid end section shown in FIG. 9.
Figure 33:
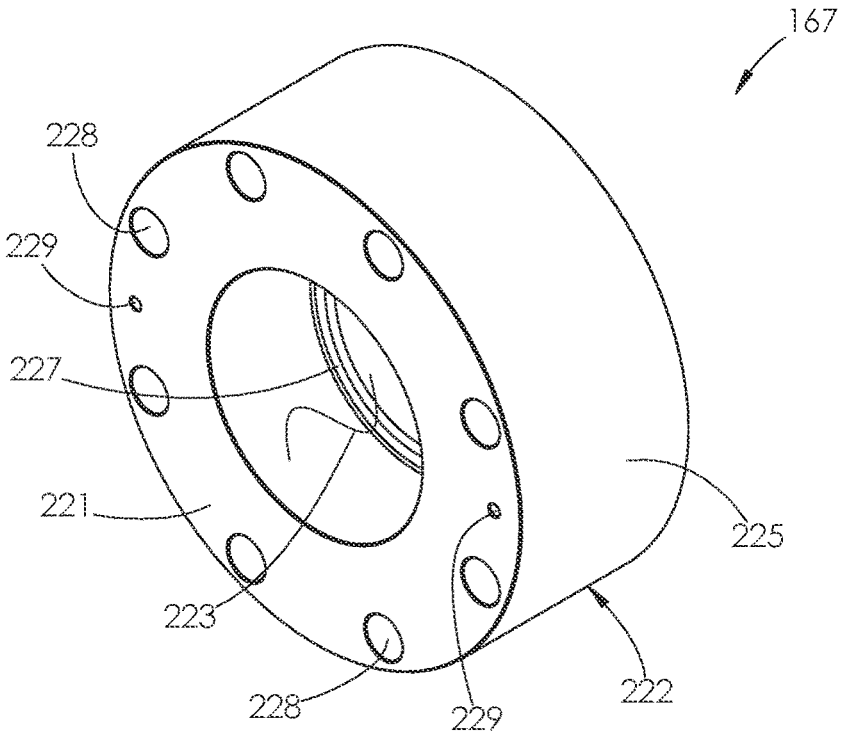
FIG. 33 is a rear perspective view of the stuffing box shown in FIG. 32.

Turning to FIGS. 32 and 33, the stuffing box 167 is configured to house the plunger packing 210 described below. The stuffing box 167 comprises opposed front and rear surfaces 220 and 221 joined by an outer intermediate surface 222 and a central passage 223 formed therein. The stuffing box 167 further comprises a front portion 224 joined to a rear portion 225. The front portion 224 has a smaller outer diameter than the rear portion 225 such that a medial surface 226 is formed between the front and rear surfaces 220 and 221. The front portion 224 further has a smaller length than that of the rear portion 225 and may be characterized as a front projecting portion 224.

The front portion 224 includes the front surface 220 of stuffing box 167, and the rear portion 225 includes the rear surface 221 of the stuffing box 167. An internal shoulder 227 is formed in the wall of the central passage 223 within the rear portion 225. The plunger packing 210 abuts the internal shoulder 227 when installed within the stuffing box 167, as shown in FIGS. 11-13.

Figure 84:
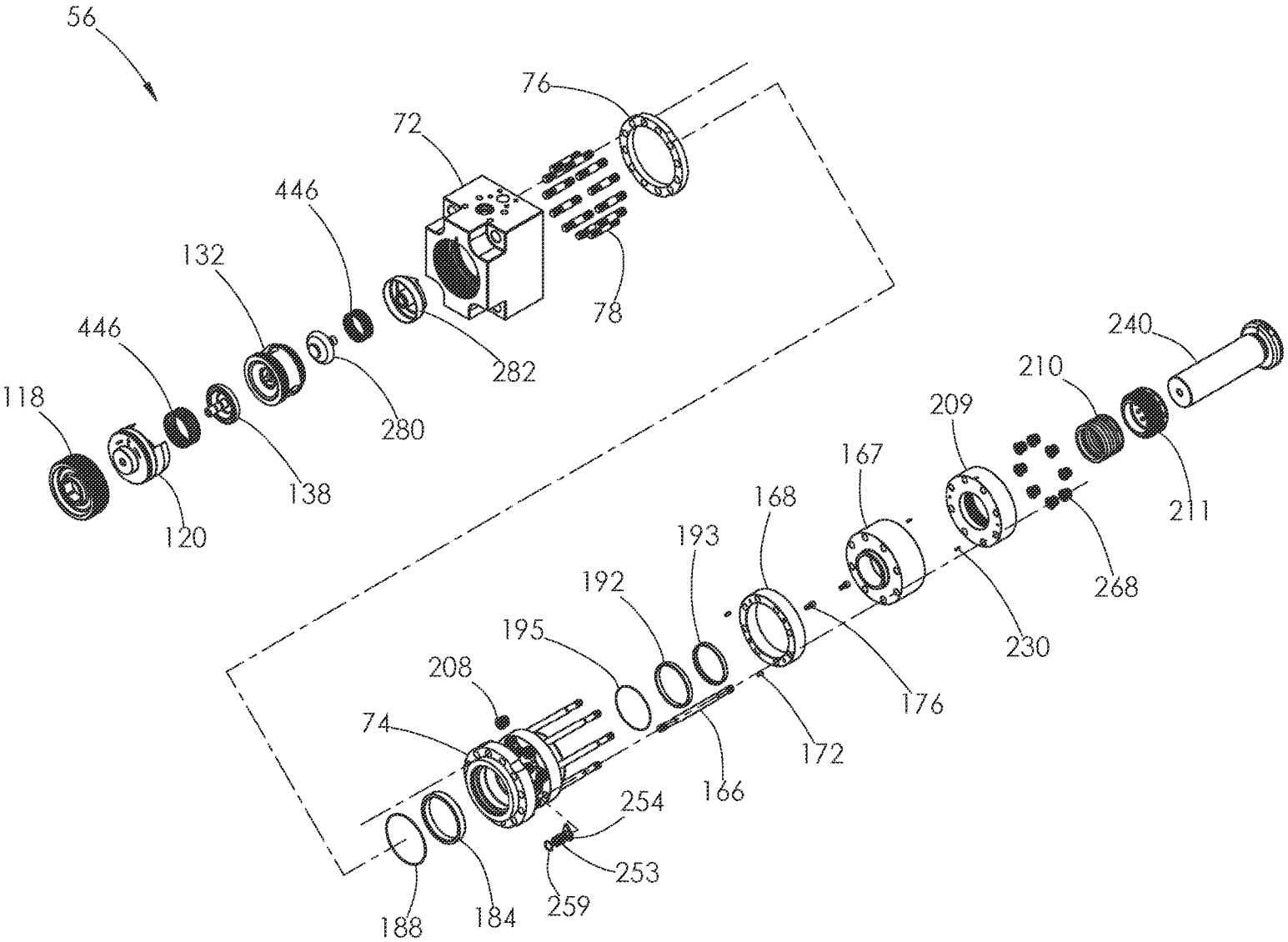
FIG. 84 is a front perspective and exploded view of the fluid end section shown in FIG. 9.

A plurality of passages 228 are formed within the rear portion 225 of the stuffing box 167 and interconnect the medial surface 226 and the rear surface 221. The passages 228 are configured to align with the plurality of first passages 216 formed in the rear spacer sleeve 168 and are configured to receive one of the plurality of second fasteners 166, as shown in FIG. 13. A plurality of dowel openings 229 are formed in the rear surface 221 of the stuffing box 167 for receiving second alignment dowels 230, as shown in FIGS. 84 and 85. The second alignment dowels 230 assist in properly aligning the rear retainer 209 on the stuffing box 167 during assembly.

Turning back to FIGS. 11-13, the stuffing box 167 is installed within the second section 74 of the housing 60 such that the front portion 224 is disposed within the stuffing box counterbore 196 and a portion of the medial surface 226 abuts the rear surface 66 of the housing 60. When installed therein, a space exists between the rear mounting flange 152 and the medial surface 226 of the stuffing box 167. As described below, such space is filled by the rear spacer sleeve 168. When the front portion 224 of the stuffing box 167 is installed within the second section 74 of the housing 60, the outer intermediate surface 222 of the front portion 224 engages the seal 193. The seal 193 prevents fluid from leaking between the housing 60 and the stuffing box 167. The seal 193 shown in the figures is a high pressure seal and is significantly larger than the seal 195 engaging the opposite side of the wear ring 192.

During operation, the seal 193 wears against the outer intermediate surface 222 of the front portion 224. Should the front portion 224 begin to erode, the stuffing box 167 may be removed and replaced with a new stuffing box 167. Likewise, the seal 193 wears against the wear ring 192 during operation. The wear ring 192 is preferably made of a harder and more wear resistant material than the housing 60, such as tungsten carbide. Should the wear ring 192 begin to erode, the wear ring 192 can be removed and replaced with a new wear ring 192. Likewise, the seal 193 can also be removed and replaced with a new seal 193, if needed. Locating the seal 193 between replaceable parts protects the housing 60 over time. Fluid is prevented from leaking around the wear ring 192 by the seal 195 installed within the second seal groove 194.

Rear Retainer

Figure 34:
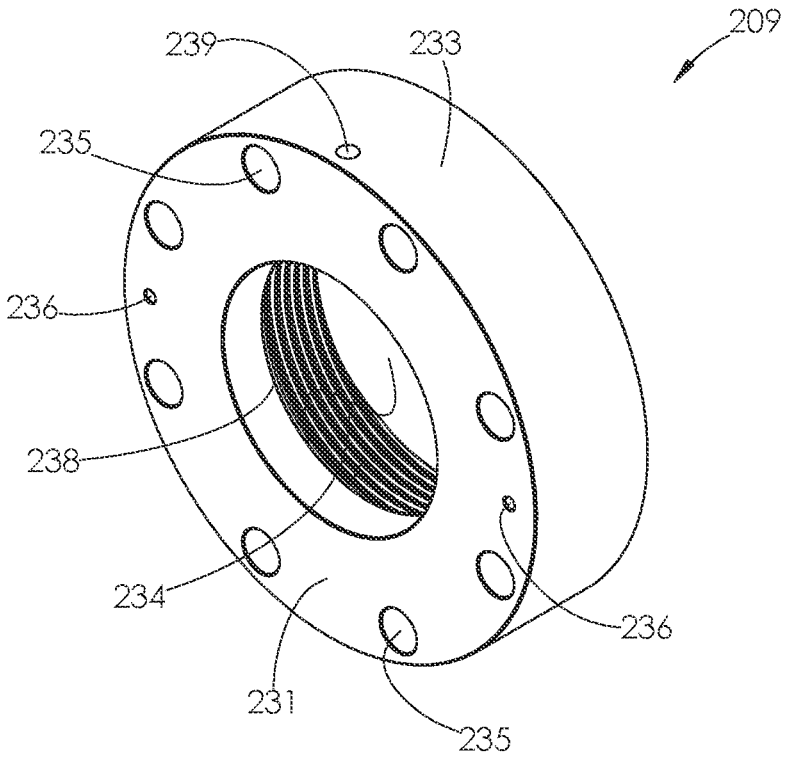
FIG. 34 is a front perspective view of the rear retainer used with the fluid end section shown in FIG. 9.
Figure 35:
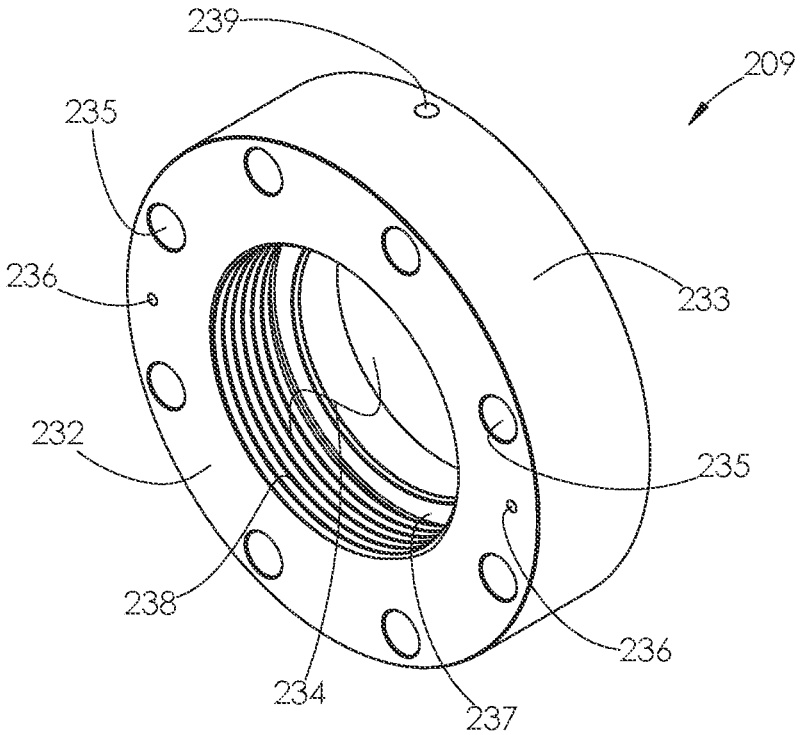
FIG. 35 is a rear perspective view of the rear retainer shown in FIG. 34.

Turning to FIGS. 34 and 35, the rear retainer 209 comprises opposed front and rear surfaces 231 and 232 joined by an outer intermediate surface 233 and a central passage 234 formed therein. A plurality of passages 235 are formed in the rear retainer 209 and surround the central passage 234. The passages 235 interconnect the front and rear surfaces 231 and 232 of the rear retainer 209 and are configured to align with the passages 228 formed in the rear portion 225 of the stuffing box 167, as shown in FIG. 13. A plurality of dowel openings 236 are formed in the front surface 231 of the rear retainer 209 for receiving a portion of the second alignment dowels 230, as shown in FIGS. 84 and 85.

An internal shoulder 237 is formed in the wall of the central passage 234 of the rear retainer 209. Internal threads 238 are formed in the wall of the central passage 234 and are positioned between the internal shoulder 237 and the rear surface 232. The internal threads 238 are configured to receive the packing nut 211, as shown in FIGS. 11-13. Between the internal shoulder 237 and the front surface 231, the wall of the central passage 234 is smooth and includes one or more lubrication ports 239. The lubrication port 239 interconnects the central passage 234 and the outer intermediate surface 233 of the rear retainer 209, as shown in FIG. 11. During operation, lubricant is supplied to the fluid end section 56 through the lubrication port 239.

Plunger Packing and Packing Nut

Continuing with FIGS. 11-13, fluid is prevented from leaking around the plunger 240 during operation by a plunger packing 210. The plunger packing 210 is installed within the stuffing box 167 and comprises a plurality of packing seals 241 sandwiched between first and second metal rings 242 and 243. The first metal ring 242 abuts the internal shoulder 227 formed within the stuffing box 167 and the second metal ring 243 extends into the central passage 223 formed in the rear retainer 209. The second metal ring 243 is known in the art as a "lantern ring". One or more passages 244 may be formed in the second metal ring 243 and fluidly connect with the one or more lubrication ports 239 formed in the rear retainer 209, as shown in FIG. 11. During operation, oil used to lubricate the plunger 240 and plunger packing 210 is supplied through the lubrication port 239 and second metal ring 243.

Figure 36:
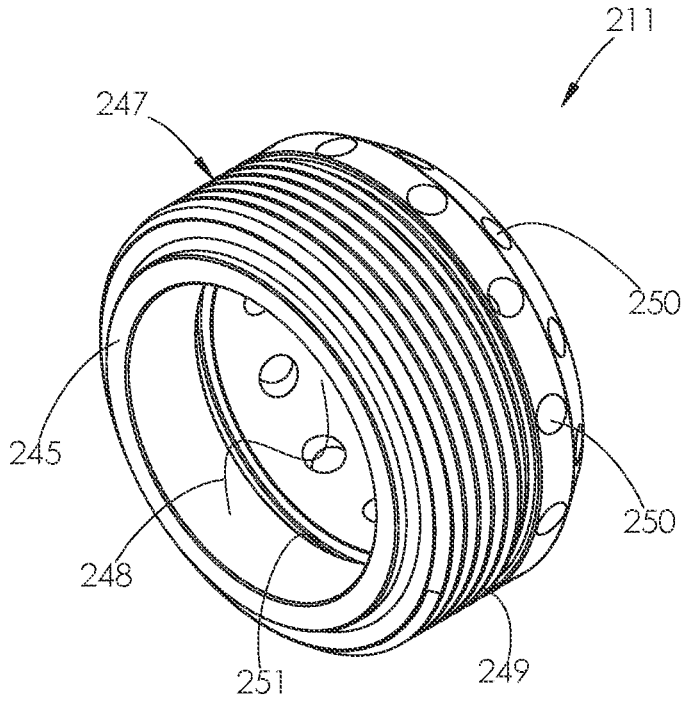
FIG. 36 is a front perspective view of the packing nut used with the fluid end section shown in FIG. 9.
Figure 37:
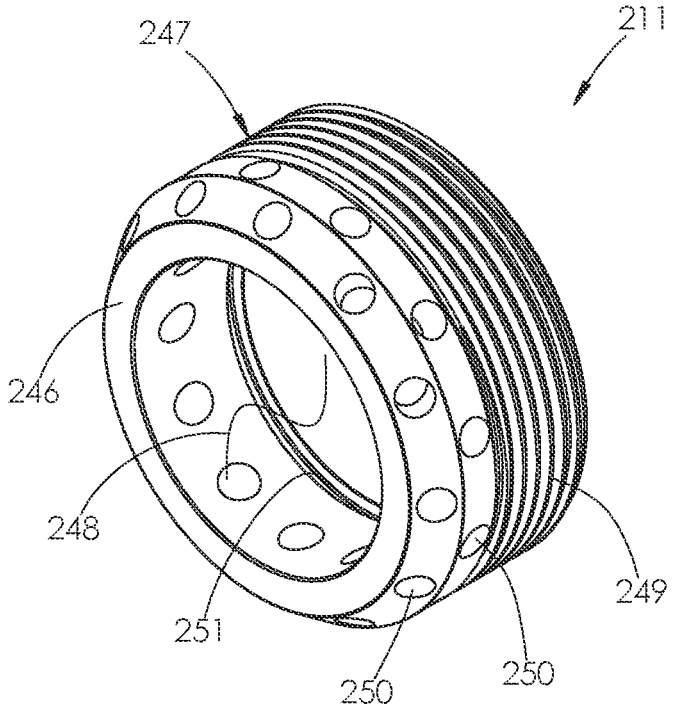
FIG. 37 is a rear perspective view of the packing nut shown in FIG. 36.
Figure 38:
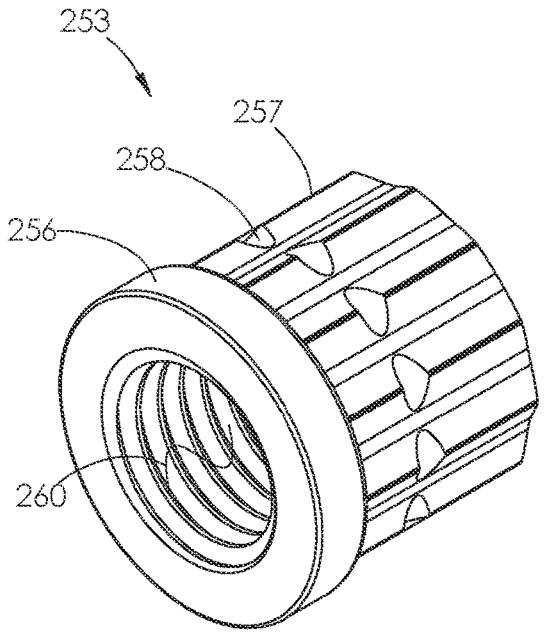
FIG. 38 is a front perspective view of a blind nut used with the fluid end section shown in FIG. 9.
Figure 39:
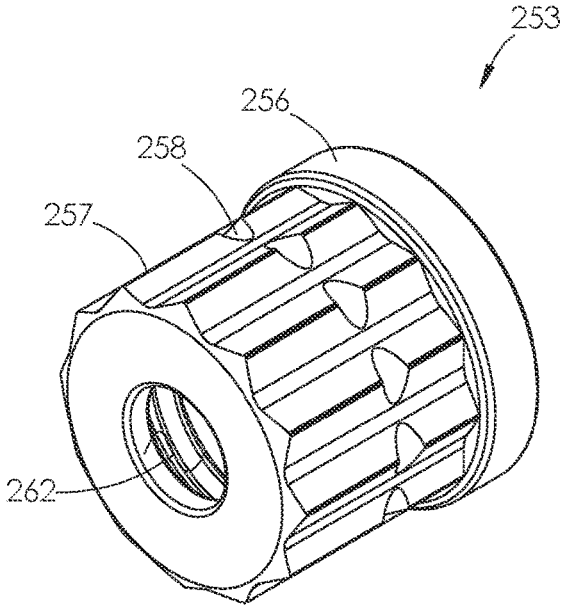
FIG. 39 is a rear perspective view of the blind nut shown in FIG. 38.
Figure 40:
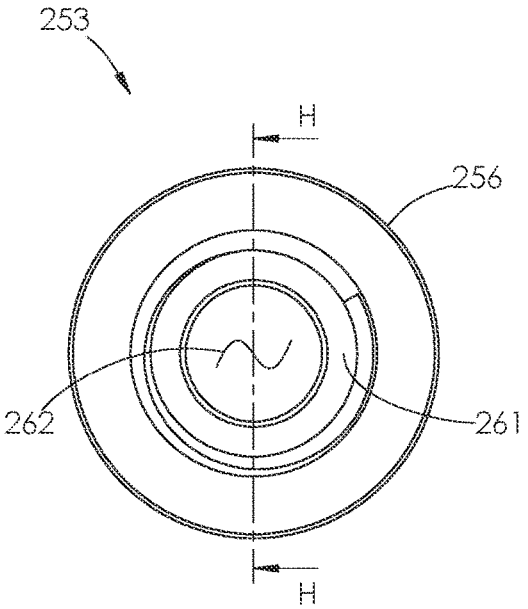
FIG. 40 is a rear elevational view of the blind nut shown in FIG. 38.
Figure 41:
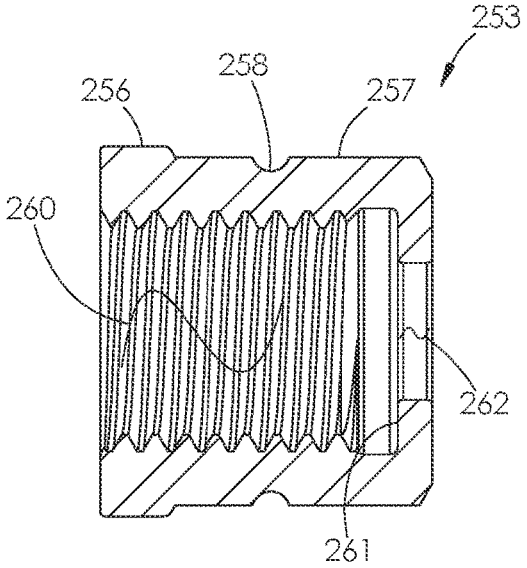
FIG. 41 is a cross-sectional view of the blind nut shown in FIG. 40, taken along line H-H.

With reference to FIGS. 36 and 37, the plunger packing 210 is retained within the stuffing box 167 and the rear retainer 209 using the packing nut 211. The packing nut 211 comprises opposed front and rear surfaces 245 and 246 joined by an outer intermediate surface 247 and a central passage 248 formed therein. External threads 249 are formed in a portion of the outer intermediate surface 247 for engaging the internal threads 238 formed in the rear retainer 209, as shown in FIGS. 11-13. When the packing nut 211 is installed within the rear retainer 209, the front surface 245 of the packing nut 211 engages the lantern ring 243 and compresses the plunger packing 210, as shown in FIGS. 11-13. When compressed, the packing seals 241 of the plunger packing 210 tightly seal against an outer surface of the plunger 240.

During operation, the packing nut 211 may be tightened, as needed, to ensure adequate compression of the packing seals 241 against the plunger 240. At least a portion of the packing nut 211 projects from the rear surface 232 of the rear retainer 209 to provide clearance to turn the packing nut 211, as needed. One or more mounting holes 250 formed in the packing nut 211 adjacent its rear surface 246 are configured to engage tools used to turn the packing nut 211. The central passage 248 formed in the packing nut 211 is sized to closely receive the plunger 240. A groove 251 may be formed in the wall of the central passage 248 for receiving a seal 252, as shown in FIGS. 11-13. The seal 252 shown in FIGS. 11-13 is an O-ring. The seal 252 prevents fluid from leaking around the plunger 240 during operation.

Blind Nut and Reaction Washers

Figure 45:
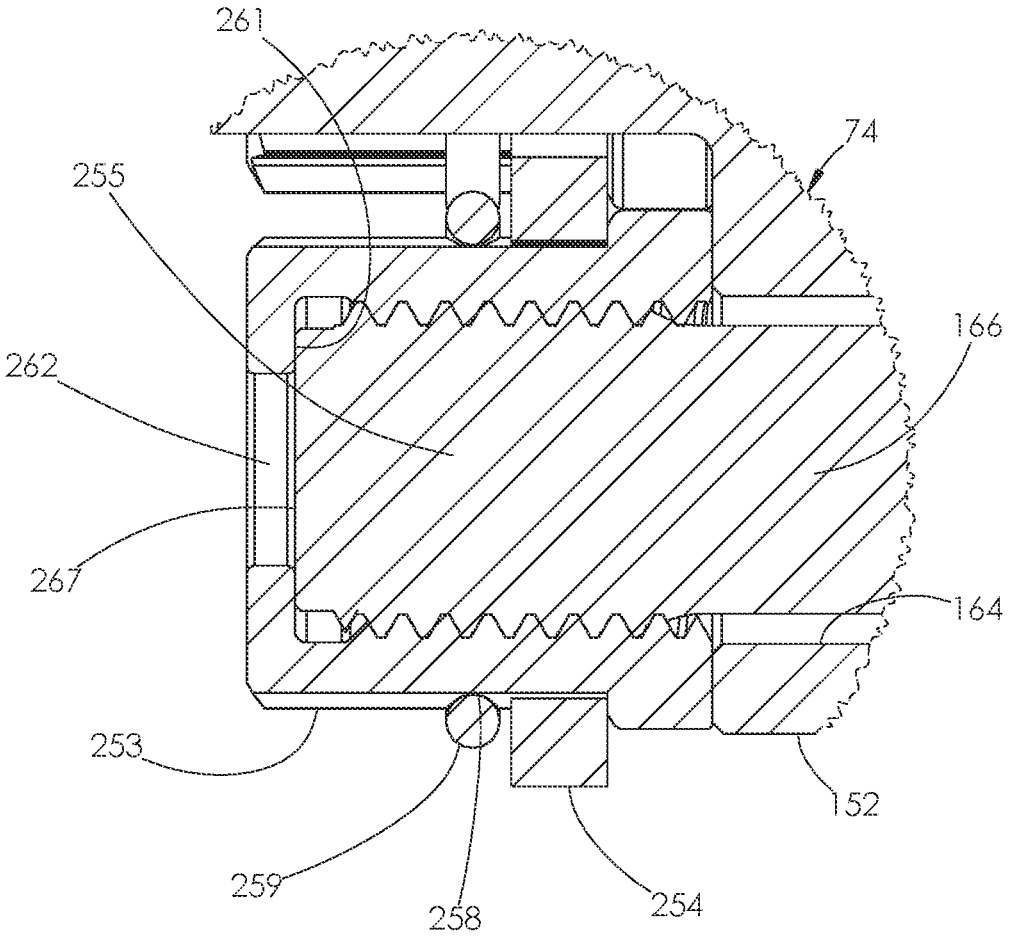
FIG. 45 is an enlarged view of area J, shown in FIG. 13.

Turning to FIGS. 38-43, a blind nut 253 and a reaction washer 254 are installed in a first threaded end 255 of each second fastener 166. The blind nut 253 is a flanged nut and comprises a flanged section 256 joined to a drive section 257, as shown in FIGS. 38-41. The flanged section 256 functions as a washer. The drive section 257 comprises a standard 12-point drive, sometimes called a double hex drive. A series of grooves 258 are formed in the outer surface of the drive section 257 and extend radially around the periphery of the outer surface of the drive section 257. The grooves 258 are configured to receive a seal 259, such as an O-ring seal. The seal 259 is configured to hold the reaction washer 254 on the blind nut 253, as shown in FIG. 45. The blind nut 253 further comprises a threaded blind bore 260 having a base 261. An opening 262 may be formed in the base 261 for viewing the interior of the blind bore 260.

Figure 42:
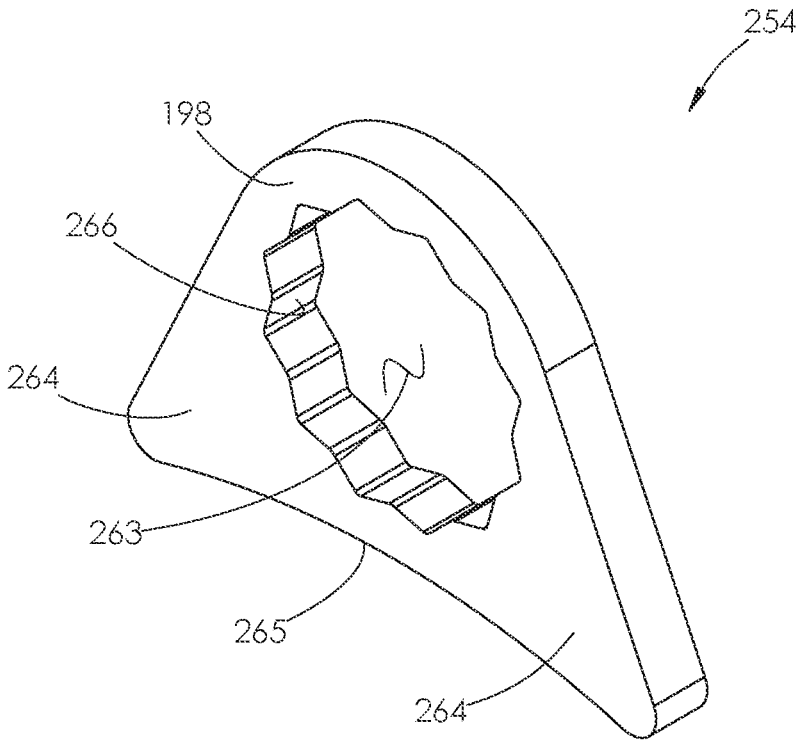
FIG. 42 is a front perspective view of a reaction washer used with the fluid end section shown in FIG. 9.
Figure 43:
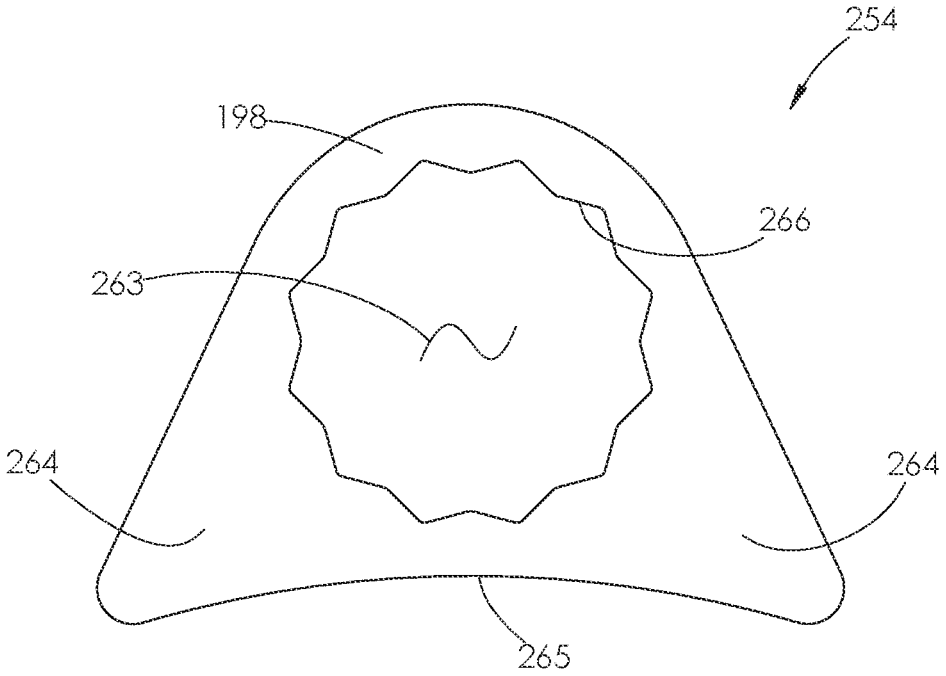
FIG. 43 is a front elevational view of the reaction washer shown in FIG. 42.

With reference to FIGS. 42 and 43, the reaction washer 254 comprises a pair of torque reaction arms 264 positioned on opposite sides of a central opening 263. The reaction arms 264 are joined by a concave surface 265 sized to conform to the outer cylindrical surface of the medial portion 158 of the second section 74 of the housing 60. The central opening 263 comprises a 12-point wall 266 that is congruent to the 12-point drive section 257 of the blind nut 253.

Figure 44:
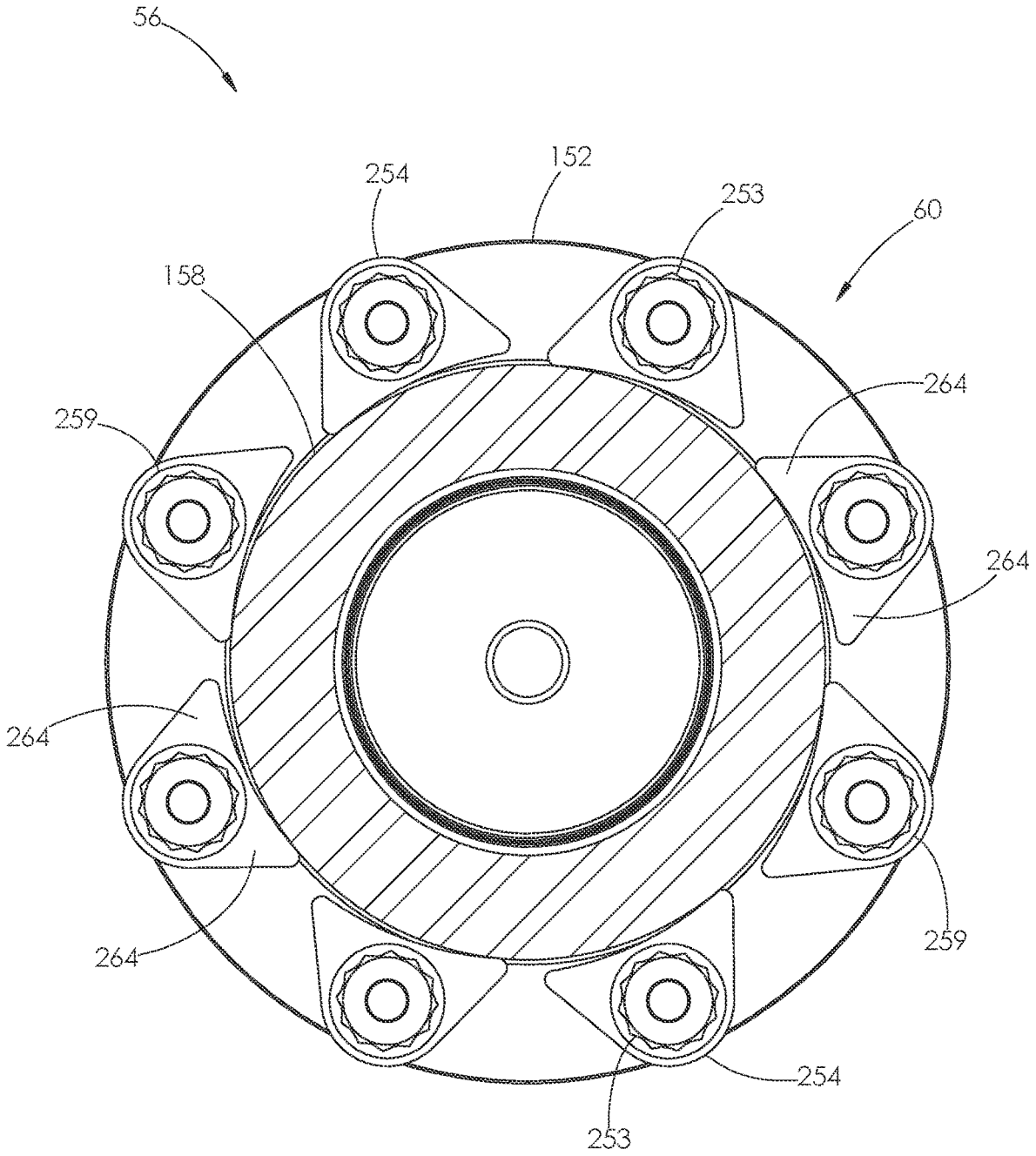
FIG. 44 is a cross-sectional view of the fluid end section shown in FIG. 10, taken along line I-I.

The reaction washer 254 is shaped to slide over the drive section 257 of the blind nut 253 and is held on the drive section 257 by the seal 259, as shown in FIGS. 44 and 45. When installed thereon, at least one of the reaction arms 264 of the reaction washer 254 engages the medial portion 158 of the second section 74. As will be described herein, during assembly of the fluid end section 56, the reaction washers 254 provide a mechanism for resisting torque applied to the blind nuts 253 when other parts of the fluid end section 56 are assembled.

Assembly of Components on Rear Surface of Housing

Turning back to FIGS. 11-13, the components at the rear surface 66 of the housing 60 are assembled by first inserting each of the second fasteners 166 through a corresponding one of the second passages 164 formed in the rear mounting flange 152. The second fasteners 166 are pushed through the second passages 164 until a first threaded end 255 of each fastener 166 projects from the rear mounting flange 152 and is positioned over the medial portion 158 of the second section 74 of the housing 60, as shown in FIGS. 9 and 10. A blind nut 253 is then torqued onto each first threaded end 255. The blind nut 253 is torqued until an end surface 267 of each first threaded end 255 abuts the base 261 of the threaded blind bore 260, as shown in FIG. 45.

After the blind nuts 253 are attached to the second fasteners 166, a reaction washer 254 is installed around the drive section 257 of each blind nut 253. Each reaction washer 254 is held on the blind nut 253 by sliding a seal 259 around each drive section 257 until it is positioned within the grooves 258, as shown in FIGS. 9, 44, and 45. The reaction washers 254 may be positioned on the blind nuts 253 immediately after attaching the blind nuts 253 to the second fasteners 166 or anytime prior to torquing a plurality of nuts 268 on the opposite second end 269 of each second fastener 166.

Following the assembly of the second fasteners 166 and blind nuts 253, a first dowel pin 172 is inserted into a corresponding one of the dowel openings 170 formed on the rear surface 66 of the second section 74, as shown in FIG. 17. The rear spacer sleeve 168 is then brought together with the second section 74 of the housing 60 such that the first dowel pins 172 are inserted into the dowel pin passages 219, the second fasteners 166 are disposed within the passages 216, and the threaded openings 174 are aligned with the counterbored passages 217, as shown in FIGS. 12 and 13. When in such position, the front surface 212 of the rear spacer sleeve 168 abuts the rear surface 66 of the housing 60 and the rear portion 156 of the second section 74 is installed within the central opening 214 of the rear spacer sleeve 168.

The rear spacer sleeve 168 is secured to the rear surface 66 of the housing 60 by installing a third fastener 176 within a corresponding one of the aligned threaded openings 174 and counterbored passages 217, as shown in FIG. 12. The third fasteners 176 shown in the figures are screws. The third fasteners 176 are torqued within the threaded openings 174 until a head 270 of each fastener 176 abuts a base 271 of each counterbored passage 217, thereby rigidly securing the rear spacer sleeve 168 to the housing 60. When the rear spacer sleeve 168 is attached to the housing 60, the rear surface 213 of the rear spacer sleeve 168 is positioned flush with the rear surface 66 of the housing 60.

Continuing with FIGS. 11-13, prior to attaching the stuffing box 167 to the housing 60, the seal 195 is installed within the second seal groove 194, and the wear ring 192 is press-fit or interference fit into the second counterbore 189. The seal 193 is then installed within the wear ring 192 and the second counterbore 189. The wear ring 192 is positioned intermediate the seals 195 and 193 such that the wear ring 192 surrounds the seal 193. When the components are installed within the second counterbore 189, a side surface of both the wear ring 192 and the annular seal 193 abut the base 191 of the second counterbore 189. The opposite side surface of the wear ring 192 is flush with the rear surface 66 of the housing 60.

To attach the stuffing box 167 to the housing 60, the stuffing box 167 is brought together with the second section 74 by inserting the second fasteners 166 into a corresponding one of the passages 228 formed in the rear portion 225 of the stuffing box 167. At the same time, the front portion 224 of the stuffing box 167 is installed within the stuffing box counterbore 196 such that the seal 193 surrounds and engages an outer surface of the front portion 224. The stuffing box 167 is brought together with the housing 60 such that the rear surface 66 of the housing 60 and the rear surface 213 of the rear spacer sleeve 168 abut the medial surface 226 of the stuffing box 167.

Once the stuffing box 167 is in place, the rear retainer 209 is attached to the stuffing box 167. The rear retainer 209 is brought together with the stuffing box 167 by inserting the second fasteners 166 into the corresponding passages 235 formed in the rear retainer 209. At the same time, the second dowel pins 230 are installed within the aligned dowel openings 229 formed in the rear surface 221 of the stuffing box 167 and the front surface 231 of the rear retainer 209, as shown in FIGS. 84 and 85. The rear retainer 209 is brought together with the stuffing box 167 until the front surface 231 of the rear retainer 209 abuts the rear surface 221 of the stuffing box 167 and a second threaded end 269 of each second fastener 166 projects from the rear surface 231 of the rear retainer 209, as shown in FIGS. 11-13.

Once the rear retainer 209 is in place, a reaction washer 254 and seal 259 are installed on each blind nut 253 and a washer 272 and threaded nut 268 are installed on the second threaded end 269 of each of the second fasteners 166, as shown in FIGS. 9 and 10. The threaded nut 268 may comprise a threaded through-bore and a 12-point outer drive section. The threaded nuts 268 are torqued to a desired specification or until the stuffing box 167 and the rear retainer 209 are rigidly secured to the housing 60 and the rear spacer sleeve 168.

When turning the nuts 268 on the second end 269 of each second fastener 166, the reaction washers 254 provide a mechanism for resisting the torque applied to the blind nuts 253, allowing the nuts 268 to be tightened or loosened without the blind nuts 253 spinning freely. Specifically, rotation of the blind nut 253 is prevented by the engagement of one of the reaction arms 264 with the medial portion 158 of the housing 60, as shown in FIG. 44. After assembly, the reaction washers 254 may be removed from the blind nuts 253. Alternatively, the reaction washers 254 may be left in place so as to prevent 2*s* rotation of the blind nuts 253 during operation, thereby reducing the likelihood of the second fasteners 166 from coming loose.

After the rear spacer sleeve 168, stuffing box 167, and rear retainer 209 are attached to the housing 60, the plunger packing 210 may be installed within the stuffing box 167 and the packing nut 211 may be installed within the rear retainer 209, as shown in FIGS. 11-13. The packing nut 211 is torqued within the rear retainer 209 as needed to compress the packing seals 210.

Eight second fasteners 166 are shown in the figures. In alternative embodiments, more or less than eight second fasteners 166 may be used. The second fasteners 166 shown in the figures are each a threaded stud. In alternative embodiments, other types of fasteners known in the art may be used instead of a threaded stud. For example, screws or bolts may be used to secure the sections together. In further alternative embodiments, the nut 268 may comprise the three-piece nut 90, shown in FIG. 20, or other types of threaded nuts known in the art.

As shown in FIGS. 9, 10, 12, and 13, when the fluid end section 56 is assembled, the second ends 207 of the first fasteners 78 and the corresponding nuts 208 and the first ends 255 of the second fasteners 166 and the corresponding blind nuts 253 are in a spaced-relationship and face each other. Both ends 207 and 255 and corresponding nuts 208 and 253 are positioned between the front and rear mounting flanges 150 and 152 and both ends overlap the medial portion 158 of the second section 74. When assembled, the second fasteners 166 extend along an axis that is parallel to the longitudinal axis 62 of the housing 60, as shown in FIG. 13.

Components Installed within the Housing

Turning to FIGS. 46-85, the various internal components of the housing 60 will now be described in more detail. Fluid is routed throughout the housing 60 by the fluid routing plug 132. The timing of movement throughout the fluid routing plug 132 is controlled by the suction valve 280 and the discharge valve 138. Movement of the valves 280 and 138 is guided by the suction valve guide 282 and the discharge plug 120.

Fluid Routing Plug

Turning to FIGS. 46-59, the fluid routing plug 132 comprises a body 330 having a suction surface 332 and an opposed discharge surface 334 joined by an outer intermediate surface 336. A central longitudinal axis 338 extends through the body 330 and the suction and discharge surfaces 332 and 334. When the fluid routing plug 132 is installed within the housing 60, the discharge surface 334 is positioned within the first section 72 of the housing 60, and at least a portion of the suction surface 332 is positioned within the second section 74 of the housing 60, as shown in FIGS. 11-13.

Figure 51:
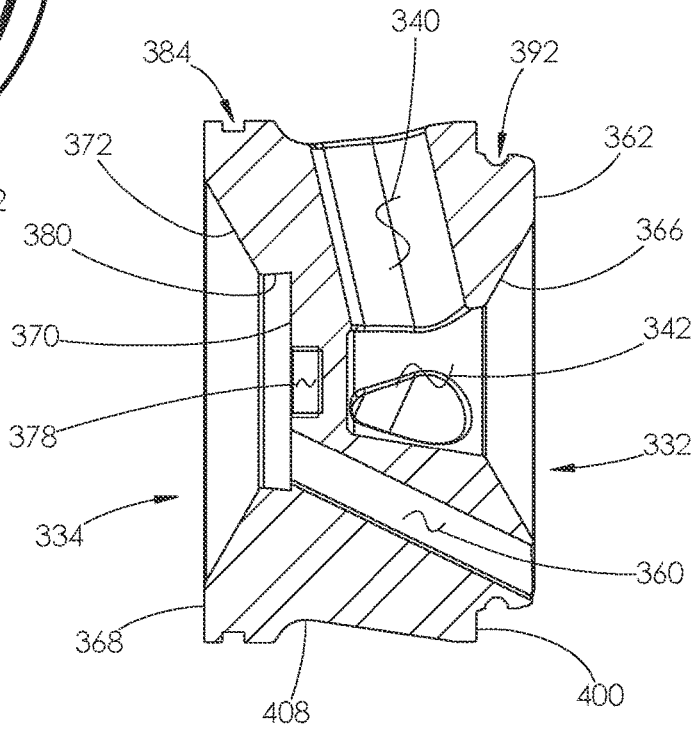
FIG. 51 is a cross-sectional view of the fluid routing plug shown in FIG. 50, taken along line K-K.

The body 330 further comprises a plurality of suction fluid passages 340. The suction passages 340 interconnect the intermediate surface 336 and the suction surface 332 of the body 330, as shown in FIG. 51. The connection is formed within a blind bore 342 formed within the suction surface 332 of the body 330. The blind bore 342 may be referred to as an axially-blind bore 342 because it is blind along the longitudinal axis 338 of the body 330. During operation, fluid entering the housing 60 through the suction bores 133 and 134 flows into the suction passages 340 of the fluid routing plug 132 and into the axially-blind bore 342. From there, fluid flows towards the suction surface 332 of the body 330 and out of the fluid routing plug 132. Three suction fluid passages 340 are shown in the figures. In alternative embodiments, more or less than three suction fluid passages 340 may be formed within the body 330.

Figure 52:
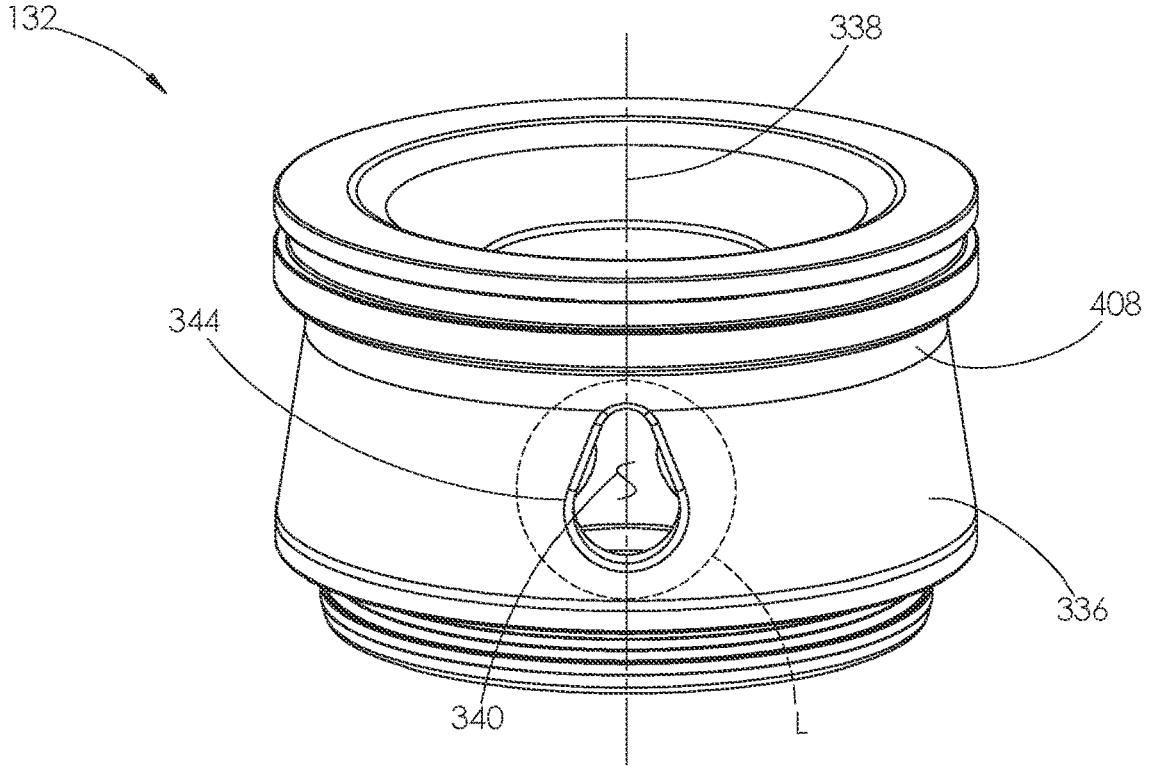
FIG. 52 is a top perspective view of the fluid routing plug shown in FIG. 46.
Figure 53:
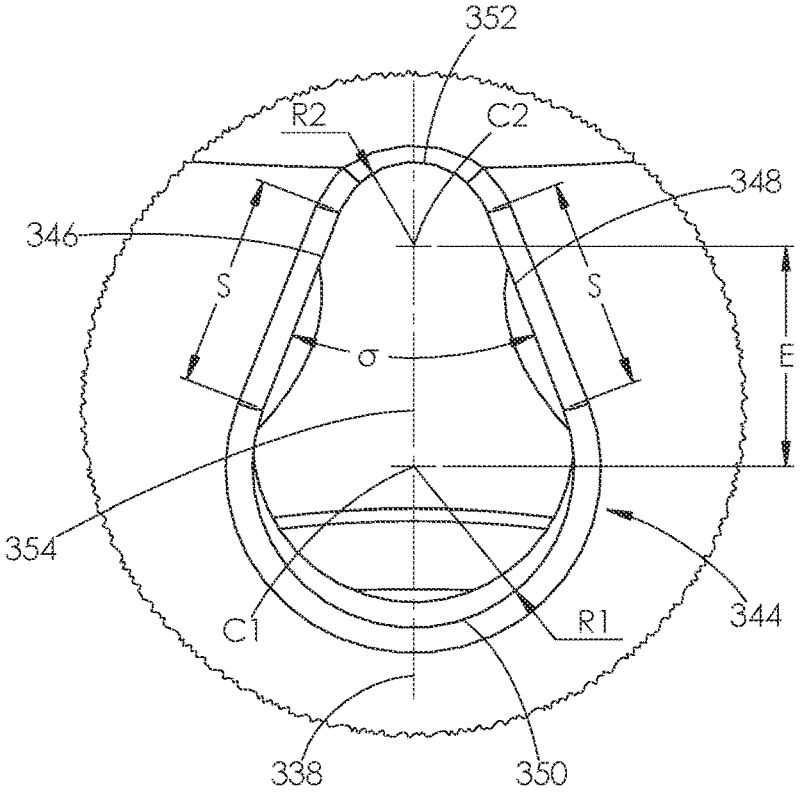
FIG. 53 is an enlarged view of area L shown in FIG. 52.
Figure 54:
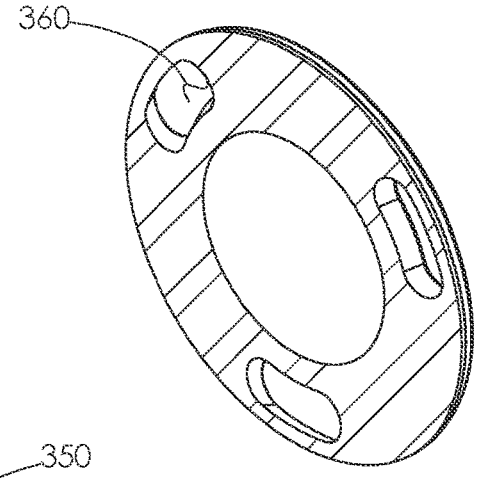
FIG. 54 is a perspective cross-sectional view of the fluid routing plug shown in FIG. 47, taken along line M-M.

Continuing with FIGS. 52 and 53, each suction passage 340 has a generally oval or tear drop cross-sectional shape. An opening 344 of each suction passage 340 on the intermediate surface 336 comprises a first side wall 346 joined to a second side wall 348 by first and second ends 350 and 352. The first and second side walls 346 and 348 are straight lines of equal length S, and the first and second ends 350 and 352 are circular arcs, as shown in FIG. 53.

The first end 350 of the opening 344 has a radius of R1 with a center at C1, and the second end 352 has a radius of R2 with a center at C2. The first end 350 is larger than the second end 352 such that R1>R2. The first and second side walls 346 and 348 are tangent to the first and second ends 350 and 352 and have an included angle, σ.

The opening 344 has a centerline 354 that connects the centers C1 and C2 of the first and second ends 350 and 352. The centerline 354 has a length E and is parallel with the central longitudinal axis 338. A cross-sectional shape of each suction passage 340 throughout the length of the body 330 corresponds with the shape of each opening 344. Each suction passage 340 is sized and shaped to maximize fluid flow through the passage 340 and minimize fluid turbulence and stress to the body 330 of the fluid routing plug 132.

Figure 55:
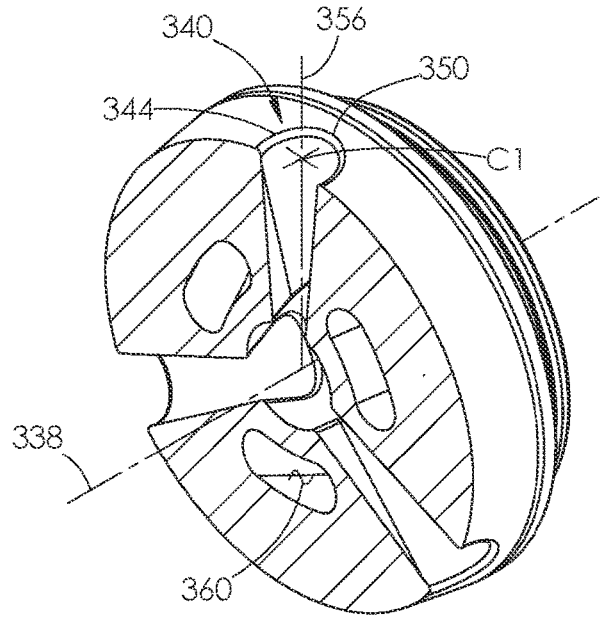
FIG. 55 is a perspective cross-sectional view of the fluid routing plug shown in FIG. 47, taken along line N-N.
Figure 56:
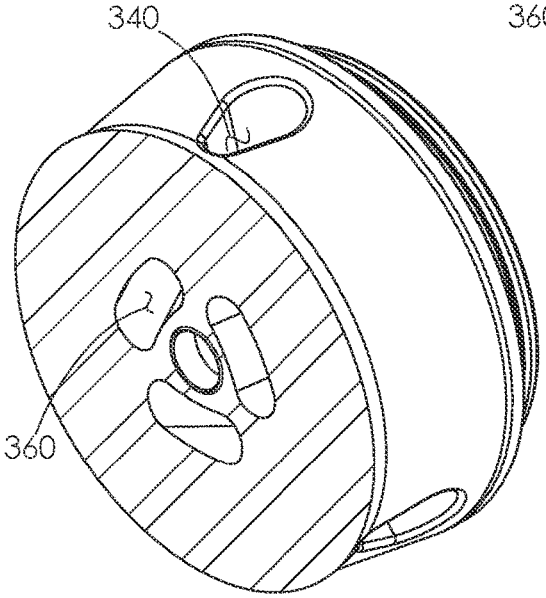
FIG. 56 is a perspective cross-sectional view of the fluid routing plug shown in FIG. 47, taken along line O-O.

With reference to FIGS. 55 and 56, each suction fluid passage 340 extends between the axially-blind bore 342 and the suction surface 332 such that each suction passage 340 comprises a longitudinal axis 356. The longitudinal axis 356 extends through the center C1 of the first end 350 of the opening 344 and intersects the central longitudinal axis 338, as shown in FIG. 55.

Figure 57:
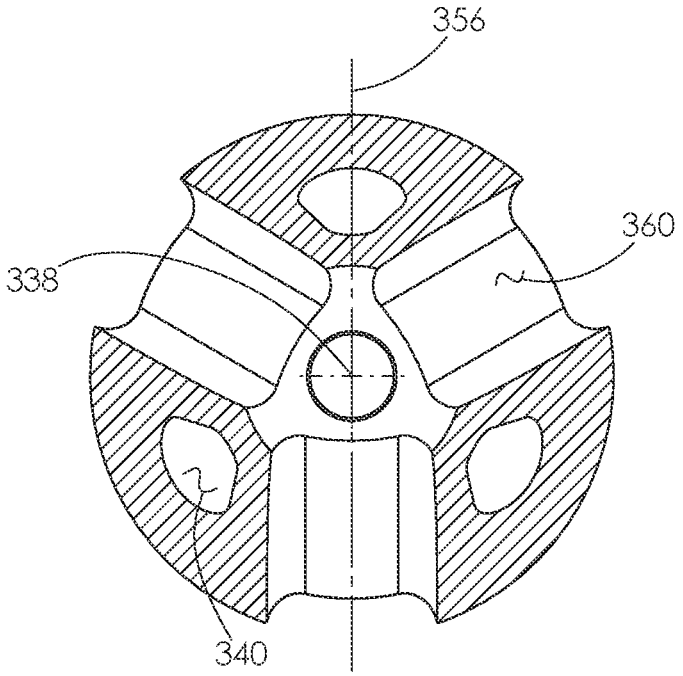
FIG. 57 is a front elevational and conical-sectional view of the fluid routing plug shown in FIG. 46. The conical-section is taken from line P in FIGS. 46 and 48 to line Q in FIGS. 49 and 50.
Figure 58:
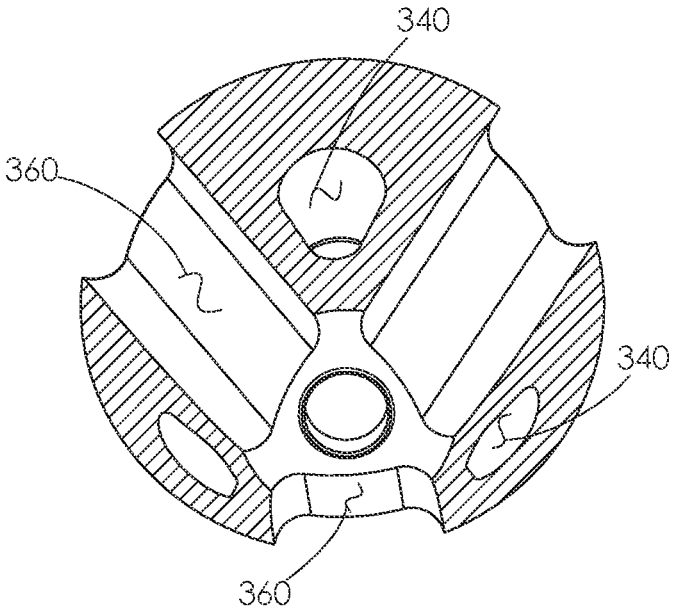
FIG. 58 is a front perspective and conical-sectional view of the fluid routing plug shown in FIG. 57.

The body 330 further comprises a plurality of discharge fluid passages 360. The discharge passages 360 interconnect the suction surface 332 and the discharge surface 334 of the body 330 and do not intersect any of the suction passages 340, as shown in FIGS. 57 and 58. Rather, the discharge and suction passages 360 and 340 are in a spaced-relationship. In operation, fluid exiting the body 330 at the suction surface 332 is subsequently forced into the discharge passages 360, towards the discharge surface 334 of the body 330, and out of the fluid routing plug 132. Three discharge fluid passages 360 are shown in the figures. In alternative embodiments, more or less than three discharge fluid passages 360 may be formed within the body 330.

The suction surface 332 of the body 330 comprises an outer rim 362 joined to the axially-blind bore 342 by a tapered seating surface 366, as shown in FIG. 51. Likewise, the discharge surface 334 comprises an outer rim 368 joined to a central base 370 by a tapered seating surface 372, as shown in FIG. 51.

Figure 46:
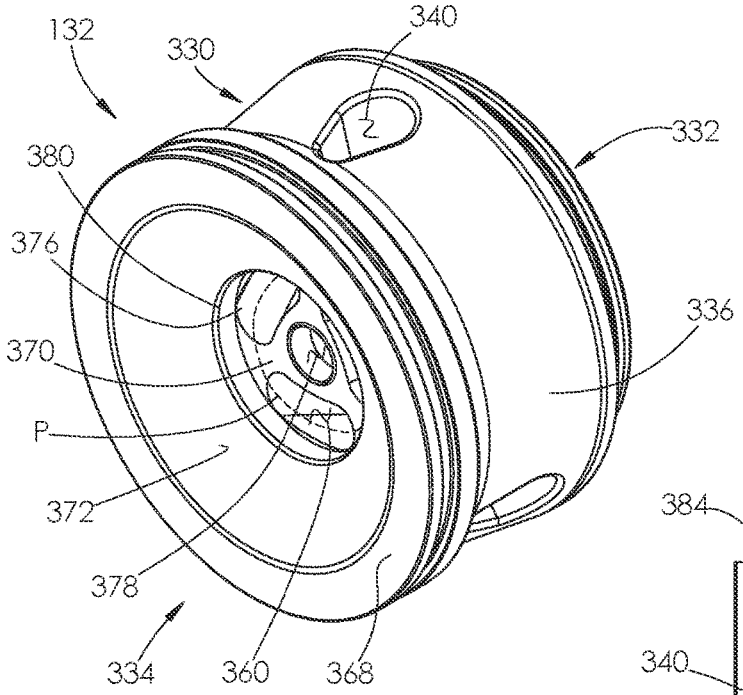
FIG. 46 is a front perspective view of the discharge surface of the fluid routing plug shown in FIGS. 11-13.
Figure 49:
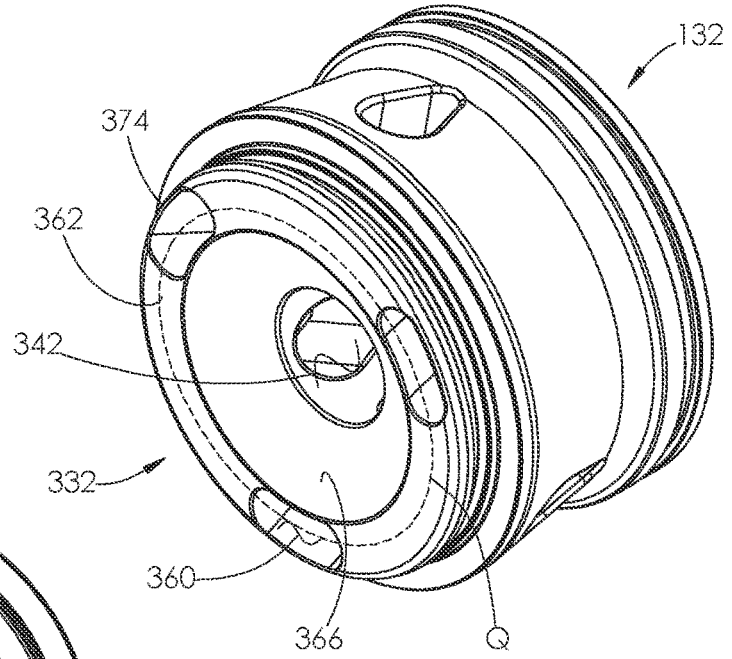
FIG. 49 is a rear perspective view of the suction surface of the fluid routing plug shown in FIG. 46.
Figure 50:
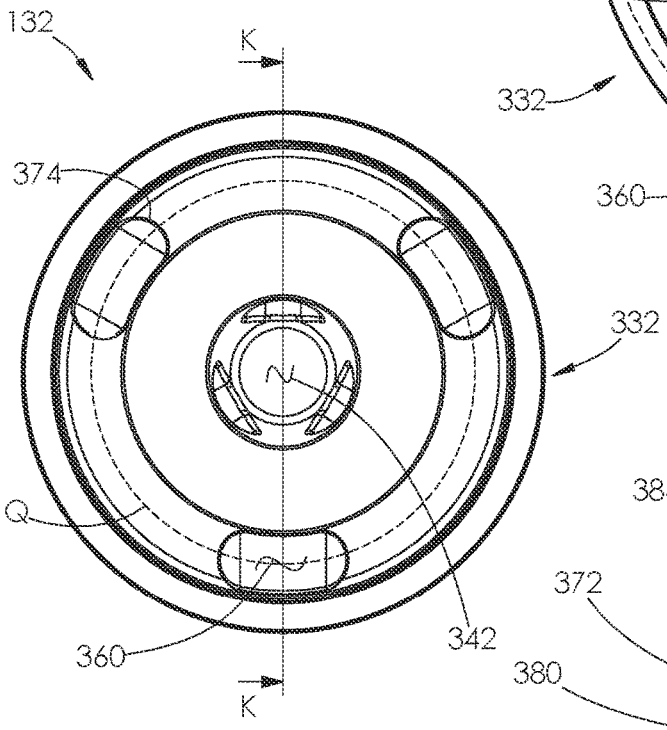
FIG. 50 is a side elevational view of the suction surface of the fluid routing plug shown in FIG. 49.

Each discharge passage 360 opens at a first opening 374 on the outer rim 362 of the suction surface 332 and opens at a second opening 376 on the central base 370 of the discharge surface 334, as shown in FIGS. 46 and 49. The second openings 376 surround a blind bore 378 formed in the central base 370 of the discharge surface 334. The blind bore 378 is configured to engage a tool used to grip the fluid routing plug 132, as needed. For example, the walls of the blind bore 378 may be threaded. The central base 370 may also be slightly recessed from the tapered seating surface 372 such that a small counterbore 380 is created, as shown in FIG. 51. The counterbore 380 helps further reduce any turbulence of fluid exiting the second openings 376.

With reference to FIGS. 54-58, the discharge passages 360 extend at an angle between the suction surface 332 and the discharge surface 334. Each discharge passage 360 further has an arced cross-sectional shape. The length of the arc may gradually increase between the suction and discharge surfaces 332 and 334. In alternative embodiments, the discharge passages 360 may have different shapes and sizes.

Turning back to FIG. 51, a first annular groove 384 is formed in the outer intermediate surface 336 of the body 330 for housing a first seal 144, as shown in FIGS. 11-13. The first groove 384 is positioned adjacent the discharge surface 334 and is characterized by two sides walls 388 joined by a base 390. When the fluid routing plug 132 is installed within the housing 60, the first seal 144 engages the sealing surface 142 of the first section 72 of the housing 60, as shown in FIGS. 11-13 and 59. Fluid is prevented from leaking around the discharge surface 334 of the fluid routing plug 132 by the first seal 144.

Figure 59:
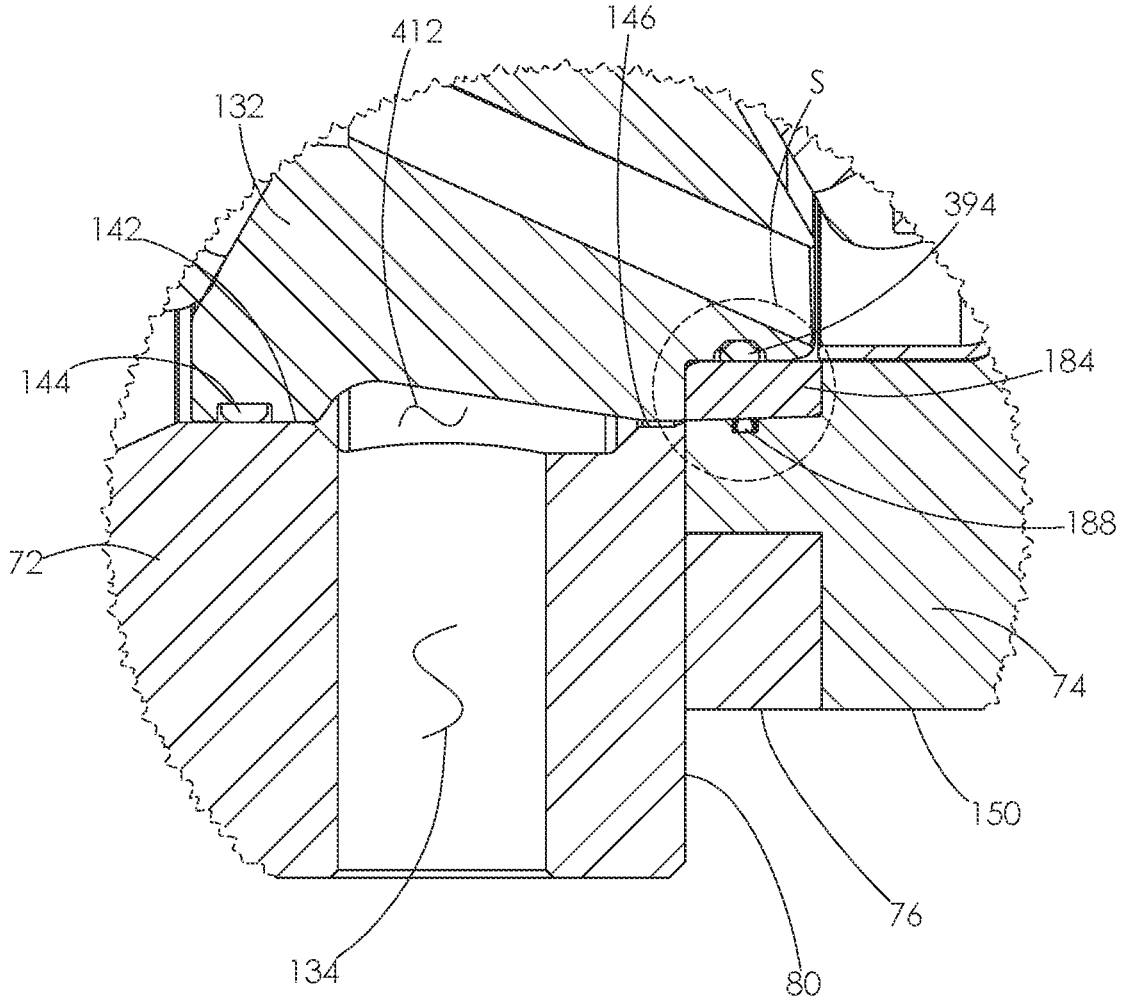
FIG. 59 is an enlarged view of area R, shown in FIG. 11.
Figure 60:
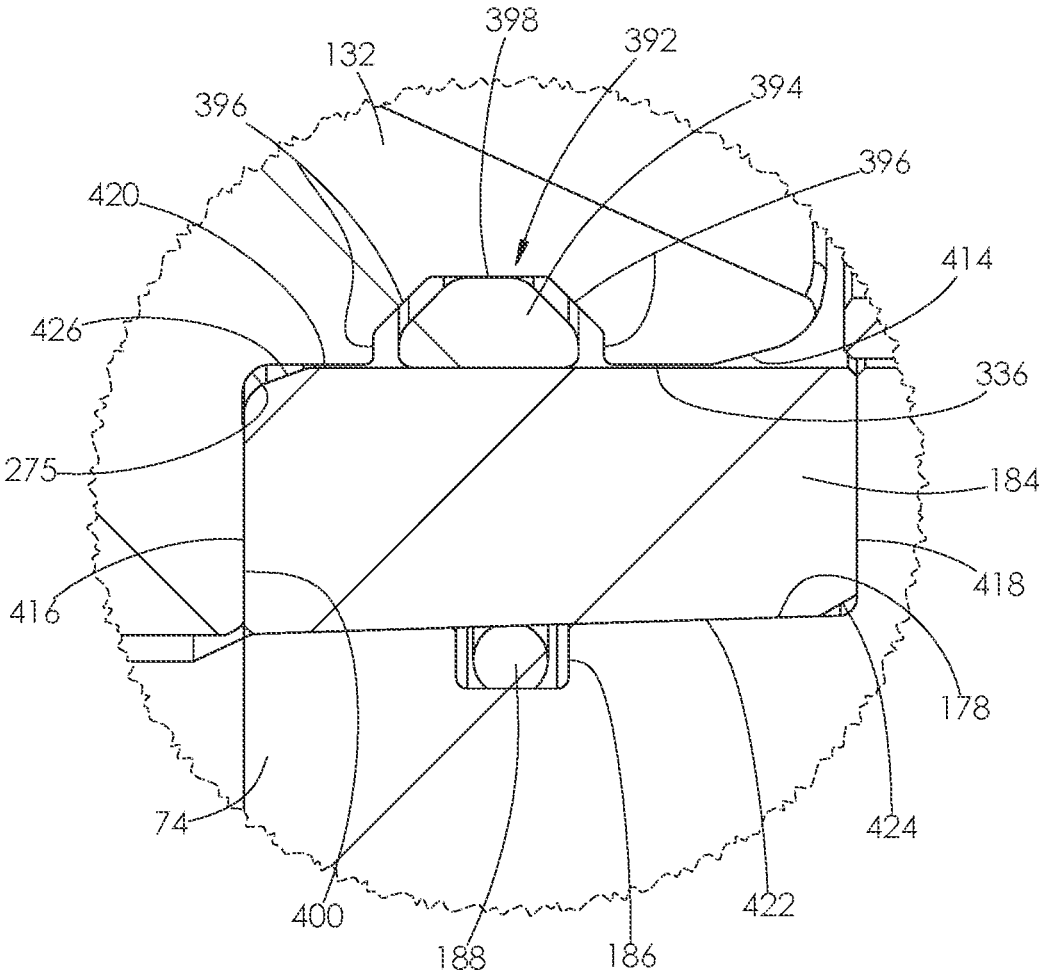
FIG. 60 is an enlarged view of area S, shown in FIG. 59.
Figure 61:
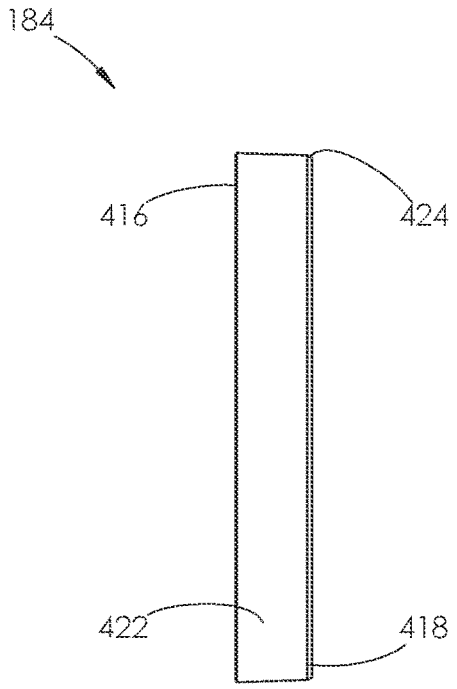
FIG. 61 is a side elevational view of the hardened insert shown in FIGS. 11-13.
Figure 62:
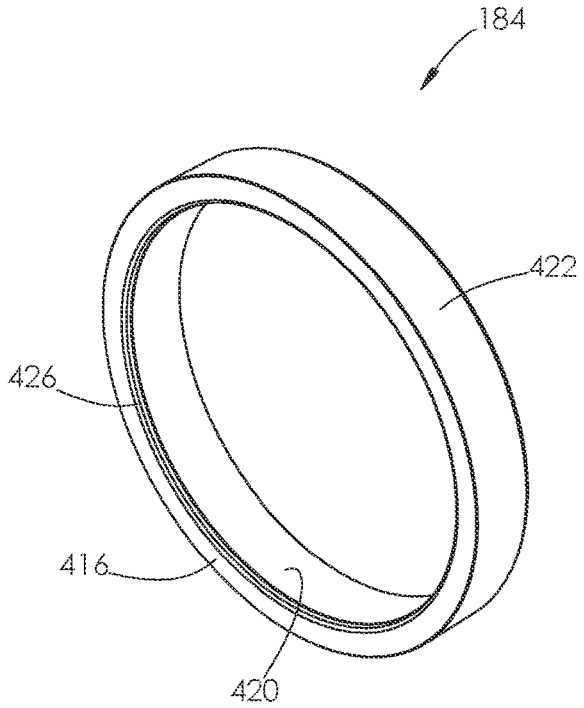
FIG. 62 is a front perspective view of the hardened insert shown in FIG. 61.

With reference to FIGS. 51 and 59, a second annular groove 392 is formed in the outer intermediate surface 336 of the body 330 for housing a second seal 394. The second groove 392 is positioned adjacent the suction surface 332 and is characterized by a plurality of side walls 396 joined by a base 398, as shown in FIG. 60. Four side walls 396 are shown in FIG. 60 such that the groove 392 has a rounded shape. When the fluid routing plug 132 is installed within the housing 60, the second seal 394 engages an outer surface of the hardened insert 184, as shown in FIGS. 59 and 60. During operation, the second seal 394 wears against the insert 184. If the insert 184 begins to erode, the insert 184 may be removed and replaced with a new insert 184.

The outer intermediate surface 336 of the body 330 further comprises an annular shoulder 400 formed in the body 330. The shoulder 400 is positioned between the opening 344 of the suction passages 340 and the second groove 392. When the fluid routing plug 132 is installed within the housing 60, the shoulder 400 abuts a front surface 416 of the insert 184, as shown in FIGS. 11-13 and 59. Axial movement of the fluid routing plug 132 towards the rear surface 66 of the housing 60 is prevented by the engagement between the shoulder 400 and the insert 184. During operation, the shoulder 400 may wear against the insert 184. If either feature begins to wear, the fluid routing plug 132 and/or the insert 184 may be removed and replaced with a new fluid routing plug 132 and/or insert 184.

The annular shoulder 400 further comprises a stress relief cutout 275, as shown in FIG. 60. The annular shoulder 400 does not contact the insert 184 in this area. The absence of contact reduces the stress on the annular shoulder 400 during operation, helping to extend the life of the fluid routing plug 132.

Figure 47:
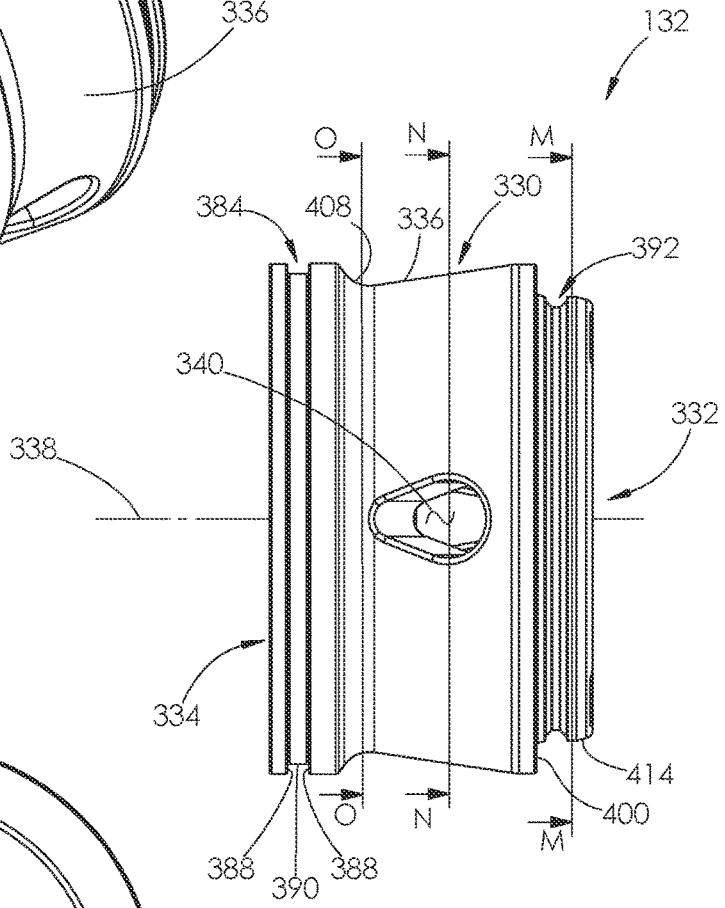
FIG. 47 is a side elevational view of the fluid routing plug shown in FIG. 46.
Figure 48:
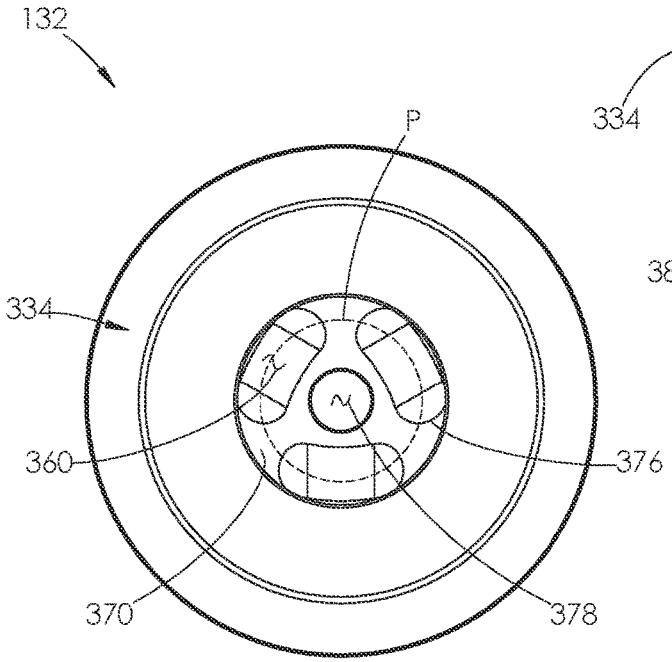
FIG. 48 is a front elevational view of the discharge surface of the fluid routing plug shown in FIG. 46.

The outer intermediate surface 336 of the body 330 further comprises a concave surface 408, as shown in FIG. 47. The outer intermediate surface 336 of the body 330 slowly tapers outward from the concave surface 408 to adjacent the annular shoulder 400. When the fluid routing plug 132 is installed within the housing 60, the concave surface 408 provides clearance between the outer intermediate surface 336 of the fluid routing plug 132 and an opening of the suction bores 133 and 134. Such clearance gives way to an annular fluid channel 412 formed between the first section 72 and the fluid routing plug 132, as shown in FIG. 59. The shape of the outer intermediate surface 336 of the fluid routing plug 132 helps direct fluid flowing from the suction bores 133 and 134 into the openings 344 of the suction passages 340 while minimizing fluid turbulence.

Turning to FIG. 60, the outer intermediate surface 336 of the body 330 further comprises a bevel 414 formed in the body 330. The bevel 414 is positioned between the outer rim 362 of the suction surface 332 and the second groove 392. The bevel 414 provides clearance to help install the fluid routing plug 132 within the housing 60 and the insert 210.

Hardened Insert and Wear Ring

With reference to FIGS. 60-64, the insert 184 has an annular shape and comprises opposed front and rear surfaces 416 and 418 joined by inner and outer intermediate surfaces 420 and 422. The outer intermediate surface 420 tapers between the front and rear surfaces 416 and 418. Such taper conforms to the tapered shape of the first counterbore 178, as shown in FIG. 60. The corresponding tapers help lock the insert 184 in place within the first counterbore 178.

Figure 63:
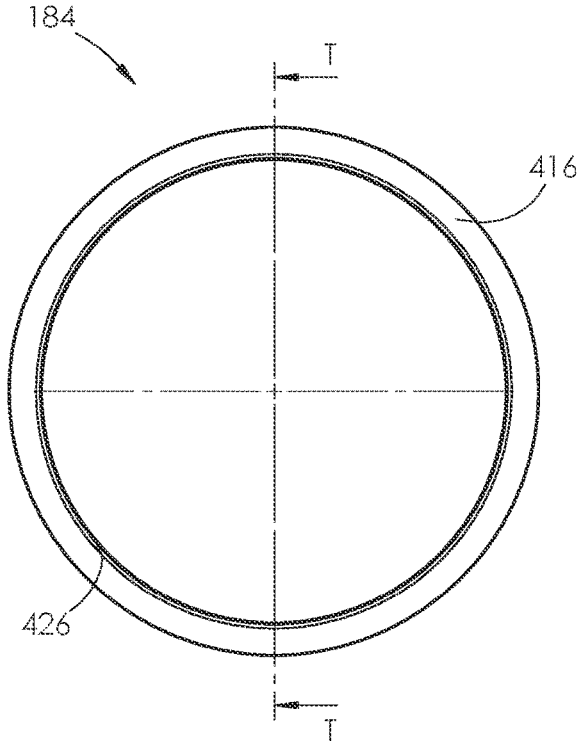
FIG. 63 is a front elevational view of the hardened insert shown in FIG. 61.
Figure 64:
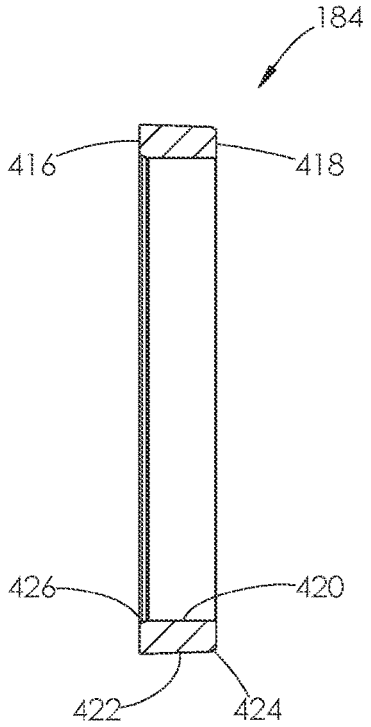
FIG. 64 is a cross-sectional view of the hardened insert shown in FIG. 63, taken along line T-T.

The insert 184 further comprises a first bevel 426 formed in the inner intermediate surface 420 adjacent the front surface 416, as shown in FIGS. 63 and 64. The first bevel 426 provides clearance to assist in installing the fluid routing plug 132 within the insert 184 within the housing 60, as shown in FIG. 60. The insert 184 also comprises a second bevel 424 formed in the outer intermediate surface 422 adjacent the rear surface 418. The second bevel 424 provides clearance to assist in installing the insert 184 within the first counterbore 178, as shown in FIG. 60. The insert 184 is made of a harder and more wear resistant material than the housing 60. For example, if the housing 60 is made of stainless steel, the insert 184 may be made of tungsten carbide. The insert 184 may also be characterized as a wear ring 184.

Figure 69:
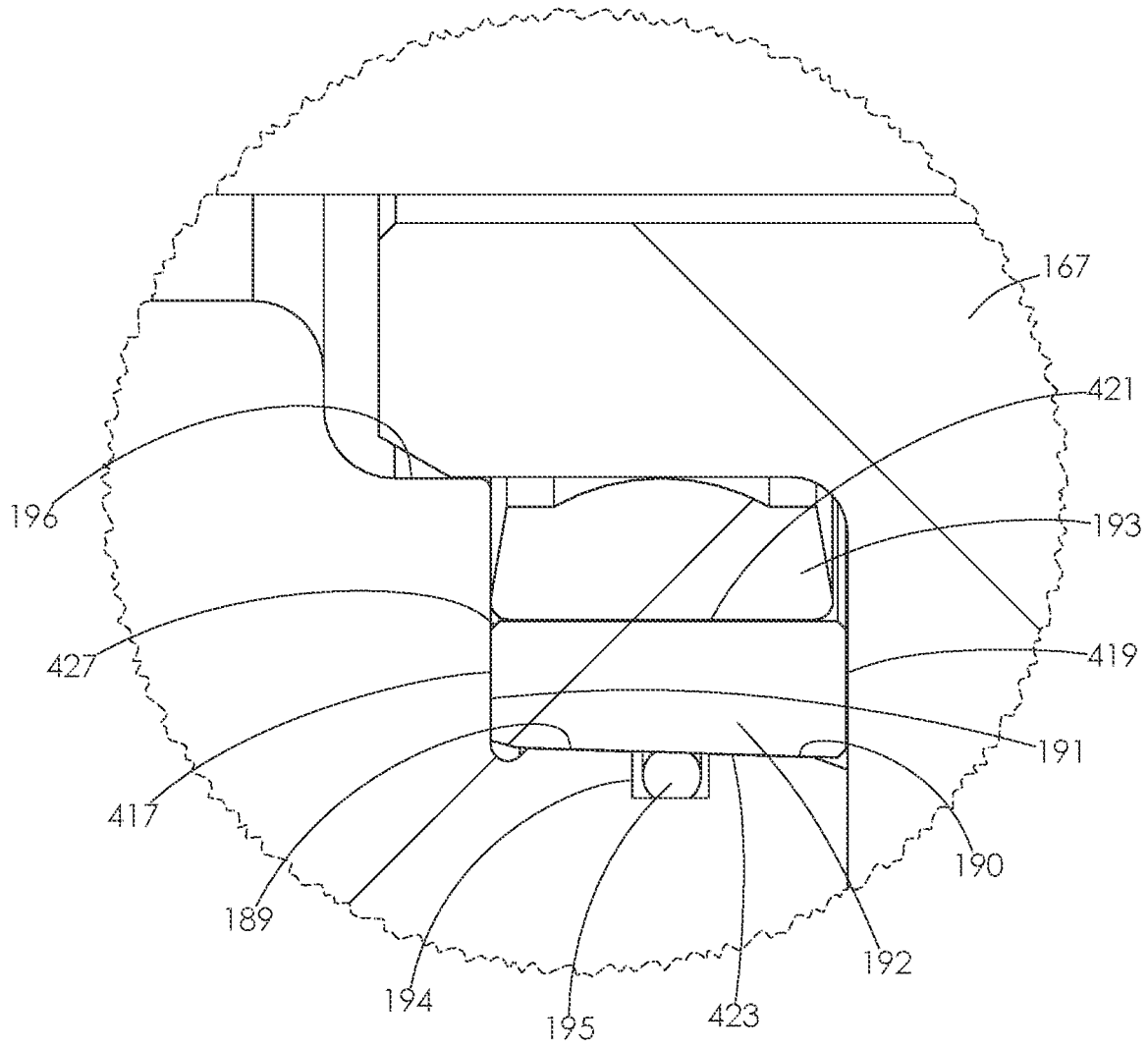
FIG. 69 is an enlarged view of area V shown in FIG. 13.
Figure 70:
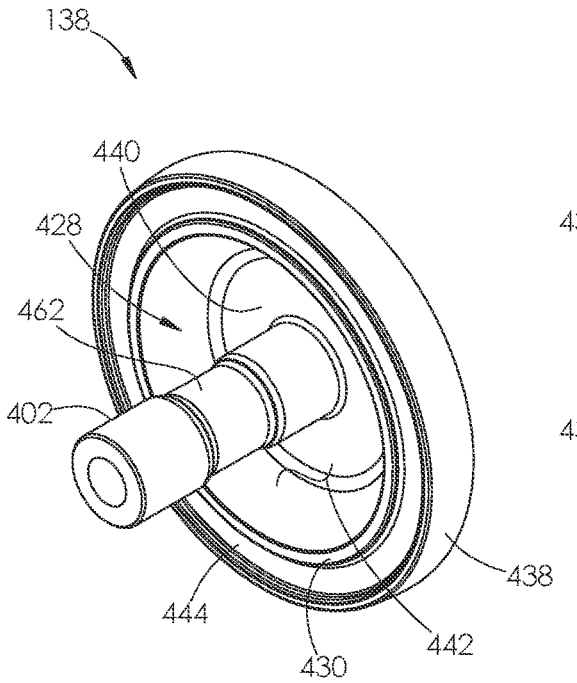
FIG. 70 is a front perspective view of the discharge valve shown in FIGS. 11-13.
Figure 71:
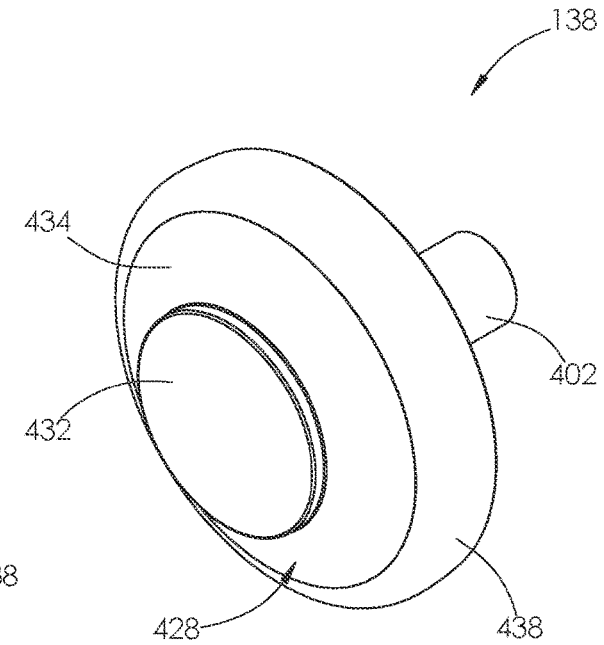
FIG. 71 is a rear perspective view of the discharge valve shown in FIG. 70.

With reference to FIGS. 65-69, the wear ring 192 has an annular shape and comprises opposed front and rear surfaces 417 and 419 joined by inner and outer intermediate surfaces 421 and 423. The outer intermediate surface 423 tapers between the front and rear surfaces 417 and 419. Such taper conforms to the tapered shape of the second counterbore 189, as shown in FIG. 69. The corresponding tapers help lock the wear ring 192 in place within the second counterbore 189.

Figure 65:
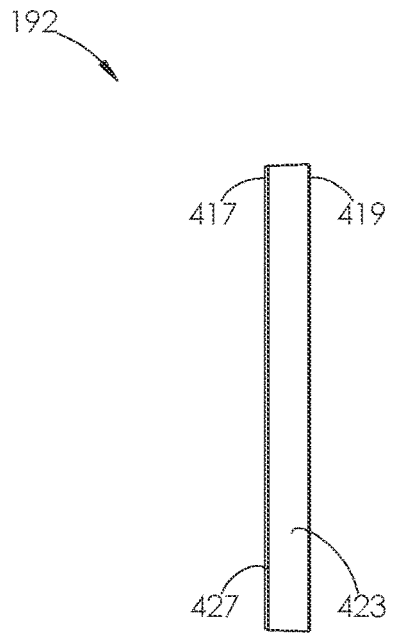
FIG. 65 is a side elevational view of the wear ring shown in FIGS. 11-13.
Figure 66:
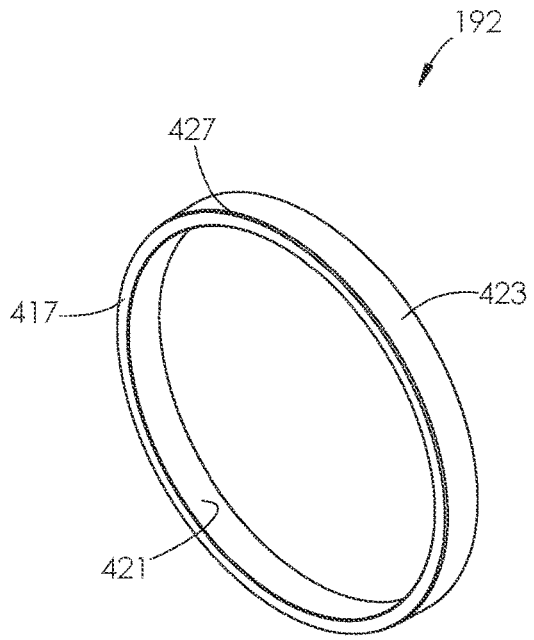
FIG. 66 is a front perspective view of the wear ring shown in FIG. 65.
Figure 67:
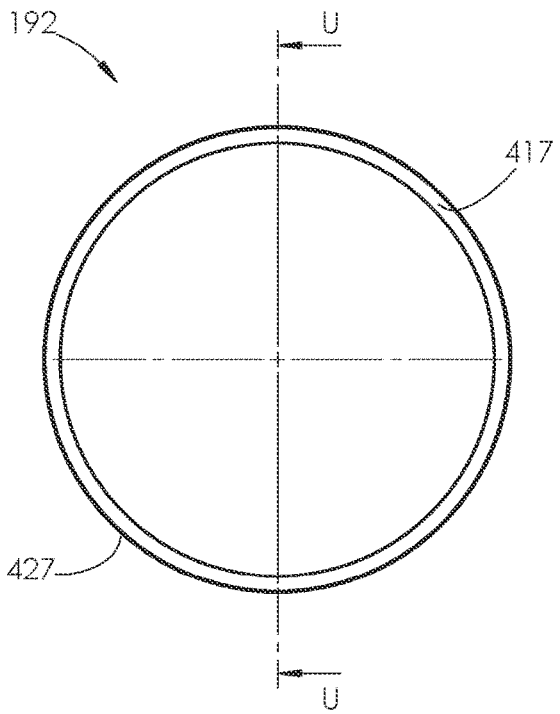
FIG. 67 is a front elevational view of the wear ring shown in FIG. 65.
Figure 68:
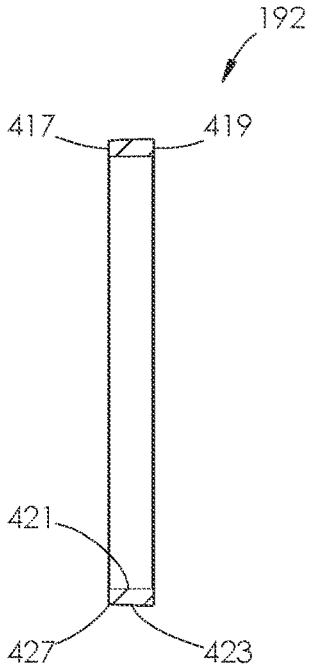
FIG. 68 is a cross-sectional view of the wear ring shown in FIG. 67, taken along line U-U.

The wear ring 192 further comprises a first bevel 427 formed in the outer intermediate surface 423 adjacent the front surface 417, as shown in FIG. 65. The first bevel 427 provides clearance to assist in installing the wear ring 192 within the second counterbore 189, as shown in FIG. 69. The wear ring 192 is made of a harder and more wear resistant material than the housing 60. For example, if the housing 60 is made of stainless steel, the wear ring 192 may be made of tungsten carbide.

Suction and Discharge Valves

With reference to FIGS. 70-73, the flow of fluid throughout the housing 60 and the fluid routing plug 132 is regulated by the suction and discharge valves 280 and 138. The suction valve 280 is configured to engage the suction surface 332, and the discharge valve 138 is configured to engage the discharge surface 334 of the fluid routing plug 132 such that the surfaces 332 and 334 function as valve seats, as shown in FIGS. 11-13. The valves 280 and 138 are similar in shape but may vary in size. As shown in FIGS. 11-13, the discharge valve 138 is slightly larger than suction valve 280.

Figure 72:
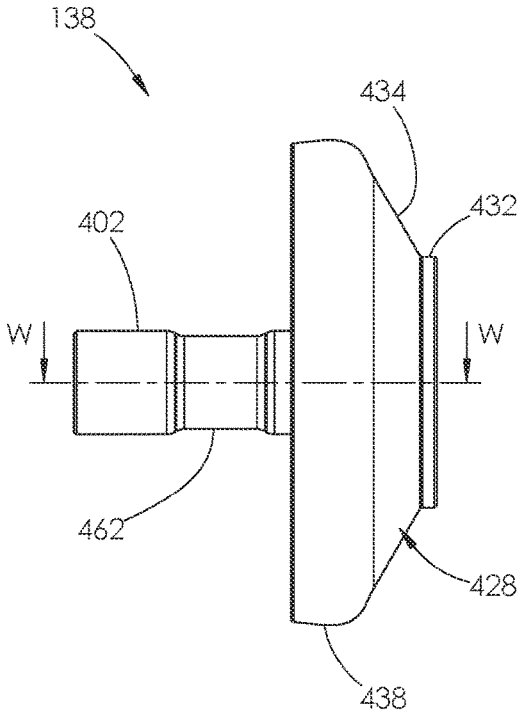
FIG. 72 is a side elevational view of the discharge valve shown in FIG. 70.
Figure 73:
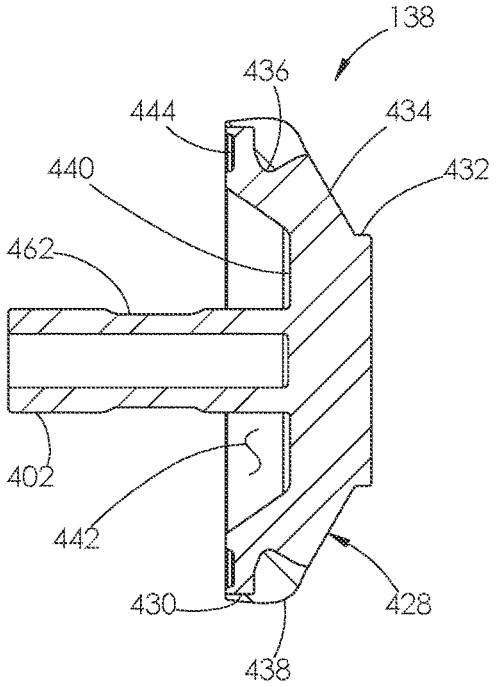
FIG. 73 is a cross-sectional view of the discharge valve shown in FIG. 72, taken along line W-W.
Figure 74:
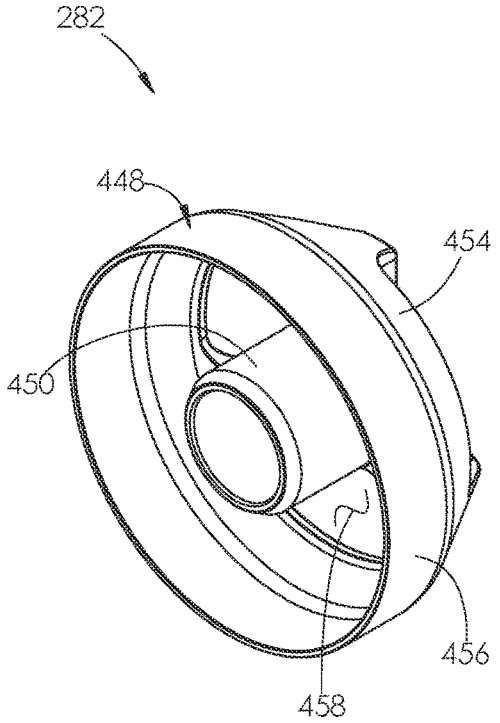
FIG. 74 is a front perspective view of the suction valve guide shown in FIGS. 11-13.
Figure 75:
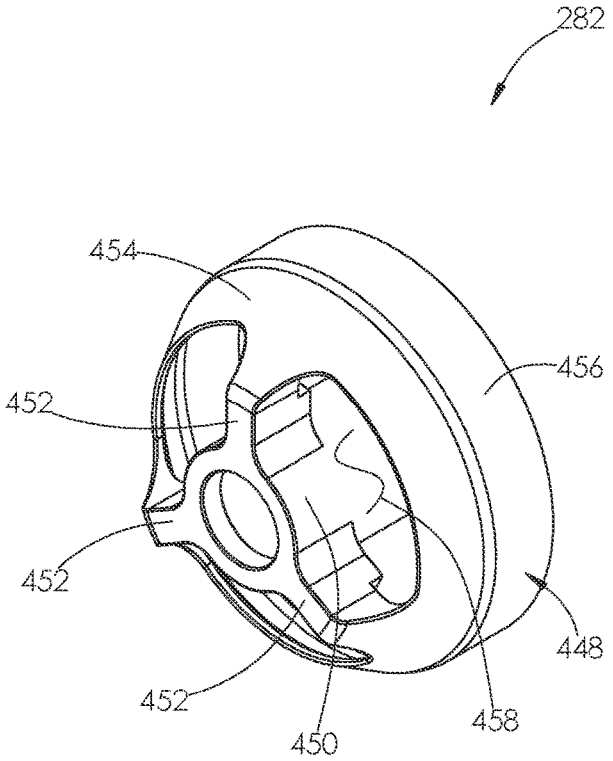
FIG. 75 is a rear perspective view of the suction valve guide shown in FIG. 74.
Figure 76:
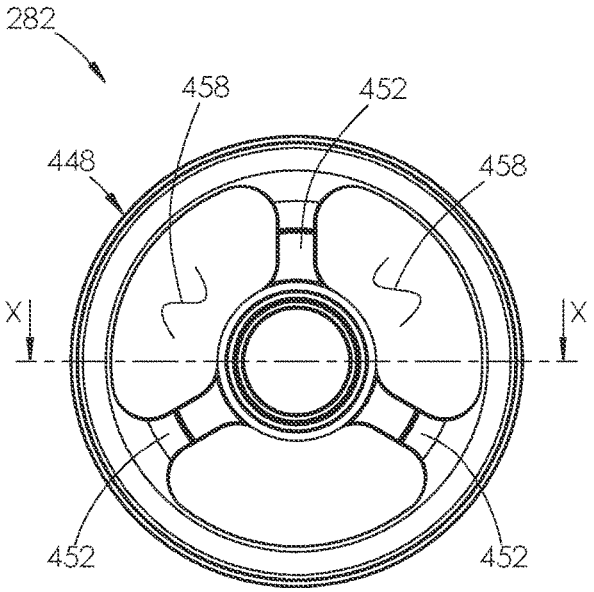
FIG. 76 is a front elevational view of the suction valve guide shown in FIG. 74.
Figure 77:
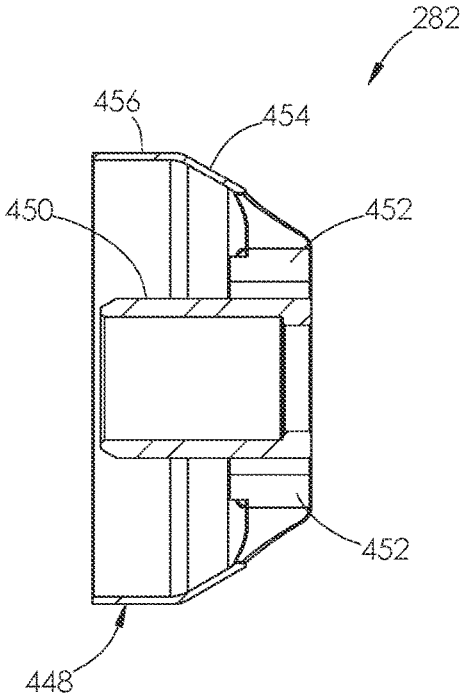
FIG. 77 is a cross-sectional view of the suction valve guide shown in FIG. 76, taken along line X-X.
Figure 78:
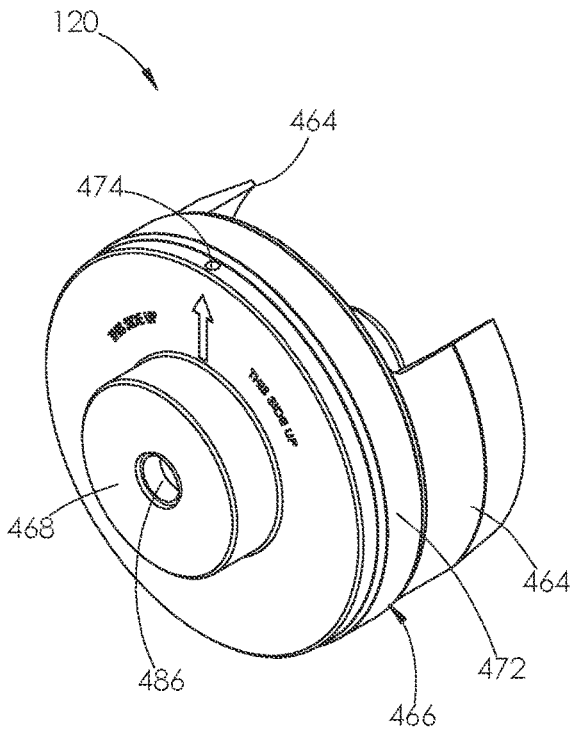
FIG. 78 is a front perspective view of the discharge plug shown in FIGS. 11-13.
Figure 79:
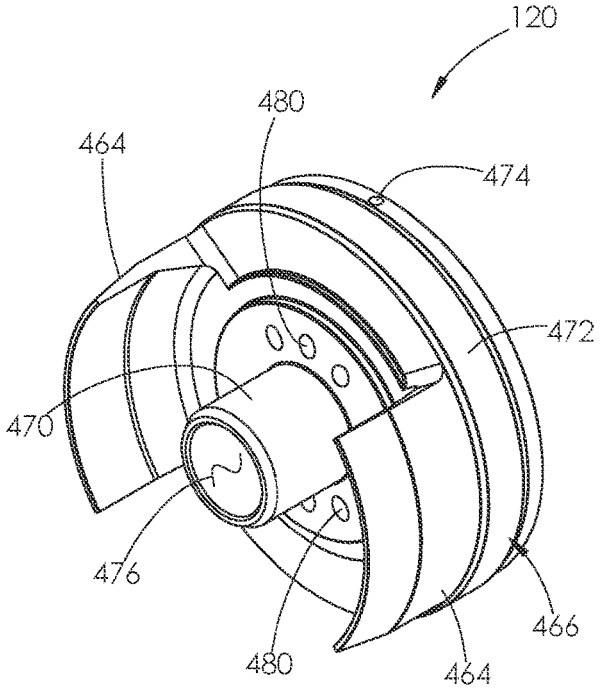
FIG. 79 is a rear perspective view of the discharge plug shown in FIG. 78.
Figure 80:
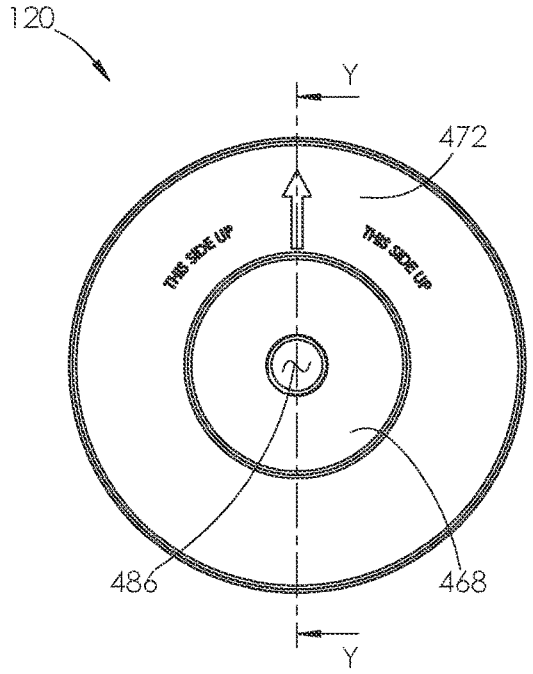
FIG. 80 is a front elevational view of the discharge plug shown in FIG. 78.

Continuing with FIGS. 70-73, the discharge valve 138 is shown in more detail. The suction valve 280 has the same features as the discharge valve 138 so only the discharge valve 138 is shown in more detail in the figures. The discharge valve 138 comprises a stem 402 joined to a body 428. The body 428 comprises an outer rim 430 joined to a valve insert 432 by a tapered seating surface 434. An annular cutout 436 formed within the seating surface 434 is configured to house a seal 438, as shown in FIG. 73.

During operation, the seating surface 434 and the seal 438 engage the seating surface 372 of the discharge surface 334 and block fluid from entering or exiting the discharge passages 360, as shown in FIG. 12. Likewise, the seating surface 434 and the seal 438 on the suction valve 280 engage the seating surface 366 of the suction surface 332 and block fluid from entering or exiting the suction passages 340 within the axially-blind bore 342, as shown in FIG. 12.

When the seating surfaces 434 and 372 are engaged, the valve insert 432 extends partially into the counterbore 380 formed in the discharge surface 334, as shown in FIG. 11. Fluid exiting the second openings 376 of the discharge passages 360 contacts the insert 432, pushing the discharge valve 138 away from the discharge surface 334 before flowing around the seating surface 434 of the discharge valve 138, as shown in FIGS. 12 and 13. Such motion enlarges the area for fluid to flow between the seating surfaces 372 and 434 before fluid reaches the surfaces 372 and 434, thereby reducing the velocity of fluid flow within such area. The lowered fluid velocity between the surfaces 372 and 434 causes any wear to the valve 138 or 280 to be concentrated at the insert 432 instead of the crucial sealing elements, thereby extending the life of the valve 138 or 280.

Likewise, the insert 432 on the suction valve 280 extends partially into the opening of the axially-blind bore 342, as shown in FIGS. 12 and 13. Fluid within the axially-blind bore 342 contacts the insert 432 before flowing around the seating surface 434 and seal 438 of the suction valve 280. Such motion enlarges the area for fluid to flow between the seating surfaces 366 and 434 before fluid reaches the surfaces 366 and 434, thereby reducing the velocity of fluid flow within such area.

Continuing with FIGS. 70-73, the stem 402 projects from a top surface 440 of the body 428 of the valve 138 or 280. The outer rim 430 surrounds the stem 402 and is spaced from the stem 402 by an annular void 442. A groove 444 is formed in the outer rim 430 for receiving a portion of a spring 446, as shown in FIGS. 11-13.

During operation, the valves 138 and 280 move axially along the longitudinal axis 62 of the housing 60 between open and closed positions. In the closed position, the seating surface 434 and the seal 438 of each of the valves 138 and 280 tightly engage the corresponding seating surface 372 or 366 of the fluid routing plug 132 and the valve insert 432 is disposed within the corresponding bore 380 or 342. In the open position, the seating surface 434 and the seal 438 are spaced from the corresponding seating surface 372 or 366 of the fluid routing plug 132 and the valve insert 432 is spaced from the corresponding bore 380 or 342.

Suction Valve Guide

With reference to FIGS. 74-77, axial movement of the suction valve 280 is guided by the suction valve guide 282. The suction valve guide 282 comprises a thin-walled skirt 448 joined to a body 450 by a plurality of support arms 452. The skirt 448 comprises a tapered upper section 454 joined to a cylindrical lower section 456. The plurality of arms 452 join the tapered upper section 454 to the body 450. A plurality of flow ports 458 are formed between adjacent arms 452 such that fluid may pass through the suction valve guide 282 during operation.

Continuing with FIGS. 74-77, the suction valve guide 282 is installed within the housing 60 such that the tapered upper section 454 engages a tapered surface 455 of the wall of the horizontal bore 70, as shown in FIG. 13. Such engagement prevents further axial movement of the suction valve guide 282 within the housing 60. When the suction valve guide 282 is installed within the housing 60, the skirt 448 covers the wall of the horizontal bore 70 positioned between the flow ports 458 and the fluid routing plug 132. During operation, fluid wears against the skirt 448, thereby protecting the housing 60 from wear and erosion. If the skirt 448 begins to erode, the suction valve guide 282 can be removed and replaced with a new guide 212.

The body 450 of the suction valve guide 282 is tubular and is centered within the skirt 448. A tubular insert 460 is installed within the body 450, as shown in FIG. 11. The insert 460 is configured to receive the stem 402 of the suction valve 280. During operation, the stem 402 moves axially within the insert 460 and wears against the insert 460. An annular cutout 462 formed in the stem 402, shown in FIGS. 72 and 73, provides space for any fluid or other material trapped between the stem 402 and the insert 460. The insert 460 is made of a harder and more wear resistant material than the body 450 thereby 1*s* extending the life of the suction valve guide 282. For example, if the body 450 is made of stainless steel, the insert 460 may be made of tungsten carbide.

A spring 446 is positioned between the outer rim 430 of the suction valve 280 and the plurality of arms 452 such that the spring 446 surrounds at least a portion of the body 450 of the suction valve guide 282, as shown in FIGS. 11-13. During operation, the spring 446 biases the suction valve 212 in a closed position, as shown in FIGS. 12 and 13. Fluid pushing against the valve insert 432 moves the suction valve 280 axially to compress the spring 446 and move the suction valve 280 to an open position, as shown in FIG. 11.

Discharge Plug

With reference to FIGS. 78-81, axial movement of the discharge valve 138 is guided by the discharge plug 120. The discharge plug 120 comprises a pair of legs 464 joined to a body 466. The body 466 comprises a front portion 468 joined to a rear portion 470 by a medial portion 472. The medial portion 472 has a larger outer diameter than both the front and rear portions 468 and 470. An outer surface of the medial portion 472 engages the seal 126 installed within the first section 72 of the housing 60, as shown in FIGS. 11-13. The pair of legs 464 are joined to the medial portion 472 and extend between the medial portion 472 and the discharge surface 334 of the fluid routing plug 132.

A dowel opening 474 is formed in the outer surface of the medial portion 472 for receiving the locating dowel pin 130, as shown in FIG. 11. The discharge plug 120 is installed within the first section 72 of the housing 60 such that the locating dowel pin 130 is installed within the dowel opening 474 formed in the medial portion 472 and the locating cutout 128 formed in the first section 72 of the housing 60, as shown in FIG. 11. Such installation aligns the discharge plug 120 within the housing 60 so that the pair of legs 464 do not block the openings of the upper and lower discharge bores 102 and 104.

The locating cutout 128 may be large enough to provide sufficient clearance for installation of the locating dowel pin 130 within the locating cutout 128. The locating cutout 128 is sized to allow maximum clearance for assembly, but still maintain an acceptable rotational position of the discharge plug 120. For example, the cutout 128 may be a maximum of 15 degrees wide along the circumference of the horizontal bore 70.

Figure 81:
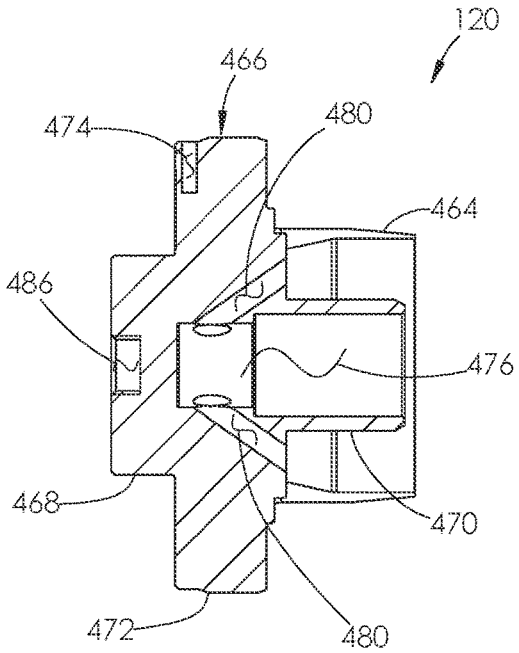
FIG. 81 is a cross-sectional view of the discharge plug shown in FIG. 80, taken along line Y-Y.

Continuing with FIG. 81, an axially-blind bore 476 extends within the body 466 and opens on the rear portion 470 of the body 466. The bore 476 is sized to receive a tubular insert 478, as shown in FIGS. 11-13. The tubular insert 478 is similar to the tubular insert 460 installed within the suction valve guide 282. The tubular insert 478 is configured to receive the stem 402 of the discharge valve 138, as shown in FIGS. 11-13.

During operation, the stem 402 moves axially within the tubular insert 478. A plurality of passages 480 are formed in the body 466 and interconnect the bore 476 and an outer surface of the medial portion 472. During operation, any fluid or other material trapped within the bore 476 exits the discharge plug 120 through the passages 480. A spring 446 is positioned between the medial portion 472 of the plug 120 and the outer rim 430 of the discharge valve 138, as shown in FIGS. 11-13. The spring 446 biases the discharge valve 138 in the closed position, as shown in FIG. 11. Fluid pushing against the valve insert 432 moves the discharge valve 138 axially to compress the spring 446 and move the discharge valve 138 to an open position, as shown in FIG. 13.

The front portion 468 of the body 466 is sized to be disposed within a counterbore 482 formed within the front retainer 118. When disposed therein, a rear surface 484 of the front retainer 118 abuts an outer surface of the medial portion 472 of the discharge plug 120, as shown in FIGS. 11-13. Such engagement holds the discharge plug 120 in place between the front retainer 118 and the fluid routing plug 132. A blind bore 486 is formed in an outer surface of the front portion 468 of the plug 120. The blind bore 486 is configured to engage a tool used to help install or remove the plug 120 from the housing 60. For example, the bore 486 may have threaded walls.

Front Retainer

Figure 82:
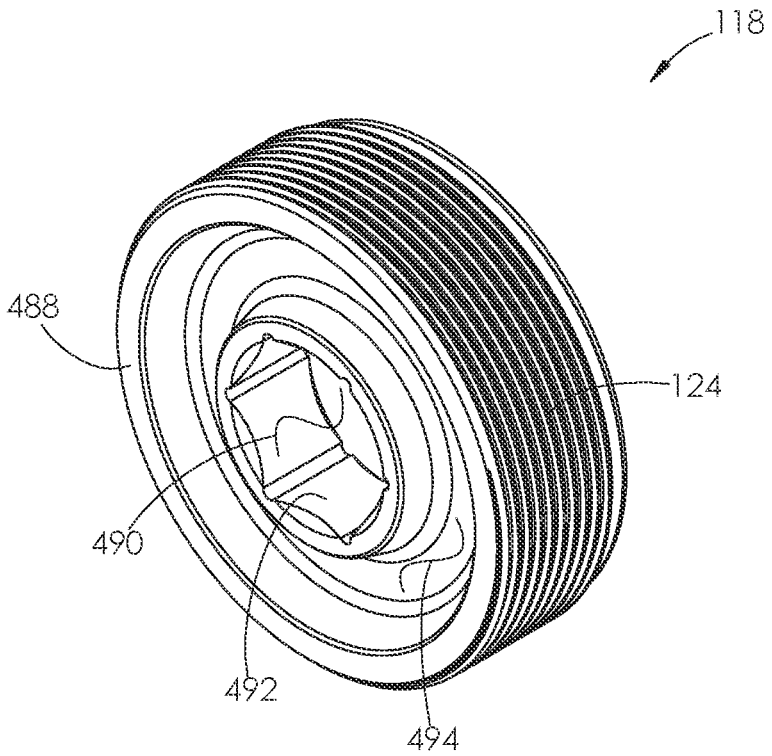
FIG. 82 is a front perspective view of the front retainer shown in FIGS. 11-13.
Figure 83:
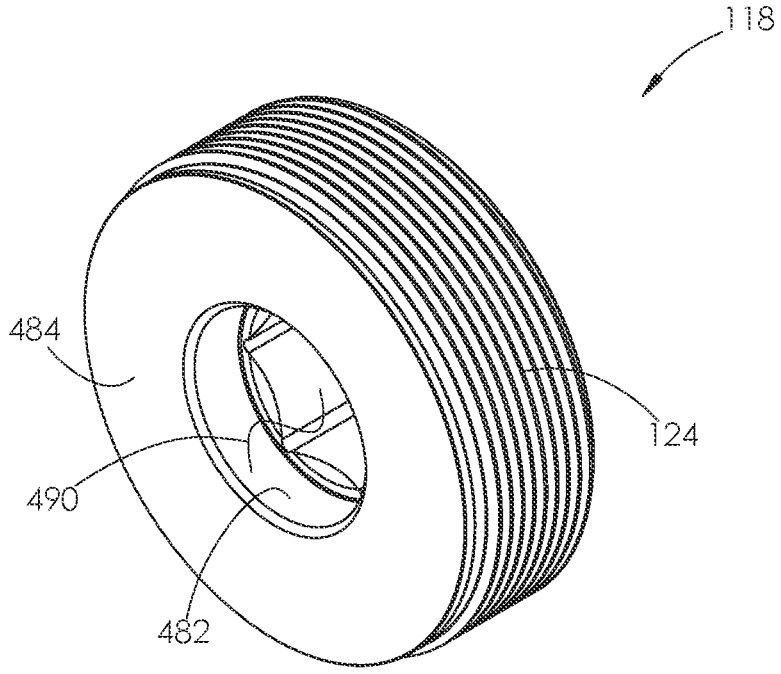
FIG. 83 is a rear perspective view of the front retainer shown in FIG. 82.

With reference to FIGS. 82 and 83, the front retainer 118 comprises opposed front and rear surfaces 488 and 484 joined by an outer surface having external threads 124 and a horizontal bore 490 formed therein. The horizontal bore 490 comprises a hex portion 492 that opens in the counterbore 482, as shown in FIGS. 11-13. The hex portion 492 is configured to mate with a tool used to thread the front retainer 118 into the housing 60 until it abuts the discharge plug 120, as shown in FIGS. 11-13. An annular void 494 is formed within the front surface 488 of the front retainer 118. The annular void 494 decreases the weight of the front retainer 118, making it easier to thread into the housing 60.

Suction and Discharge Manifolds

With reference to FIGS. 3, the discharge fitting 107 is configured to mate within one or more discharge conduits 105 included in an upper or lower discharge manifold 109 or 117. The upper and lower discharge manifolds 109 and 117 are supported on a rack 498, as shown in FIG. 3. The fluid end assembly 52 is disposed within the interior open area of the rack 498. The rack 498 supports the upper and lower discharge manifolds 109 or 117 in a spaced position from the discharge bores 102 and 104. As a result, each discharge conduit 105 has an angled or bent shape. In operation, fluid discharges from the housing 60 through upper and lower discharge bores 102 and 104 and is carried to the corresponding upper or lower discharge manifolds 109 and 117 by the discharge fittings 107 and discharge conduits 105.

Continuing with FIG. 3, the suction conduits 136 are configured to mate with an upper or lower suction manifold 111 or 119. The upper and lower suction manifolds 111 and 119 are supported on the rack 498 adjacent the discharge manifolds 109 or 117. The suction conduits 136 may be flexible so that they may bend, as needed, to properly mate with the corresponding suction manifold 111 or 119. In operation, fluid is drawn into the housing 60 from the suction manifolds 111 and 119 via the suction conduits 136 and the upper and lower suction bores 133 and 134. In alternative embodiments, other known embodiments of suction and discharge conduits and/or corresponding fittings and manifolds may be used in place of those shown in FIG. 3.

Assembly of Fluid End Section

With reference to FIGS. 11-13, 84, and 85, prior to assembling the housing 60, the seals 188 and 195 are installed in the corresponding groove 186 and 194. Likewise, the hardened insert 184 is pressed into the first counterbore 178 and the wear ring 192 is pressed into the second counterbore 189. The seal 193 is then installed within the wear ring 192 and the second counterbore 189.

Following installation of the above components, the housing 60 may be assembled as described above. Thereafter, the rear spacer sleeve 168, stuffing box 167, rear retainer 209, plunger packing 210, and packing nut 211 may be attached to the rear surface 66 of the housing 60. The plunger 240 is also inserted into the horizontal bore 70 through the packing nut 211. The inner components of the housing 60 are inserted within the housing 60 through the front surface 64 of the first section 72. The inner components may be installed prior to attaching the components to the rear surface 66 of the housing 60, if desired. Following assembly of each fluid end section 56, each section 56 is attached to the power end assembly 54 using the stay rods 58.

Each fluid end section 56 and its various components are heavy and cumbersome. Various tools or lifting mechanisms may be used to assemble the fluid end assembly 52 and attach it to the power end assembly 54, creating the high-pressure pump 50.

Operation of Fluid End Assembly

Turning back to FIGS. 11-13, in operation, retraction of the plunger 240 out of the housing 60 pulls fluid from the upper and lower suction bores 133 and 134 into the suction passages 340 within the fluid routing plug 132. Fluid flowing through the suction passages 340 and into the axially-blind bore 342 pushes on the valve insert 432 of the suction valve 280, causing the valve 280 to compress the spring 446 and move to an open position, as shown in FIG. 11. When in the open position, fluid flows around the suction valve 280 and the suction valve guide 282 and into the open horizontal bore 70 within the second section 74 of the housing 60.

Extension of the plunger 240 further into the housing 60 pushes against fluid within the open horizontal bore 70 and forces the fluid towards the suction surface 332 of the fluid routing plug 132. Such motion also causes the suction valve 280 to move to a closed position, sealing the opening of the axially-blind bore 342. Because the bore 342 is sealed, fluid is forced into the discharge passages 360, as shown in FIG. 12.

Fluid flowing through the discharge passages 360 contacts the valve insert 432 on the discharge valve 138, causing the discharge valve 138 to compress the spring 446 and move into an open position. When in the open position, fluid flows around the discharge valve 138 and into the upper and lower discharge bores 102 and 104. Fluid exiting the discharge passages 360 has a higher pressure than the fluid entering the housing 60 through the suction bores 133 and 134.

Figure 1:
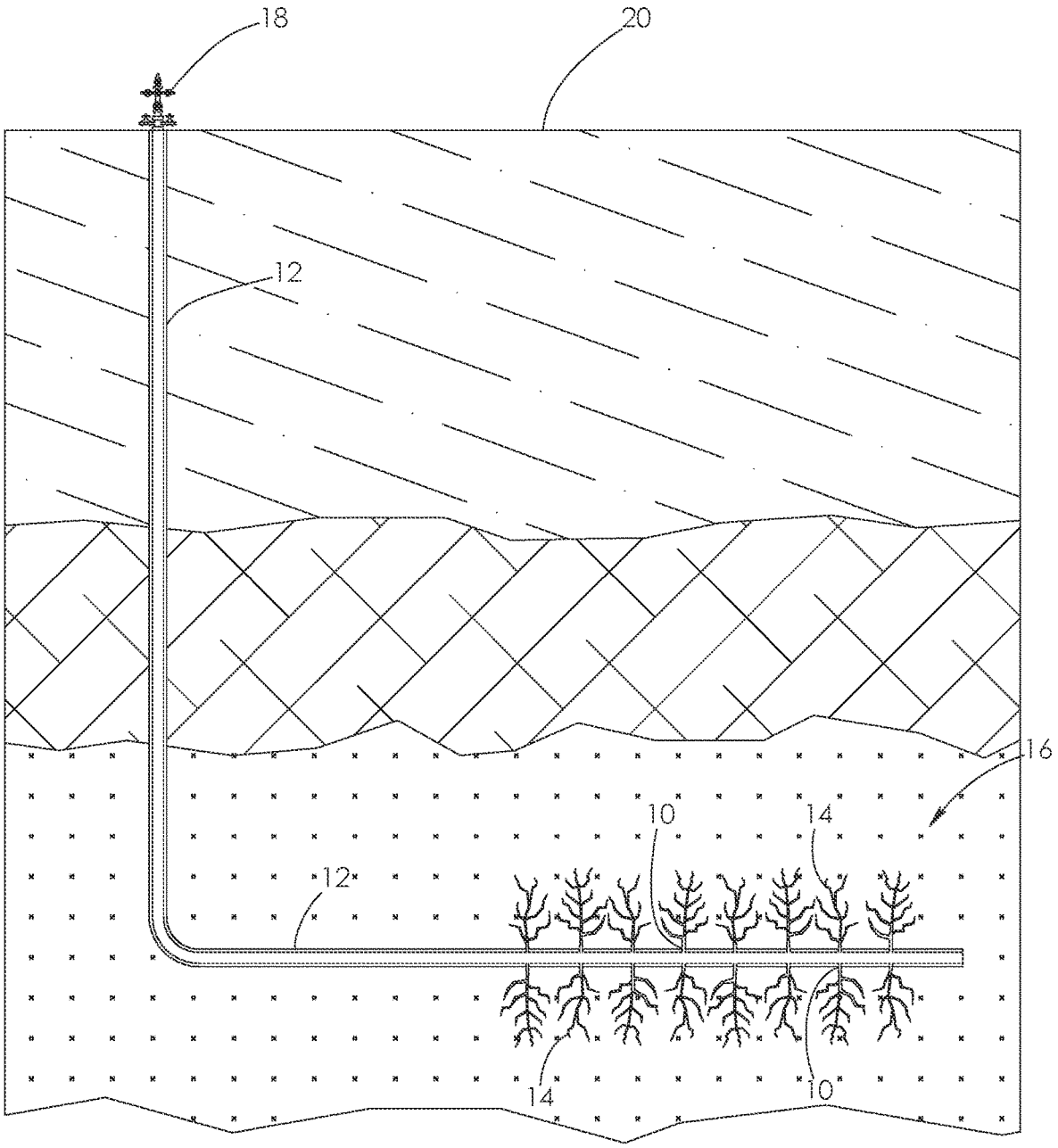
PRIOR ART FIG. 1
FIG. 1 is an illustration of the underground environment of a hydraulic fracturing operation.
Figure 2:
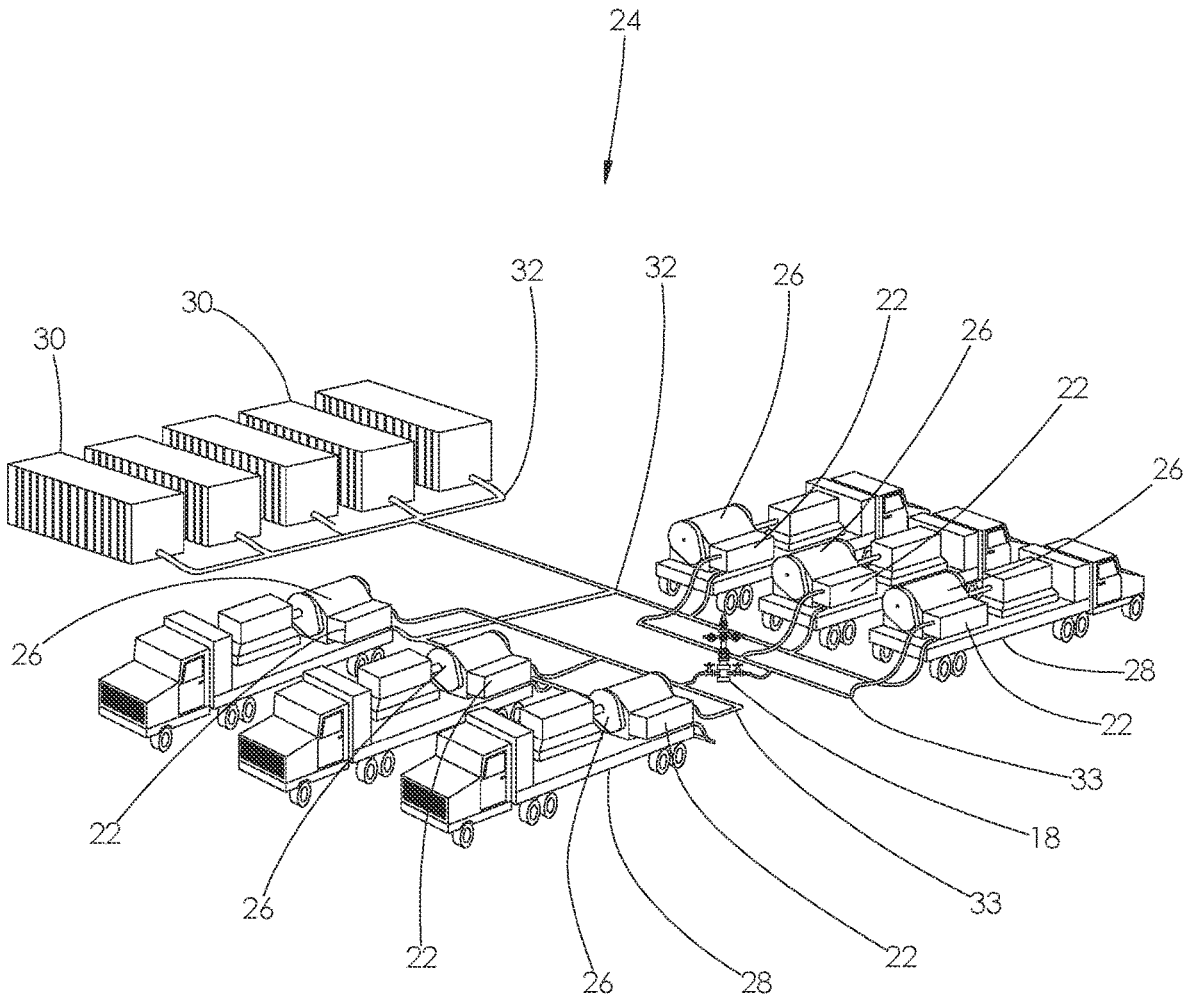
PRIOR ART FIG. 2
FIG. 2 illustrates above-ground equipment used in a hydraulic fracturing operation.

During operation, the plunger 240 continually reciprocates within the housing 60, pressuring all fluid drawn into the housing 60 through the suction bores 133 and 134. Pressurized fluid exiting the housing 60 through the upper and lower discharge bores 102 and 104 is delivered to the upper and lower discharge manifolds 109 and 117 in communication with each of the fluid end sections 56. Pressurized fluid within the discharge manifolds 109 and 117 is eventually delivered to the wellhead 18, as shown in FIG. 2.

Alternative Embodiments

Turning to FIGS. 86-120, alternative embodiments of a fluid end section 500 and 600 are shown. For ease of reference, components included in the alternative embodiments that are identical or nearly identical to components included in the fluid end section 56, shown in FIGS. 3-85, will be given the same reference numbers.

With reference to FIGS. 86-93, another embodiment of a fluid end section 500 is shown. The fluid end section 500 is identical to the fluid end section 56, but it comprises another embodiment of a housing 502. The housing 502 has the same general shape as the housing 60, but the housing 502 is of single-piece construction. The housing 502 does not include multiple sections joined together by fasteners.

Figure 88:
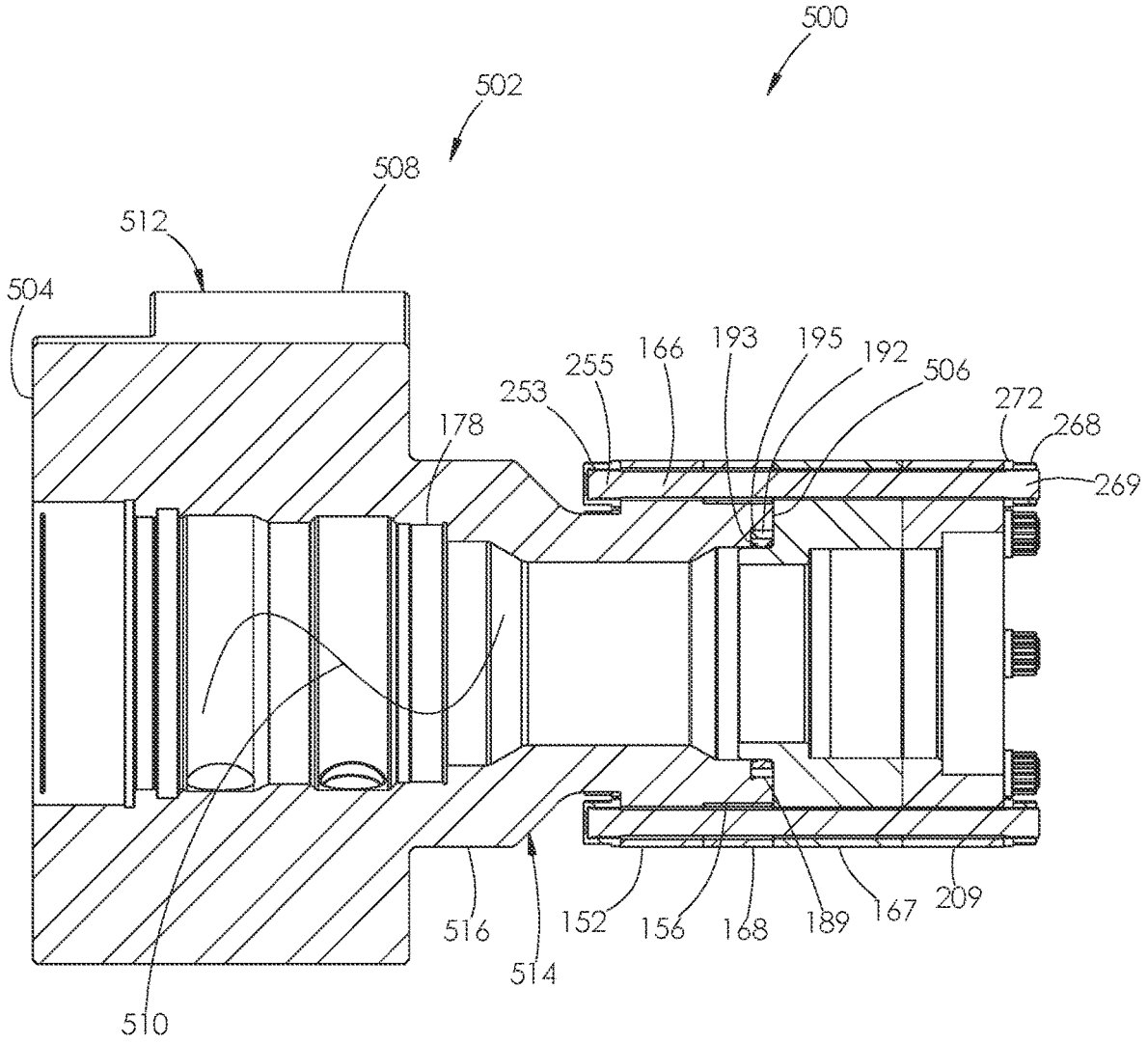
FIG. 88 is a cross-sectional view of the fluid end section shown in FIG. 87, taken along line Z-Z.
Figure 89:
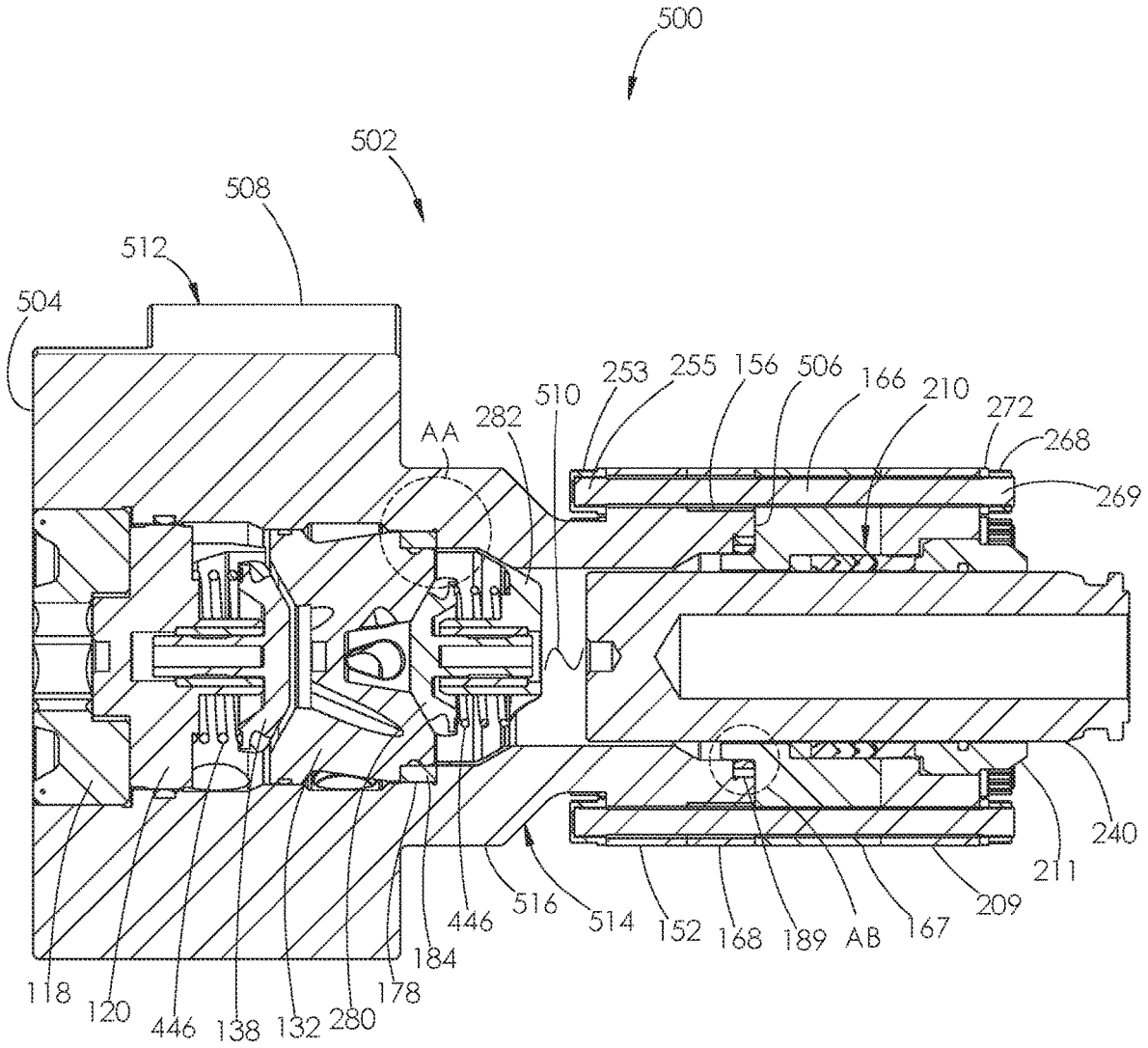
FIG. 89 is the cross-sectional view of the fluid end section shown in FIG. 88 with the inner components shown installed therein.
Figure 90:
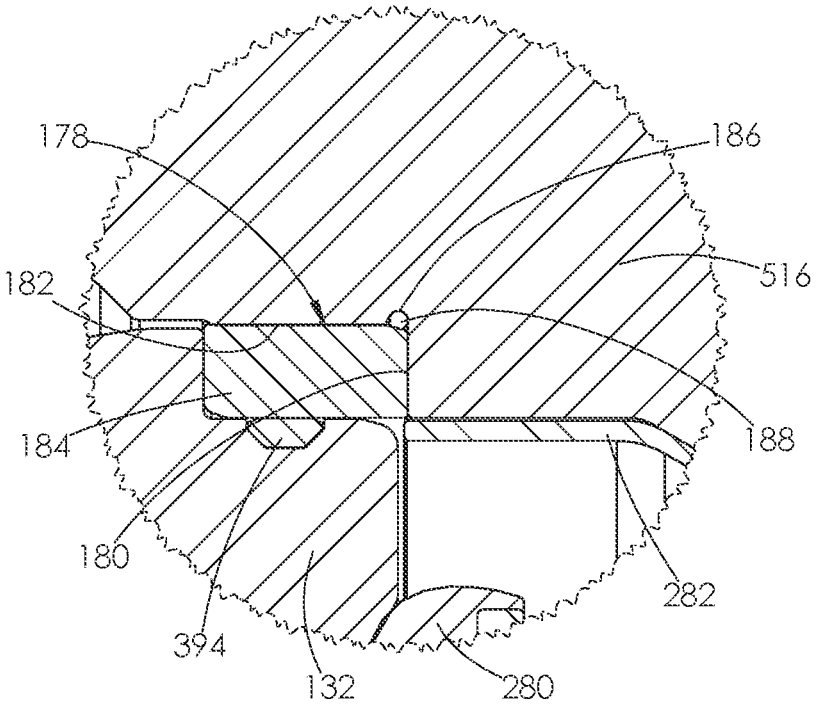
FIG. 90 is an enlarged view of area AA, shown in FIG. 89.

The housing 502 comprises opposed front and rear surfaces 504 and 506 joined by an outer intermediate surface 508, as shown in FIGS. 88 and 89. A horizontal bore 510 is formed within the housing 502 that interconnects the front and rear surfaces 504 and 506, as shown in FIGS. 88 and 89. The wall of the horizontal bore 510 is shaped identical to the wall of the horizontal bore 70 and is configured to receive the same inner components as the housing 60, as shown in FIG. 89. The only difference between the wall of the horizontal bore 70 and the horizontal bore 510 is that the first seal groove 186 is formed at the intersection of the base 180 and the side wall 182 of the first counterbore 178, instead of in the center of the second side wall 182, as shown in FIGS. 89 and 90.

Figure 86:
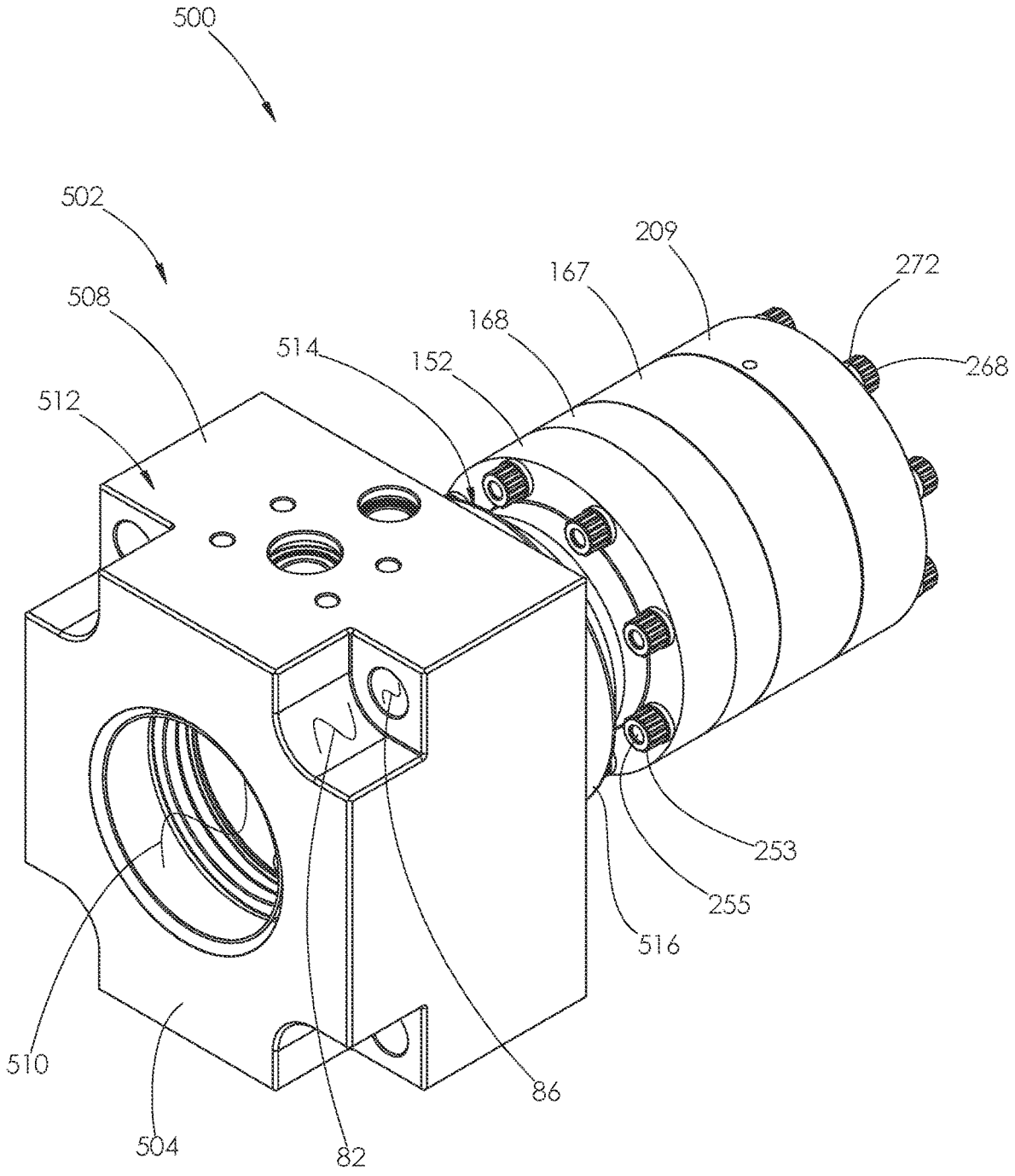
FIG. 86 is a front perspective view of another embodiment of a fluid end section without any inner components installed therein.
Figure 87:
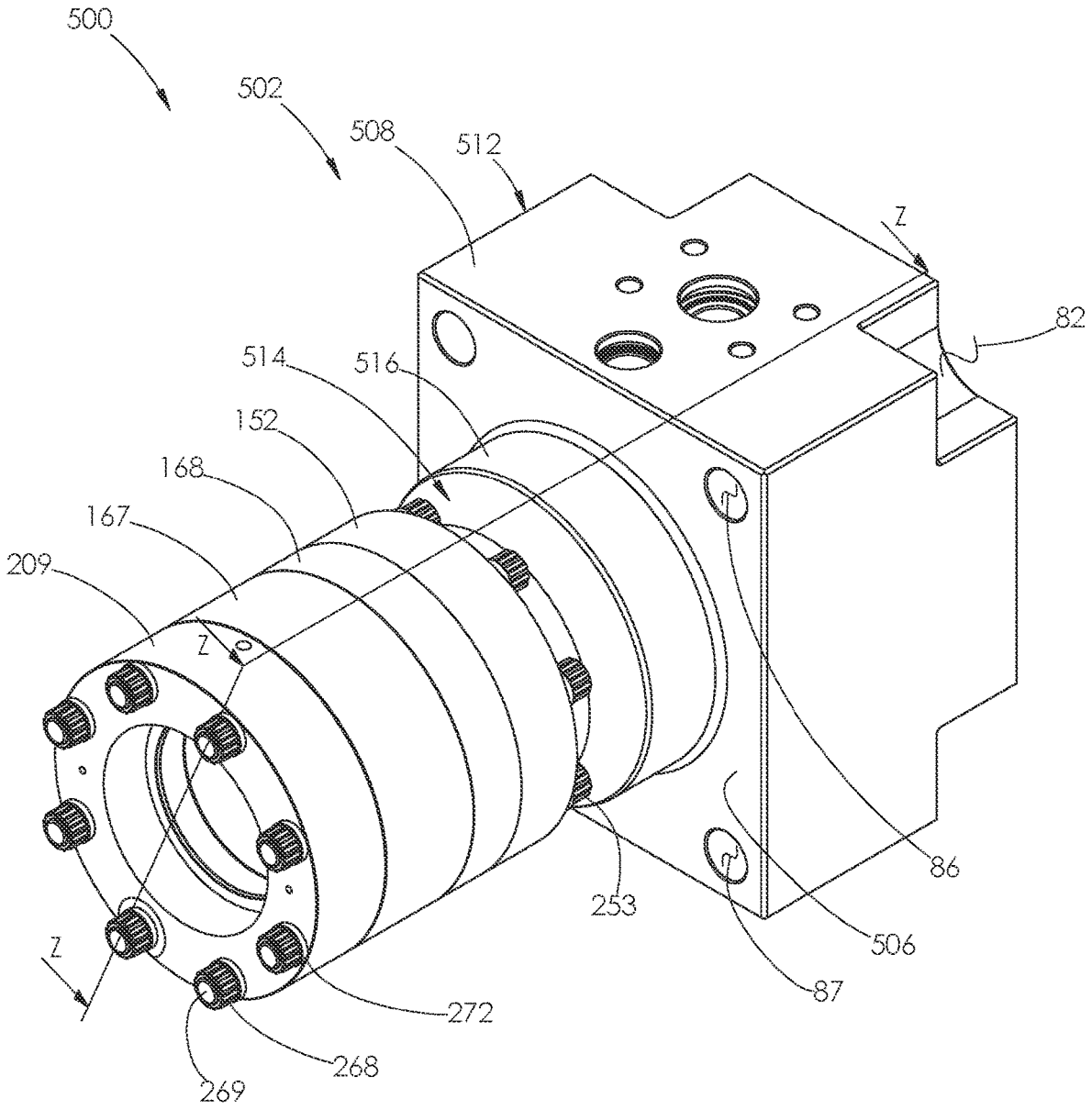
FIG. 87 is a rear perspective view of the fluid end section shown in FIG. 86.
Figure 93:
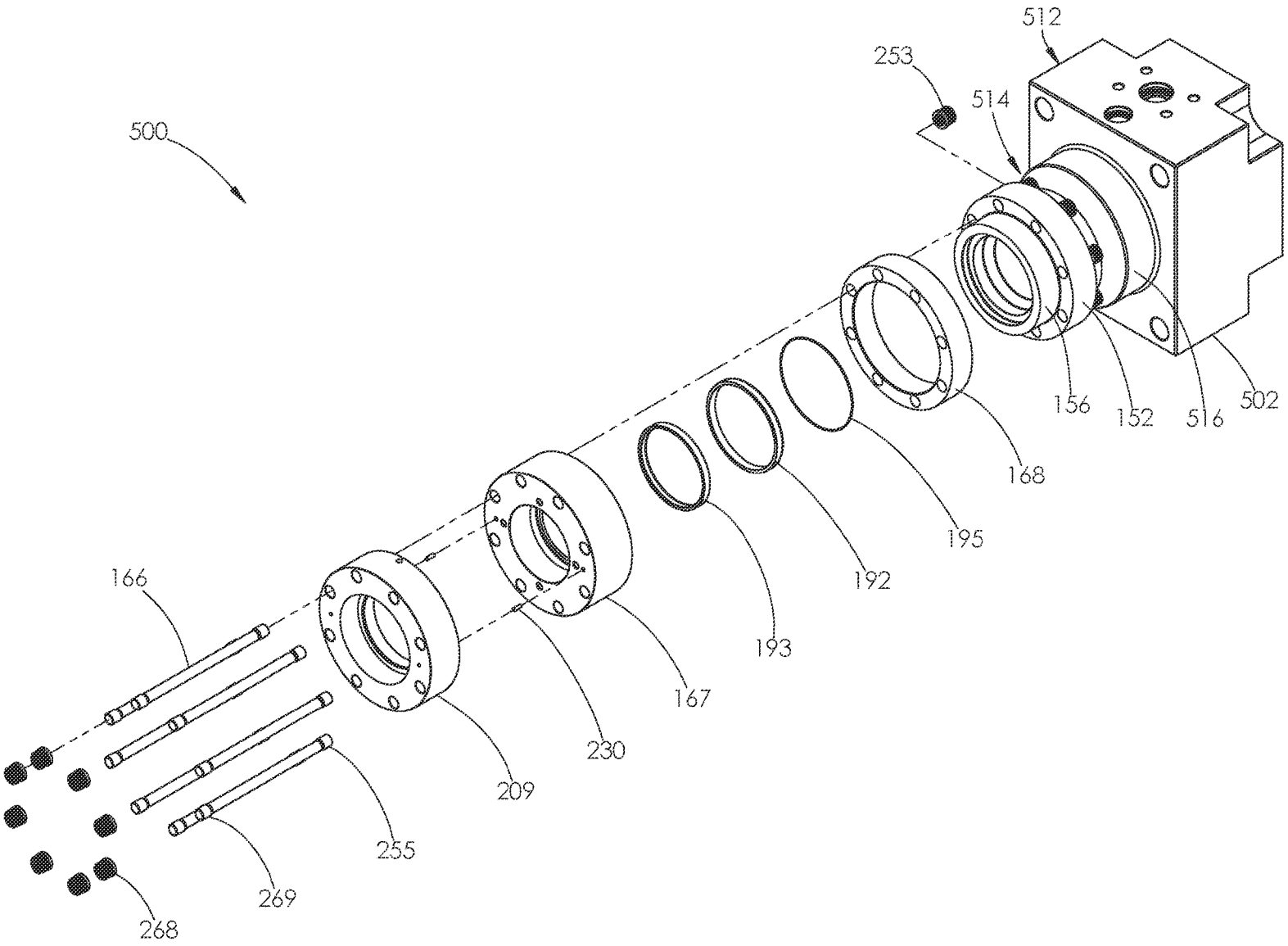
FIG. 93 is a rear perspective and exploded view of the fluid end section shown in FIG. 86.

The outer intermediate surface 508 of the housing 502 comprises a first section 512 integrally joined to a second section 514. The first section 512 is shaped identically to the first section 72 and comprises the plurality of passages 86 and corresponding notches 82 configured to receive a plurality of stay rods 54 in a one-to-one relationship, as shown in FIGS. 86 and 87. The second section 514 of the housing 502 comprises a cylindrical portion 516 that transitions into the rear mounting flange 152 and the rear projecting portion 156 of the housing 502, as shown in FIGS. 88 and 93. Because the housing 502 is a single piece, the housing 502 does not include the front spacer sleeve 76.

Figure 91:
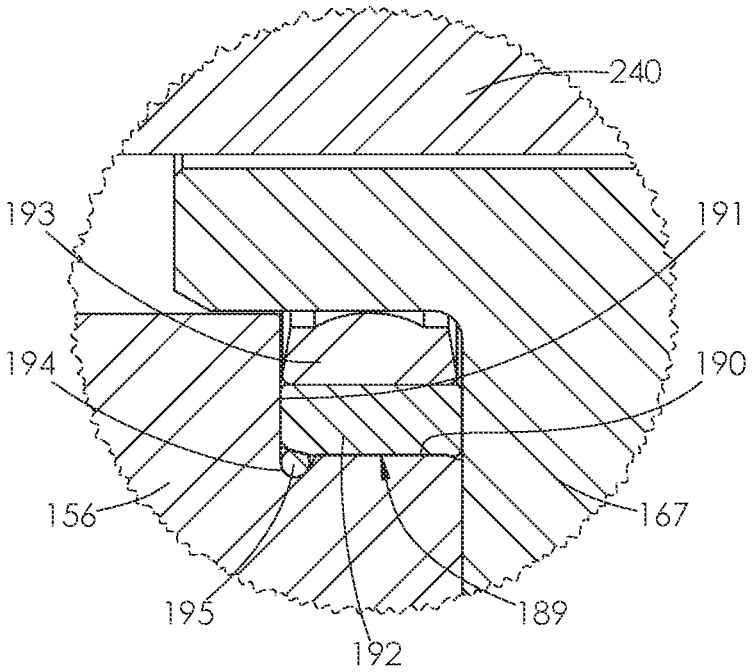
FIG. 91 is an enlarged view of area AB, shown in FIG. 89.
Figure 92:
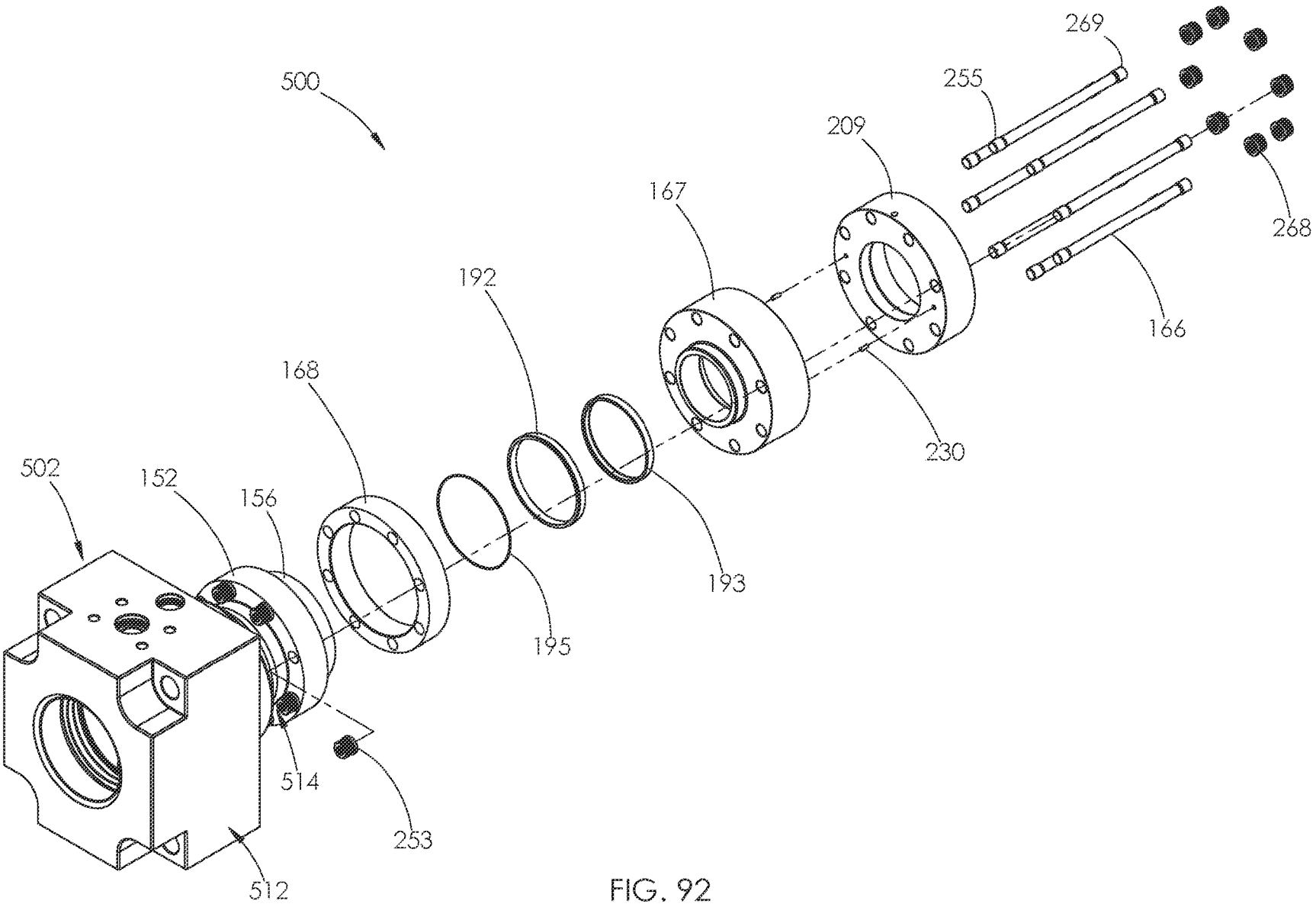
FIG. 92 is a front perspective and exploded view of the fluid end section shown in FIG. 86.

The cylindrical portion 516 of the second section 514 of the housing 502 is configured to house the same components as the second section 74 of the housing 60, shown in FIG. 89. The rear mounting flange 152 and rear portion 156 of the housing 502 are configured to mate with the rear spacer sleeve 168, the stuffing box 167, and the rear retainer 209 in the same manner as the fluid end section 56, as shown in FIGS. 88 and 89. The only difference between this area of the housing 502 and the housing 60 is that the second seal groove 194 is formed at the intersection of the base 191 and the side wall 190 of the second counterbore 189, instead of in the center of the second side wall 190, as shown in FIGS. 88 and 91.

Continuing with FIGS. 88 and 89, the second fasteners 166 extend through the rear mounting flange 152, rear spacer sleeve 168, stuffing box 167, and rear retainer 209 in the same manner as the fluid end section 56. The second fasteners 166 are secured on opposite ends 255 and 269 using the blind nuts 253 and the nuts 268 and corresponding washers 272. While not shown, a reaction washer 254 and seal 259 may also be installed on each of the blind nuts 253. The plunger packing 210, the packing nut 211, and the plunger 240 are installed within the fluid end section 500 in the same manner as the fluid end section 56. When the fluid end section 500 is assembled, the ends 255 of the second fasteners 166 and the blind nuts 253 are in a spaced-relationship with and face the cylindrical portion 516 of the second section 514 of the housing 502, as shown in FIGS. 86-89.

Turning to FIGS. 94-120, another embodiment of a fluid end section 600 is shown. The fluid end section 600 is similar to the fluid end section 56 but it includes another embodiment of a housing 602 and utilizes a retention plate 604 instead of the rear spacer sleeve 168. The inner components of the housing 602 are identical to the housing 502, shown in FIG. 89. However, the housing 602 also includes a third counterbore 606 configured to receive a wear ring 608 that surrounds a portion of the fluid routing plug 132, shown in FIGS. 96-99.

Figure 101:
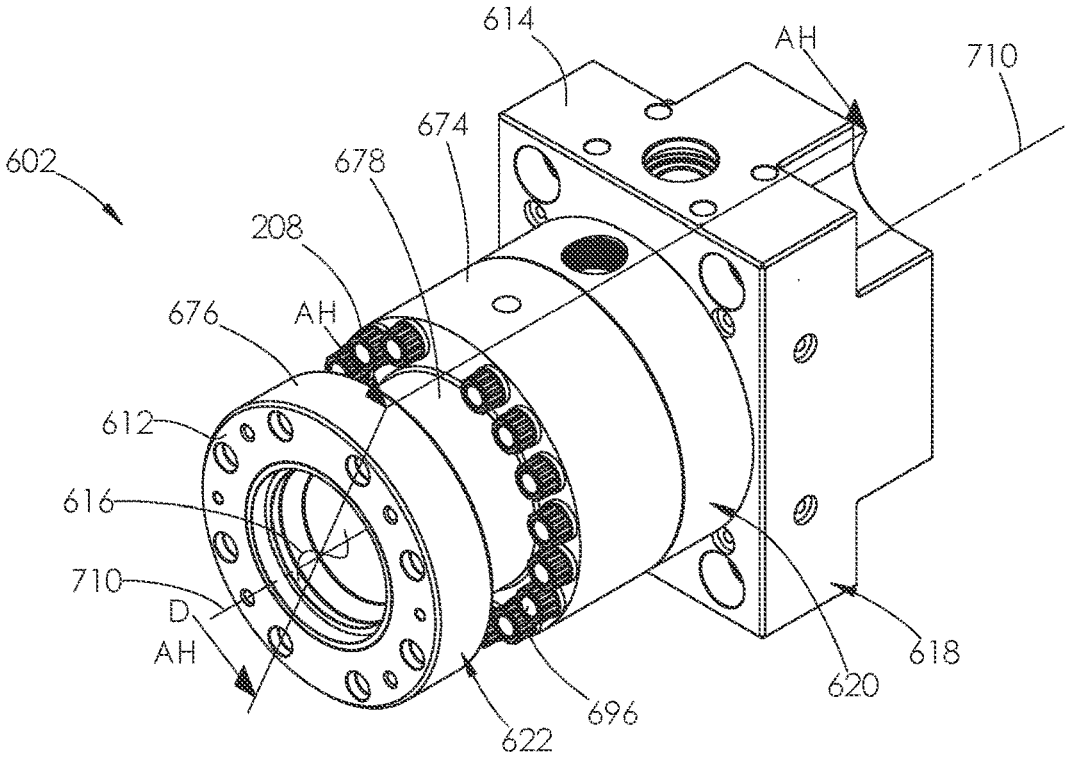
FIG. 101 is a rear perspective view of the housing shown in FIG. 100.
Figure 102:
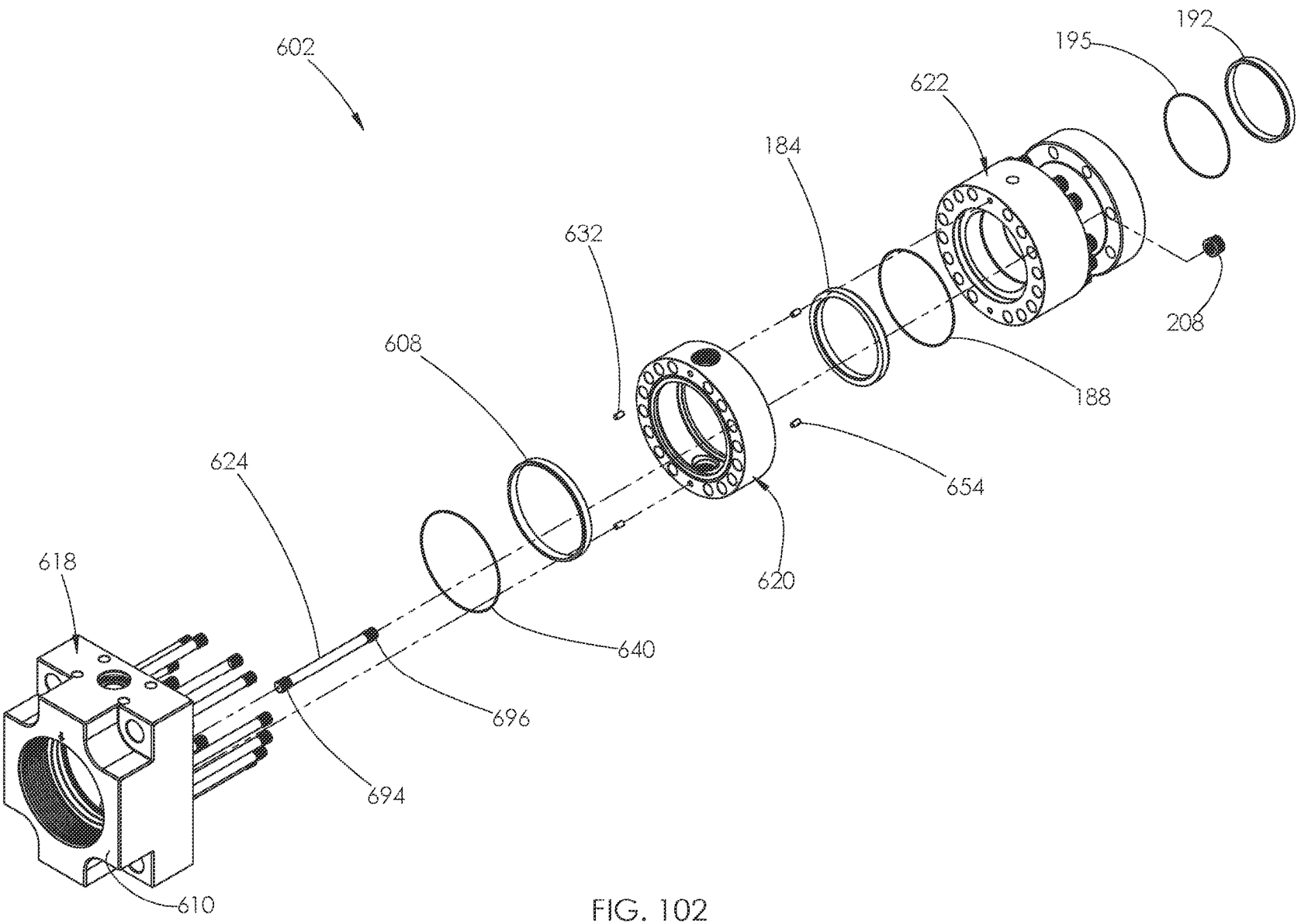
FIG. 102 is a front perspective and exploded view of the housing shown in FIG. 100.
Figure 103:
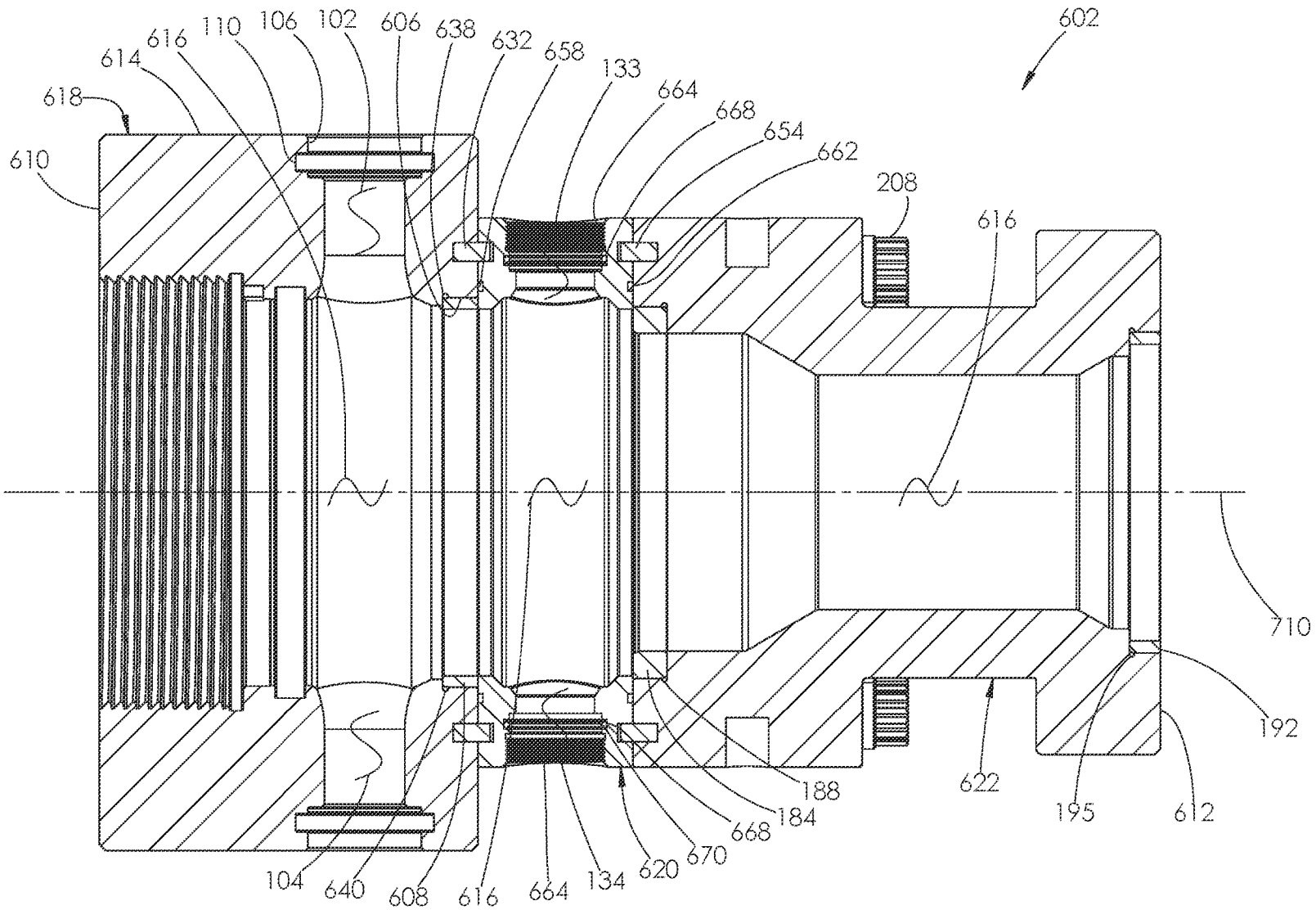
FIG. 103 is a cross-sectional view of the housing shown in FIG. 100, taken along line AG-AG.
Figure 104:
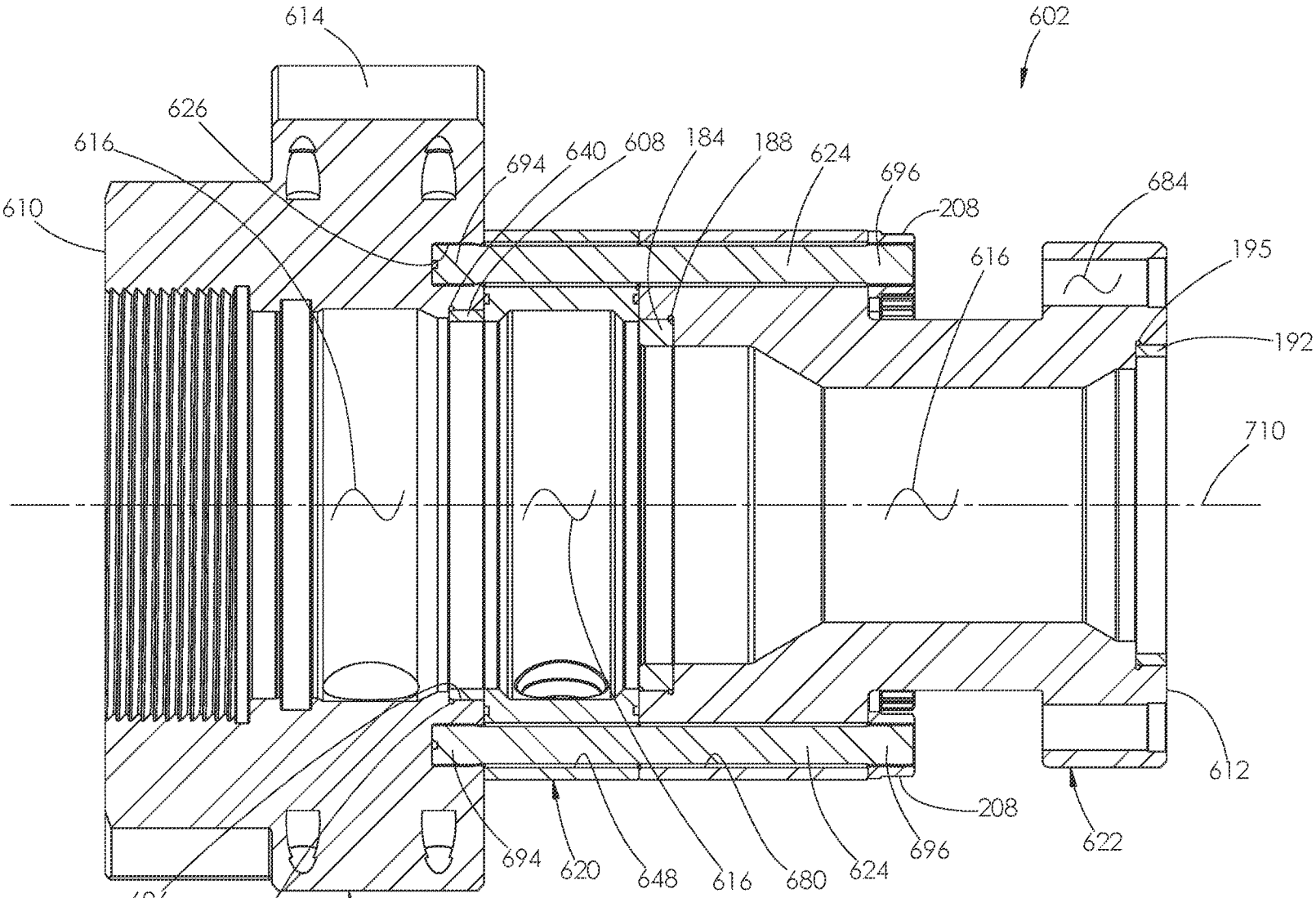
FIG. 104 is a cross-sectional view of the housing shown in FIG. 101, taken along line AH-AH.

With reference to FIGS. 100-104, the housing 602 comprises opposed front and rear surfaces 610 and 612 joined by an outer intermediate surface 614. A horizontal bore 616 is formed within the housing 602 and interconnects the front and rear surfaces 610 and 612, as shown in FIGS. 103 and 104. The housing 602 is of multi-piece construction. In contrast to the housing 60, the housing 602 comprises three sections instead of two sections. However, the housing 602 does not utilize the front spacer sleeve 76.

The housing 602 comprises a first section 618 joined to a second section 620 and a third section 622 by a plurality of first fasteners 624, as shown in FIGS. 102 and 104. Like the housing 60, by making the housing 602 out of multiple sections 618, 620, and 622, any one of the sections may be removed and replaced with a new section without replacing the rest of the housing 602. The first fasteners 624 are identical to the first fasteners 78 but are longer to accommodate the three sections of the housing 602, instead of the two included in the housing 60, as shown in FIG. 104.

Turning to FIGS. 105-109, the first section 618 is positioned at the front end of the housing 602 and includes the front surface 610. During operation, fluid within the first section 618 remains at relatively the same high pressure. Thus, the first section 618 is considered the static or constant high-pressure section of the housing 602. The first section 618 is generally identical to the first section 72 of the housing 60, but the first section 618 is shortened so that it does not include the upper and lower suction bores 133 and 134. Likewise, the first section 618 only receives a portion of the discharge surface 334 of the fluid routing plug 132, as shown in FIGS. 96-99.

Figure 105:
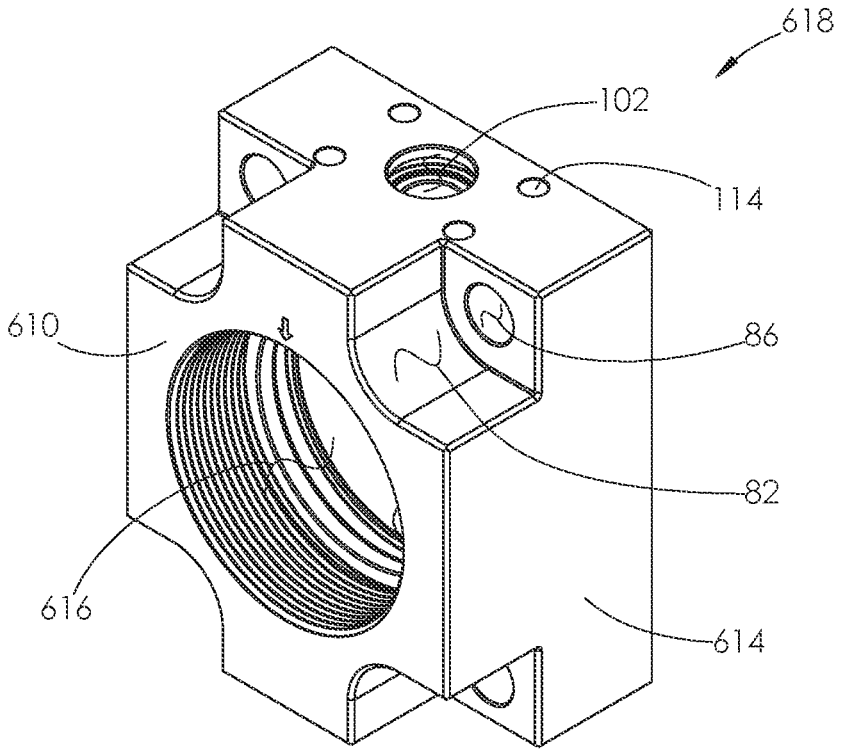
FIG. 105 is a front perspective view of the first section of the housing shown in FIG. 100.
Figure 106:
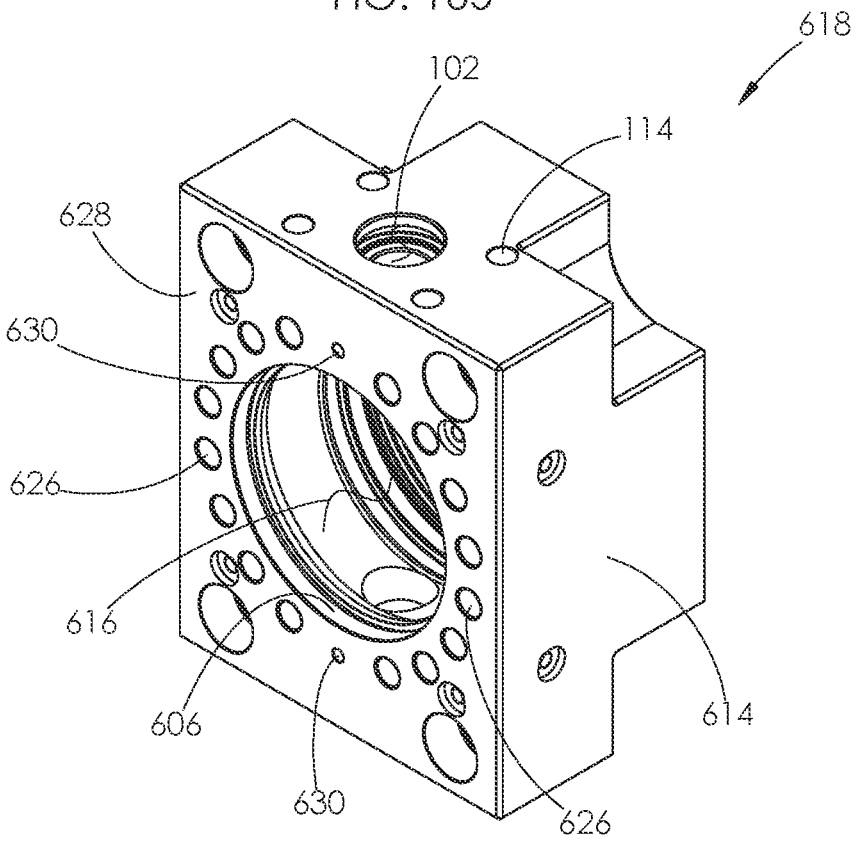
FIG. 106 is a rear perspective view of the first section of the housing shown in FIG. 105.
Figure 107:
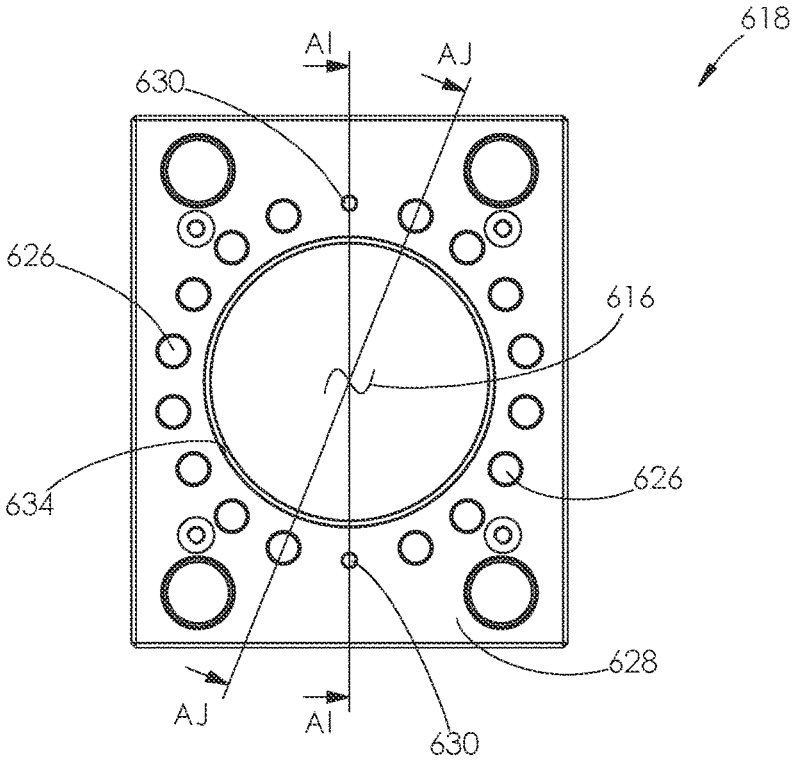
FIG. 107 is a rear elevational view of the first section of the housing shown in FIG. 105.

Like the first section 72, the first section 618 comprises the plurality of passages 86 and corresponding notches 82 configures to receive a corresponding one of the stay rods 54, as shown in FIGS. 105 and 106. The first section 618 further comprises a the rear surface 628 with a plurality of threaded openings 626. Like the threaded openings 96 formed in the first section 72, the threaded openings 626 are configured to receive the plurality of first fasteners 624 in a one-to-one relationship, as shown in FIG. 104. Also formed within the rear surface 628 of the first section 618 are a plurality of dowel openings 630 configured to receive first alignment dowels 632 used to align the second section 620 on the first section 618 of the housing 602, as shown in FIG. 103.

Figure 108:
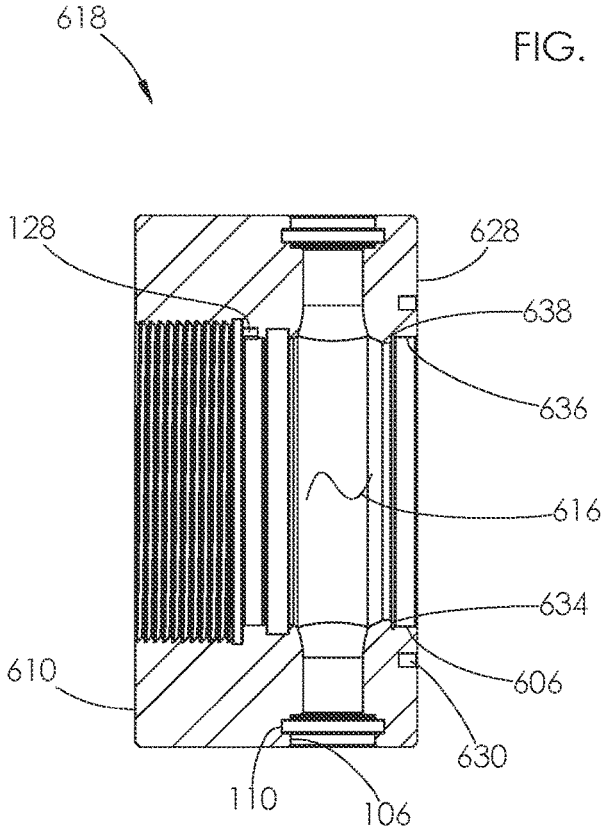
FIG. 108 is a cross-sectional view of the housing shown in FIG. 107, taken along line AI-AI.
Figure 109:
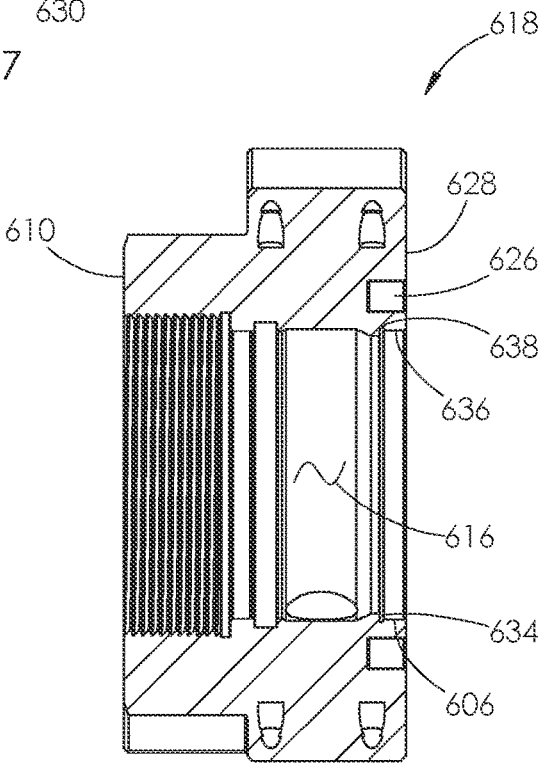
FIG. 109 is a cross-sectional view of the housing shown in FIG. 107, taken along line AJ-AJ.

The wall the horizontal bore 616 of the first section 618 is the same as the first section 72 up to adjacent the rear surface 628 of the first section 618. The third counterbore 606 is formed in the wall of the horizontal bore 616 and opens on the rear surface 628 of the first section 618, as shown in FIGS. 108 and 109. The third counterbore 606 is sized to receive the wear ring 608 and comprises a base 634 joined to a side wall 636, as shown in FIGS. 108 and 109. The side wall 636 may be tapered like the second counterbore 189, shown in FIG. 69. A third seal groove 638 is also formed at the intersection of the side wall 636 and the base 634 and is sized to receive an annular seal 640. Like the seal 195, the seal 640 prevents fluid from leaking around the wear ring 608 during operation. In alternative embodiments, the third seal groove 638 may be formed in the center of the side wall 636, as shown in FIG. 69.

When the wear ring 608 is installed within the third counterbore 606, the wear ring 608 is positioned at the same location as the sealing surface 142 formed in the first section 72 of the housing 60 and shown in FIG. 11. The wear ring 608 engages the first seal 144 installed within the fluid routing plug 132, as shown in FIGS. 96-99. During operation, the seal 144 wears against the wear ring 608. If the wear ring 608 starts to erode, the wear ring 608 can be removed and replaced with a new wear ring 608, thereby maintaining the integrity of the first section 618 of the housing 602. Like the wear ring 192, the wear ring 608 is made of a harder and more wear resistant material than that of the housing 602. The wear ring 608 may be installed within the first section 618 of the housing 602 prior to assembling the housing 602.

Figure 96:
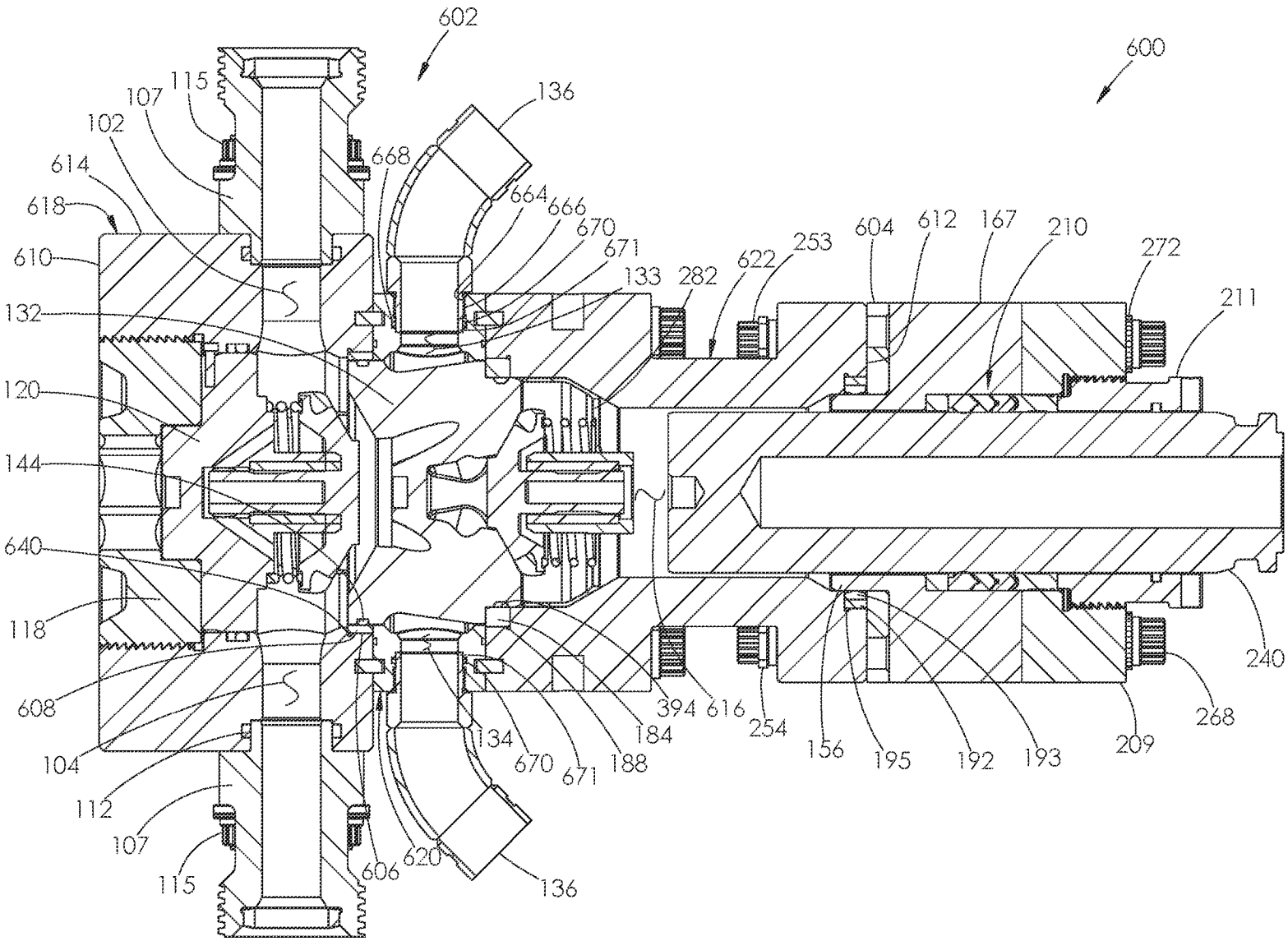
FIG. 96 is a cross-sectional view of the fluid end section shown in FIG. 94, taken along line AC-AC.

Continuing with FIG. 103, the upper and lower discharge bores 102 and 104 are formed within the first section 618 of the housing 602. Each discharge bore 102 and 104 includes the counterbore 106 and groove 110 also formed in the first section 72 of the housing 60. A discharge fitting 107 is shown installed within each discharge bore 102 and 104, as shown in FIG. 96. Each discharge fitting 107 is attached to the first section 618 by installing a plurality of threaded fasteners 115 within the threaded openings 114 formed in the outer intermediate surface 614, as shown in FIGS. 96, 105, and 106. Each discharge fitting 107 interconnects a discharge conduit 105 and the upper or lower discharge manifold 109 or 117, as shown in FIG. 3.

With reference to FIGS. 110-113, the second section 620 of the housing 602 is configured to be positioned between the first and third sections 618 and 622 and has a cylindrical cross-sectional shape. During operation, fluid pressure within the second section 620 remains at relatively the same pressure. The pressure is lower than that within the first section 618. Thus, the second section 620 may be referred to as the static or constant low-pressure section of the housing 602. The second section 620 comprises opposed front and rear surfaces 644 and 646 joined by a portion of the outer intermediate surface 614 and a portion of the horizontal bore 616.

Figure 113:
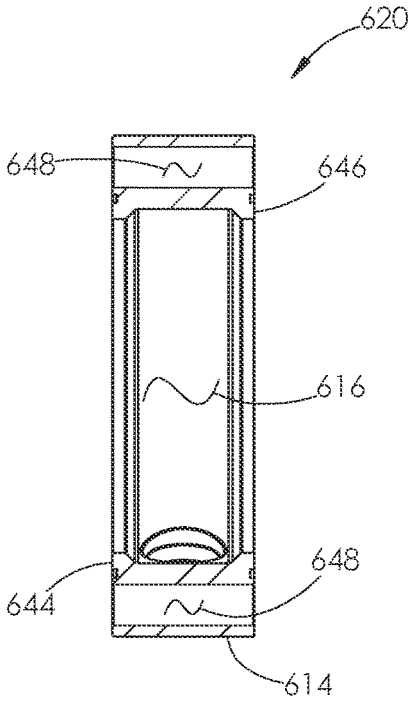
FIG. 113 is a cross-sectional view of the second section of the housing shown in FIG. 111, taken along line AL-AL.
Figure 114:
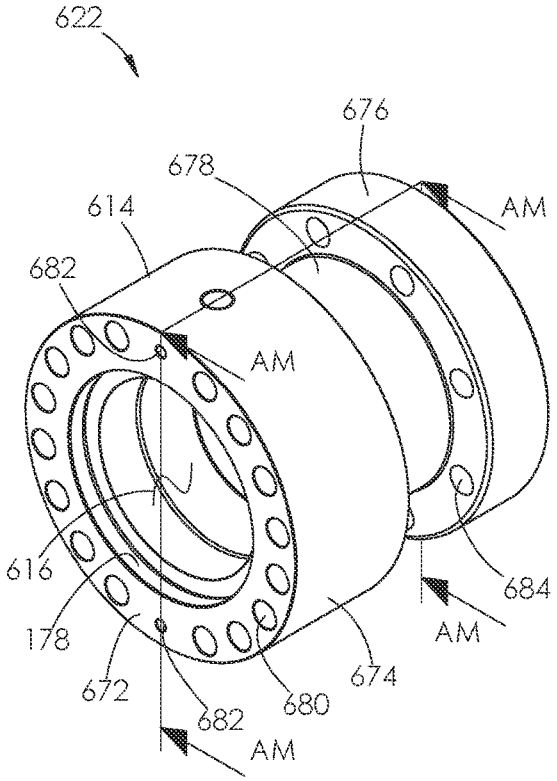
FIG. 114 is a front perspective view of the third section of the housing shown in FIG. 100.
Figure 115:
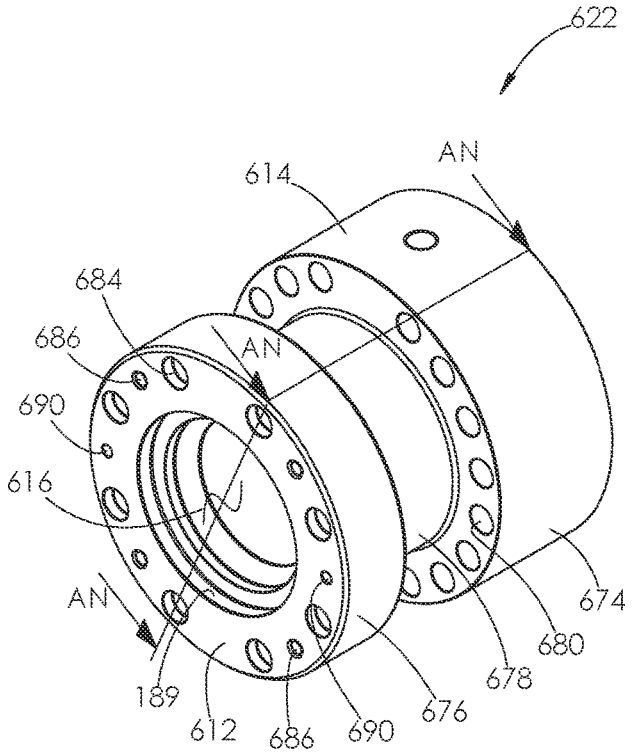
FIG. 115 is a rear perspective view of the third section of the housing shown in FIG. 114.

Formed within the second section 620 are a plurality of passages 648. The passages 648 surround the horizontal bore 616 and interconnect the front and rear surfaces 644 and 646, as shown in FIG. 113. Each passage 648 is configured to receive a corresponding one of the first fasteners 624 used to secure the sections 618, 620, and 622 of the housing 602 together, as shown in FIG. 104.

Figure 112:
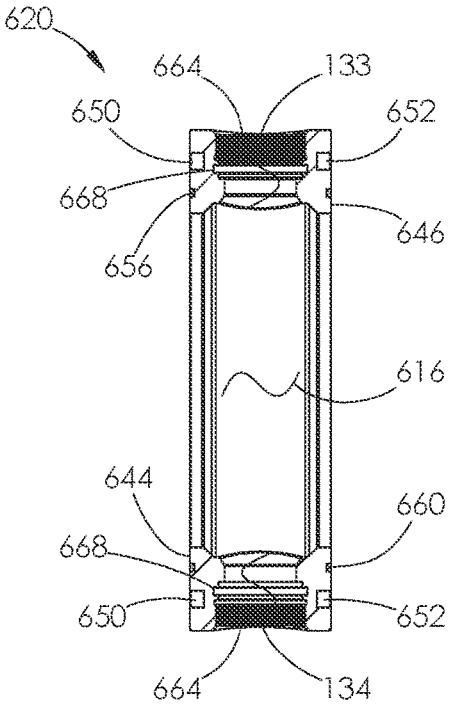
FIG. 112 is a cross-sectional view of the second section of the housing shown in FIG. 110, taken along line AK-AK.

Also formed within the second section 620 are a plurality of dowel openings 650, as shown in FIG. 112. The dowel openings 650 are formed in the front surface 644 of the second section 620. The dowel openings 650 align with the dowel openings 630 formed in the rear surface 628 of the first section 618 and are configured to receive a portion of the first alignment dowels 632, as shown in FIG. 103. Likewise, a plurality of dowel openings 652 are formed in the rear surface 646 of the second section 620, as shown in FIG. 112. The dowel openings 652 are configured to receive a portion of second alignment dowels 654, as shown in FIG. 103. The second alignment dowels 654 are configured to align the second section 620 and the third section 622 during assembly.

Figure 110:
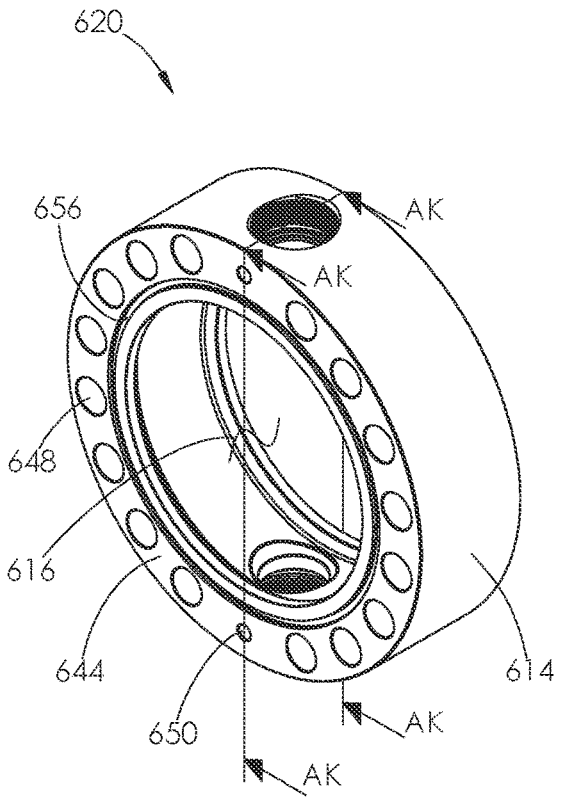
FIG. 110 is a front perspective view of the second section of the housing shown in FIG. 100.
Figure 111:
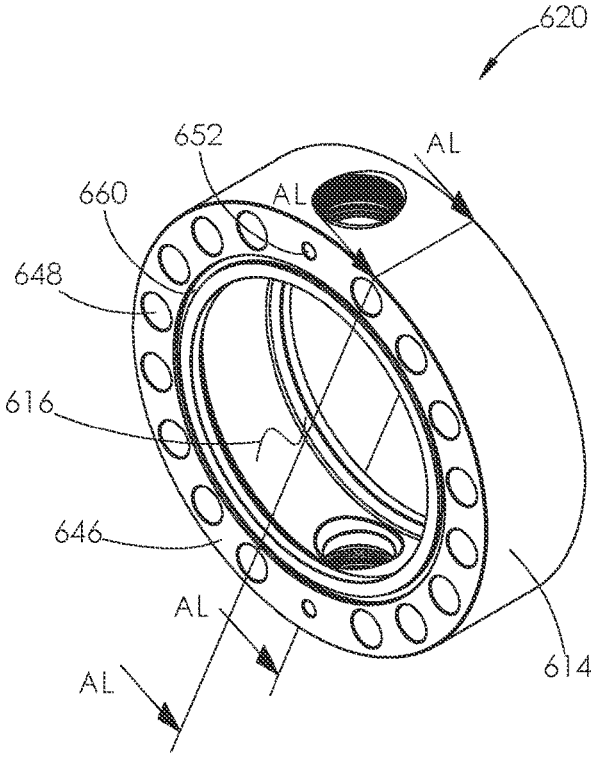
FIG. 111 is a rear perspective view of the second section of the housing shown in FIG. 110.

A first annular groove 656 is also formed in the front surface 644 of the second section 620 such that it surrounds the horizontal bore 616, as shown in FIG. 110. The first groove 656 is positioned between the horizontal bore 616 and the plurality of passages 648 and is configured to receive a first seal 658, as shown in FIG. 103. Likewise, a second annular groove 660 is formed in the rear surface 646 of the second section 620 and positioned between the horizontal bore 616 and the plurality of passages 648, as shown in FIG. 111. The second groove 660 is configured to receive a second seal 662, as shown in FIG. 103. The seals 658 and 662 shown in the figures are O-rings. In alternative embodiments, other types of seals known in the art may be used. During operation, the seals 658 and 662 prevent fluid from leaking between the first and second sections 618 and 620 and between the second and third sections 620 and 622.

Continuing with FIG. 103, the upper and lower suction bores 133 and 134 are formed within the second section 620 of the housing 602. The suction bores 133 and 134 are each configured to receive one of the suction conduits 136, as shown in FIG. 96. Internal threads 664 are formed in a portion of each wall of each suction bore 133 and 134. The internal threads 664 are configured to mate with external threads 666 formed on the outer surface of each suction conduit 136. Internal of the internal threads 664, a seal groove 668 is formed in each bore 133 and 134 for receiving a seal 670 sized to surround an extended portion 671 of each suction conduit 136, as shown in FIG. 96. During operation, the seal 670 prevents fluid from leaking between the suction bores 133 or 134 and the suction conduits 136.

The wall of the horizontal bore 616 within the second section 620 is configured to receive a majority of the fluid routing plug 132, as shown in FIGS. 96-99. A small amount of clearance may exist between the wall of the horizontal bore 616 of the second section 620 and an outer surface of the fluid routing plug 132.

Turning to FIGS. 114-117, the third section 622 of the housing 602 is positioned at the rear end of the housing 602 and includes the rear surface 612. The third section 622 has a generally cylindrical cross-sectional shape. Fluid pressure within the third section 622 varies during operation. Thus, the third section 622 may be referred to as the dynamic or variable pressure section of the housing 602. The third section 622 is similar in size and shape to the second section 514 of the housing 502, shown in FIG. 88.

The third section 622 comprises a front surface 672 joined to the rear surface 612 of the housing 602 by a portion of the outer intermediate surface 614 and a portion of the horizontal bore 616. The outer intermediate surface 614 of the third section 622 comprises a front mounting flange 674 and a rear mounting flange 676. The mounting flanges 674 and 676 are separated by a medial portion 678 of the third section 622. The mounting flanges 674 and 676 have a greater outer diameter than the medial portion 678. The front mounting flange 674 further has a greater outer diameter than the rear mounting flange 676. In contrast to the second section 620 of the housing 602, the front and rear mounting flanges 674 and 676 formed in the third section 622 of the housing 602 are not spaced from the front and rear surfaces 672 and 612 of the third section 622. Rather, each mounting flange 674 and 676 includes the corresponding front and rear surface 672 and 612 of the third section 622.

The front mounting flange 674 is wider than that of the front mounting flange 150 formed in the second section 74 of the housing 60, but like the front mounting flange 150, the front mounting flange 674 is configured to receive the first fasteners 624. A plurality of passages 680 are formed in the front mounting flange 674 that are positioned to align with the passages 648 formed in the second section 620, as shown in FIG. 104. A plurality of dowel openings 682 are also formed in the front surface 672 of the third section 622 for receiving the second alignment dowels 654, as shown in FIG. 103.

Figure 97:
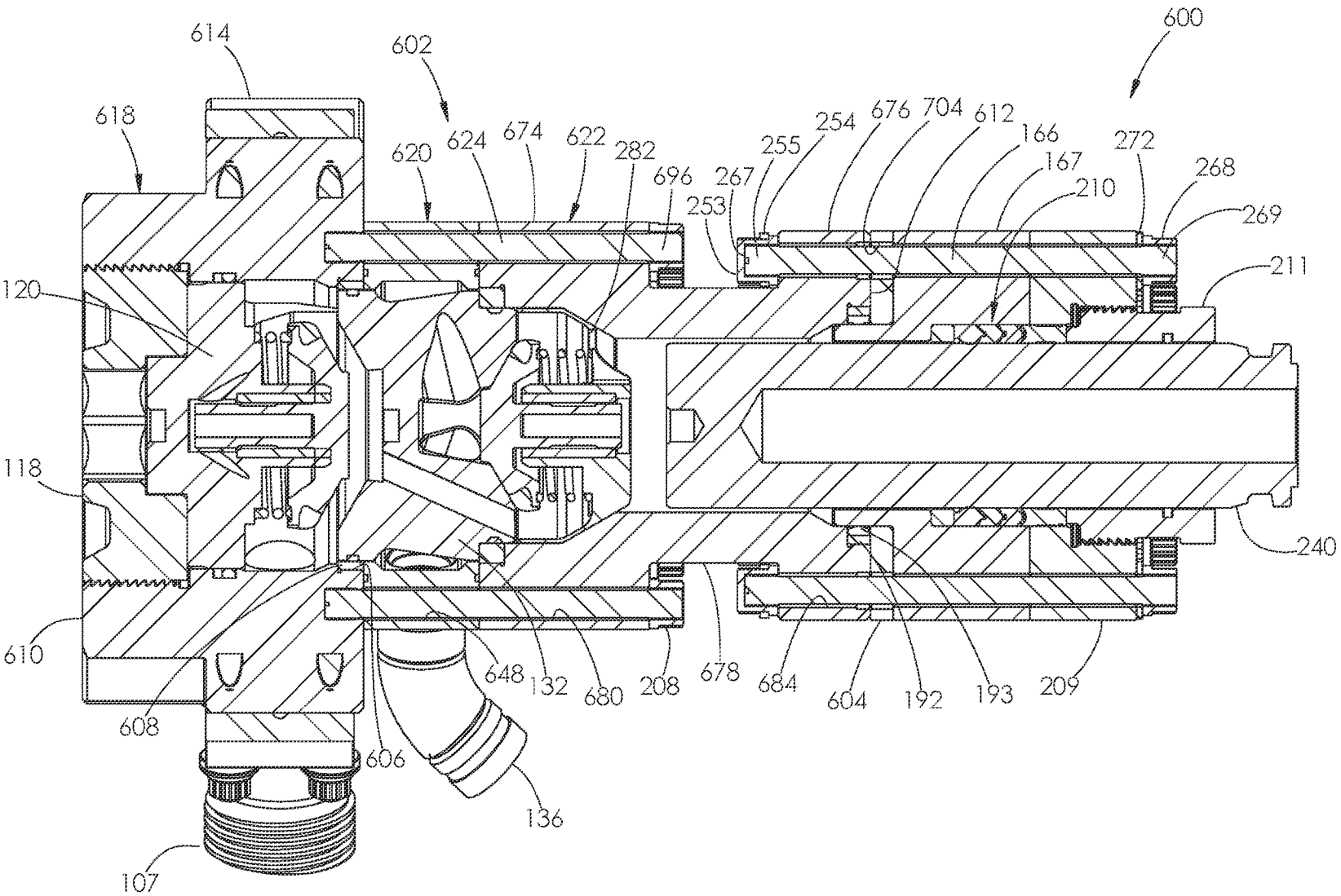
FIG. 97 is a cross-sectional view of the fluid end section shown in FIG. 95, taken along line AD-AD.
Figure 98:
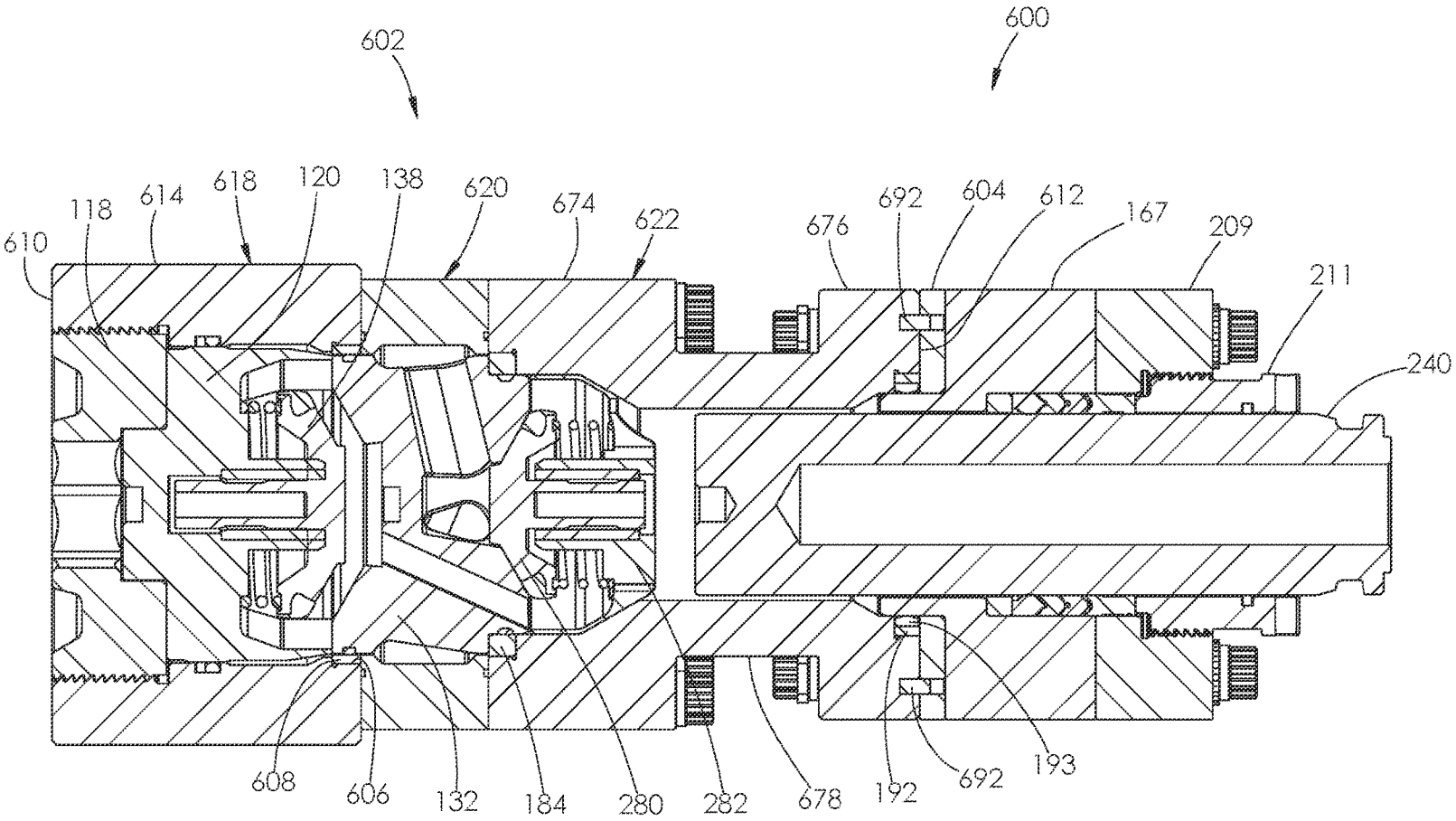
FIG. 98 is a cross-sectional view of the fluid end section shown in FIG. 94, taken along line AE-AE.
Figure 69:
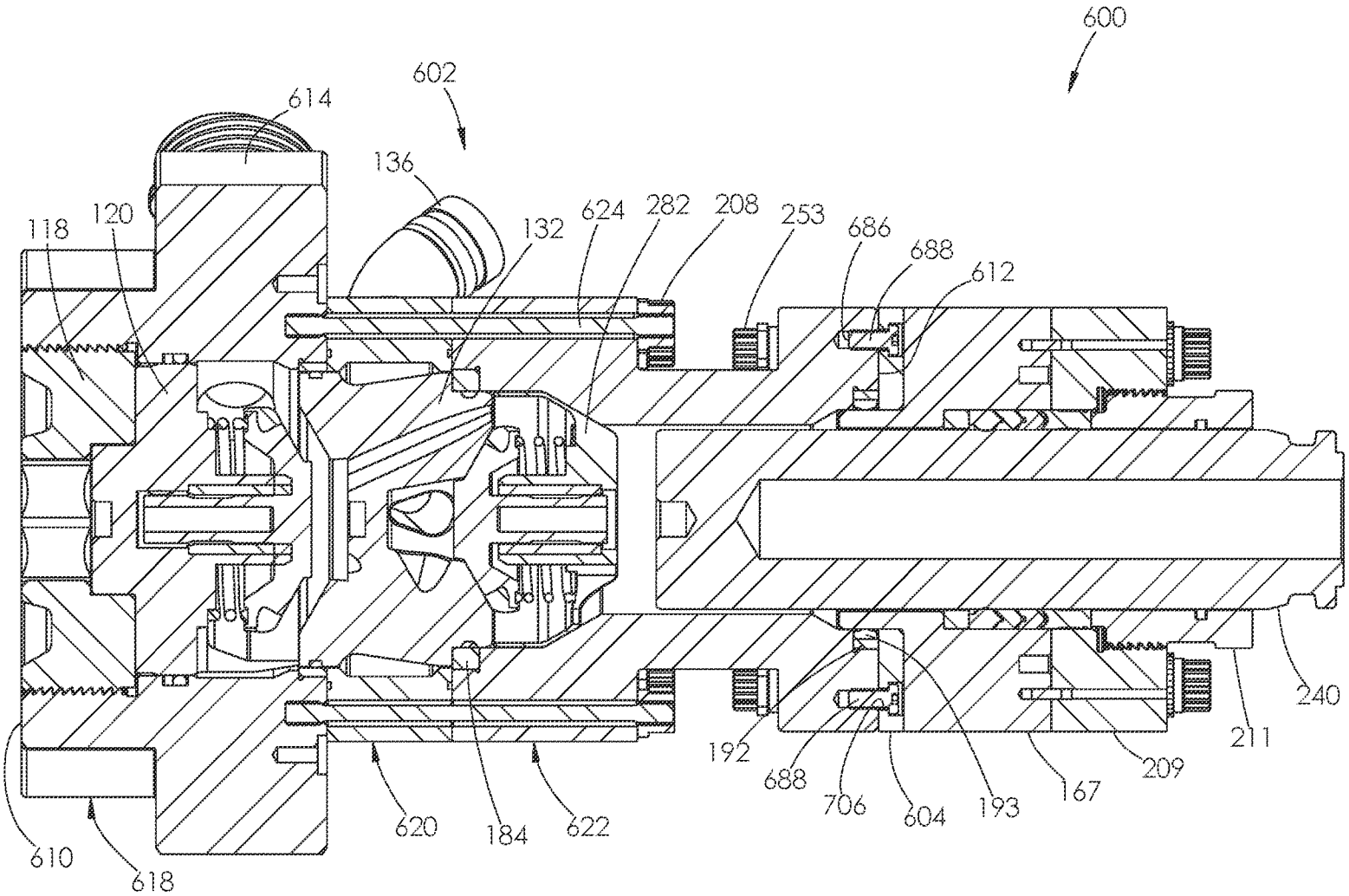

Like the rear mounting flange 152, the rear mounting flange 676 comprises a plurality of passages 684 configured to receive the second fasteners 166, as shown in FIG. 97. Also like the rear mounting flange 152, the rear mounting flange 676 comprises a plurality of threaded openings 686 configured to receive a corresponding third fastener 688, as shown in FIG. 99. The rear mounting flange 676 further comprises a plurality of dowel openings 690 configured to receive third alignment dowels 692, as shown in FIG. 98.

Figure 116:
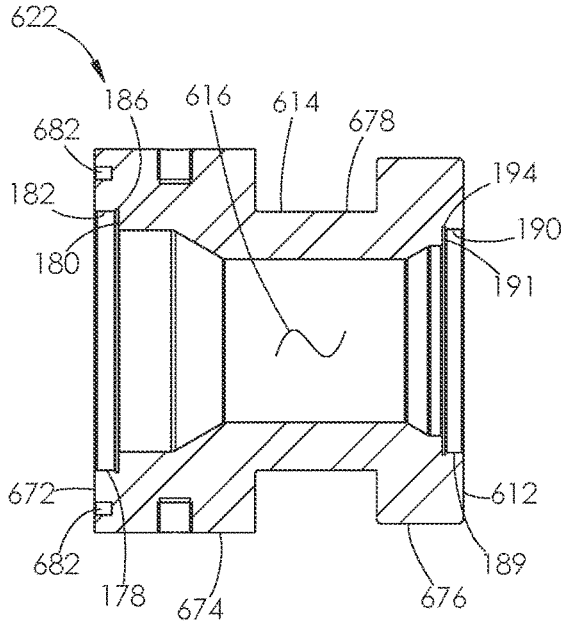
FIG. 116 is a cross-sectional view of the third section of the housing shown in FIG. 114, taken along line AM-AM.
Figure 117:
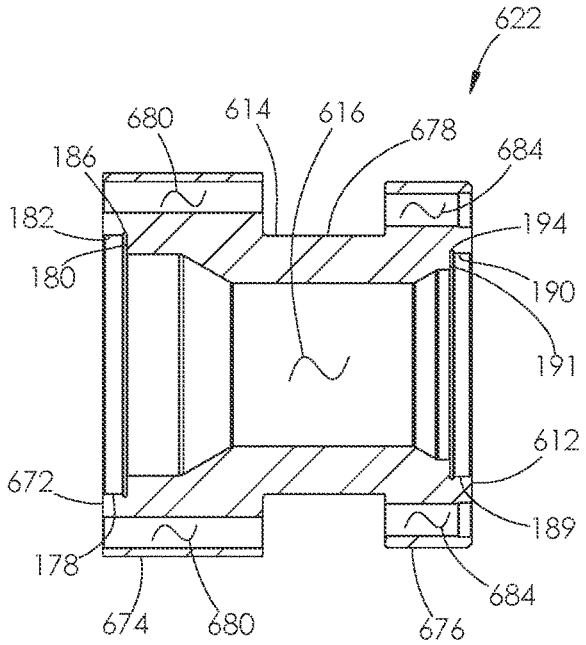
FIG. 117 is a cross-sectional view of the third section of the housing shown in FIG. 115, taken along line AN-AN.

Continuing with FIGS. 116 and 117, the third section 622 of the housing 602 further comprises the first counterbore 178 and the first seal groove 186, like those shown in FIG. 90. Likewise, the third section 622 comprises the second counterbore 189 and the second seal groove 194 like those shown in FIG. 91. In alternative embodiments, the first and second seal grooves 186 and 194 may be positioned in the center of the side walls 182 and 190 of the corresponding counterbores 178 and 189, like those shown in FIGS. 16 and 17. The third section 622 is configured to receive the same components as the second section 74 of the housing 60, as shown in FIGS. 11-13 and 97.

With reference to FIGS. 102-104, the housing 602 is assembled by threading a first end 694 of each of the first fasteners 624 into a corresponding one of the threaded openings 626 formed in the first section 618. Once installed therein, the first fasteners 624 project from the rear surface 628 of the first section 618. The second and third sections 620 and 622 may then be slid onto the fasteners 624 projecting from the first section 618 using the corresponding passages 648 and 680. The first and second alignment dowels 632 and 654 help to further align the sections 618, 620, and 622 together during assembly.

Figure 100:
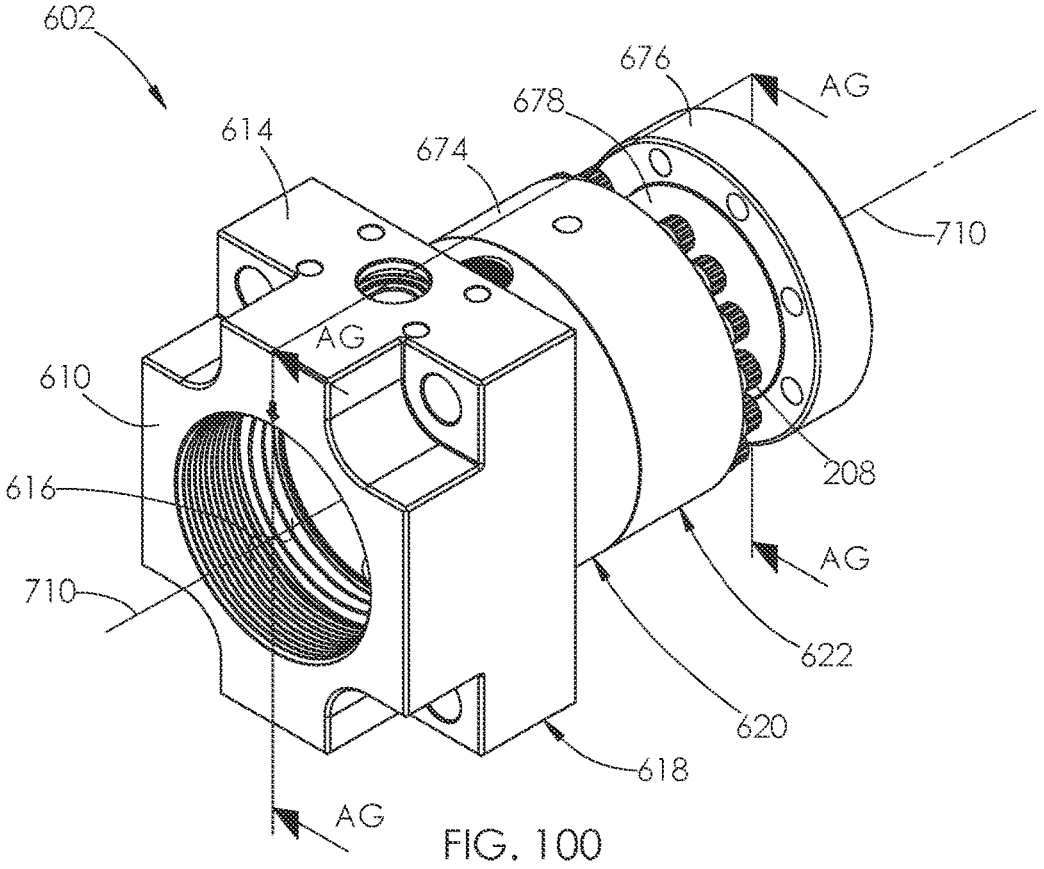
FIG. 100 is a front perspective view of the housing used with the fluid end section shown in FIG. 94.

When the second and third sections 620 and 622 are installed on the fasteners 624, a second end 696 projects from the front mounting flange 674 of the third section 622 and is positioned over the medial portion 678 of the third section 622, as shown in FIGS. 100 and 101. A nut 208 is installed on the second end 696 and torqued against the front mounting flange 674, tightly securing the sections 618, 620, and 622 together. Prior to assembling the housing 602, the wear ring 192, the seal 193, the seal 195, the annular insert 184, and the seal 188 are installed within the corresponding counterbores 178 and 189.

Turning back to FIGS. 94 and 95, the stuffing box 167 and the rear retainer 209 are attached to the rear surface 612 of the housing 602. In contrast to the fluid end sections 56 and 500, the fluid end section 600 does not utilize a rear spacer sleeve 168. Instead, the retention plate 604 is positioned between the rear surface 612 of the housing 602 and a portion of the stuffing box 167, as shown in FIGS. 96-99.

Figure 118:
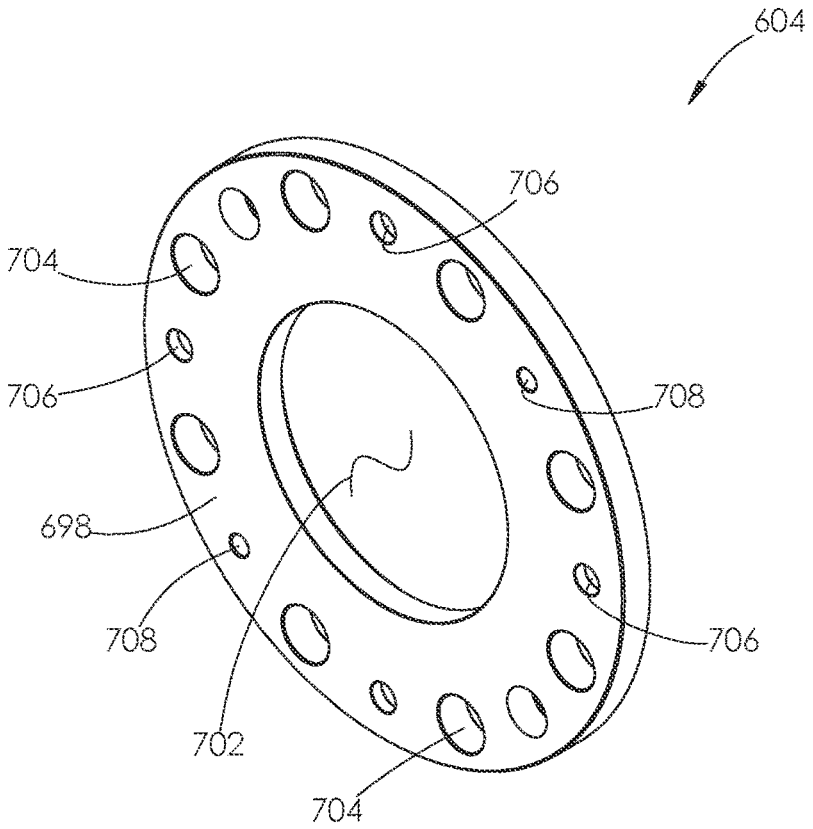
FIG. 118 is a front perspective view of the retention plate used with the fluid end section shown in FIG. 94.
Figure 119:
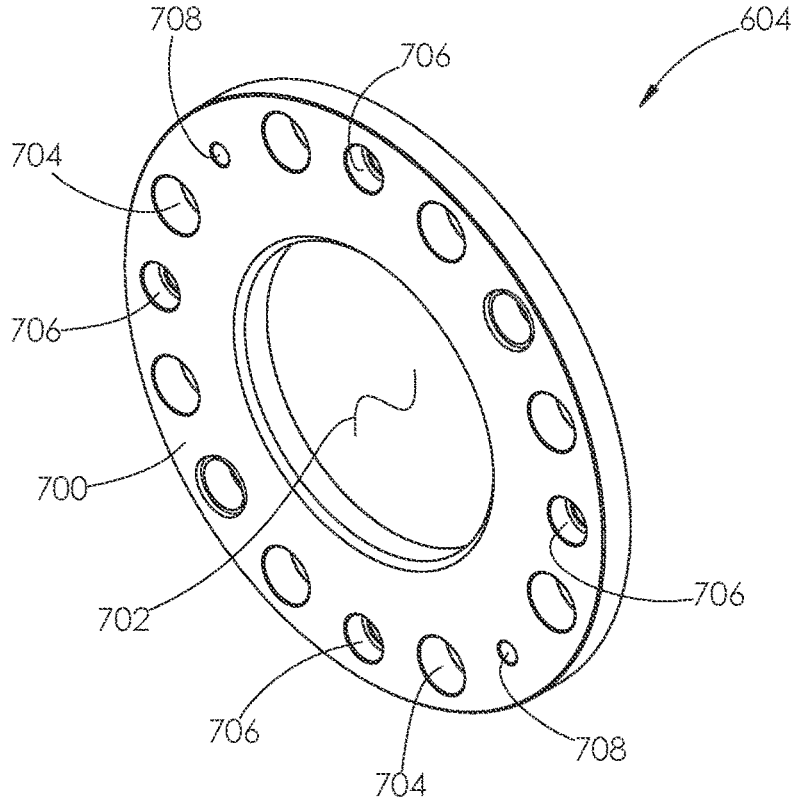
Figure 120:
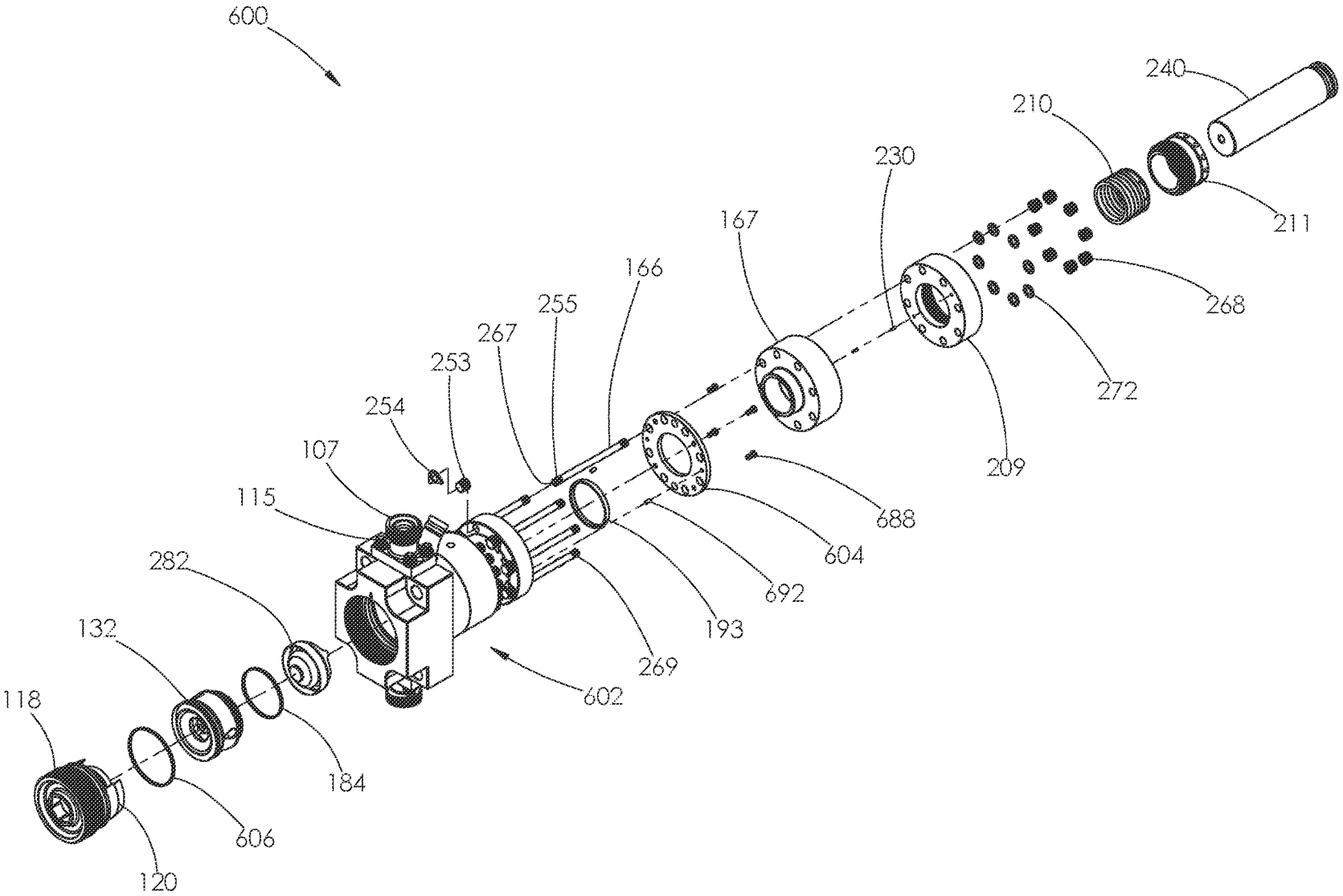

With reference to FIGS. 118 and 119, the retention plate 604 has a cylindrical cross-sectional shape and is sized to cover the rear surface 612 of the housing 602 and the wear ring 192 and the seal 193, as shown in FIG. 97. The retention plate 604 holds the wear ring 192 and the seal 193 within the housing 602 in the event the stuffing box 167 needs to be removed.

The retention plate 604 comprises opposed front and rear surface 698 and 700 joined by a central opening 702 formed therein. A plurality of first passages 704 are formed in the retention plate 604 and surround the central opening 702 of the plate 604. The first passages 704 align with the passages 684 formed in the rear mounting flange 676 of the third section 622 and are configured to receive the plurality of second fasteners 166, as shown in FIG. 97.

A plurality of second passages 706 are also formed in the retention plate 604. The second passages 706 align with the threaded openings 686 formed in the rear surface 612 of the housing 602 and are configured to receive the third fasteners 688, as shown in FIG. 99. A third fastener 688 is threaded into one of the threaded openings 686 and is turned until it sits flush with the rear surface 700 of the retention plate 604. A plurality of dowel passages 708 are also formed in the retention plate 604 for receiving third alignment dowels 692, as shown in FIG. 98. The third alignment dowels 692 assist in properly aligning the retention plate 604 and the stuffing box 167 on the housing 602 during assembly.

Since fluid does not contact the retention plate 604 during operation, the retention plate 604 may be made of a different and less costly material than that of the housing 602 or the stuffing box 167. For example, the retention plate 604 may be made of alloy steel, while the housing 602 and stuffing box 167 are made of stainless steel.

Figure 94:
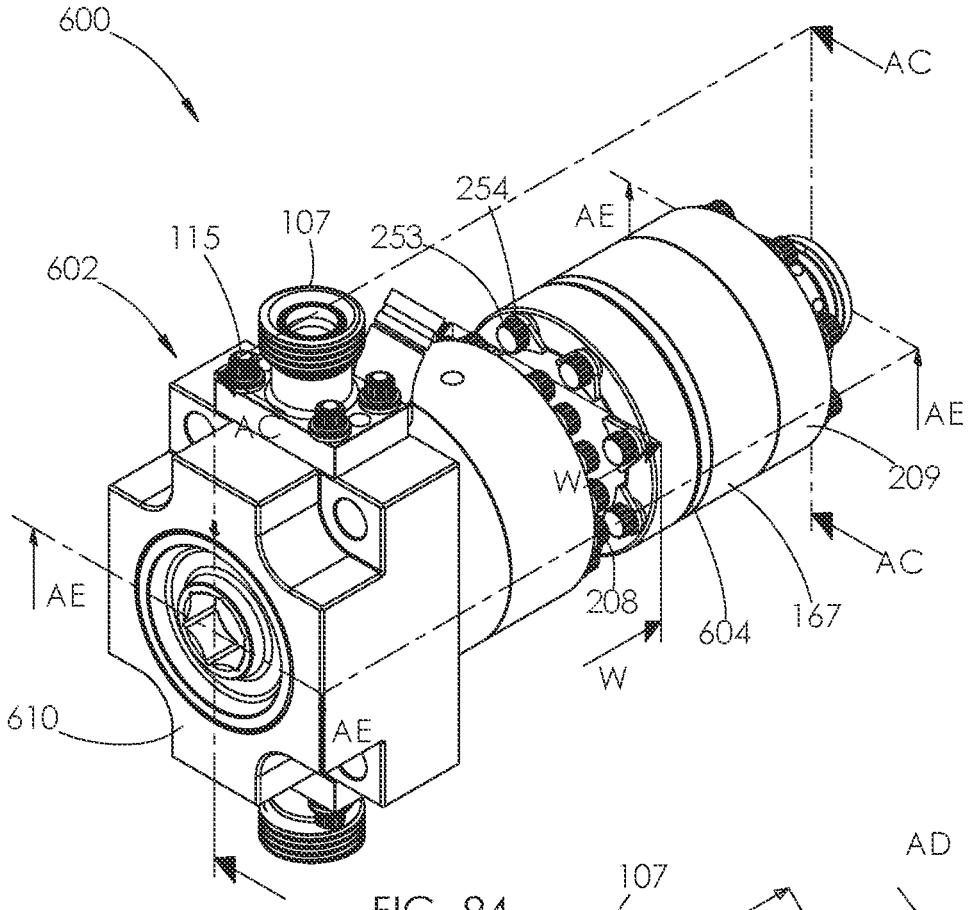
FIG. 94 is a front perspective view of another embodiment of a fluid end section.

Continuing with FIG. 97, after the retention plate 604 is attached to the rear surface 612 of the housing 602, the stuffing box 167 and rear retainer 209 are attached to the housing 602 using the second fasteners 166 in the same manner as the fluid end sections 56 and 500. The blind nuts 253 and nuts 268 and corresponding washers 272 are attached to opposite ends 255 and 269 of the second fasteners 166. The reaction washers 254 are also shown installed on each of the blind nuts 253, as shown in FIG. 94. The plunger packing 210 and packing nut 211 are also installed within the stuffing box 167 and the rear retainer 209 in the same manner as the fluid end sections 56 and 500. While not shown, the blind nuts 253 shown in FIG. 97 may also include the opening 262 for viewing the second fastener 166.

Figure 95:
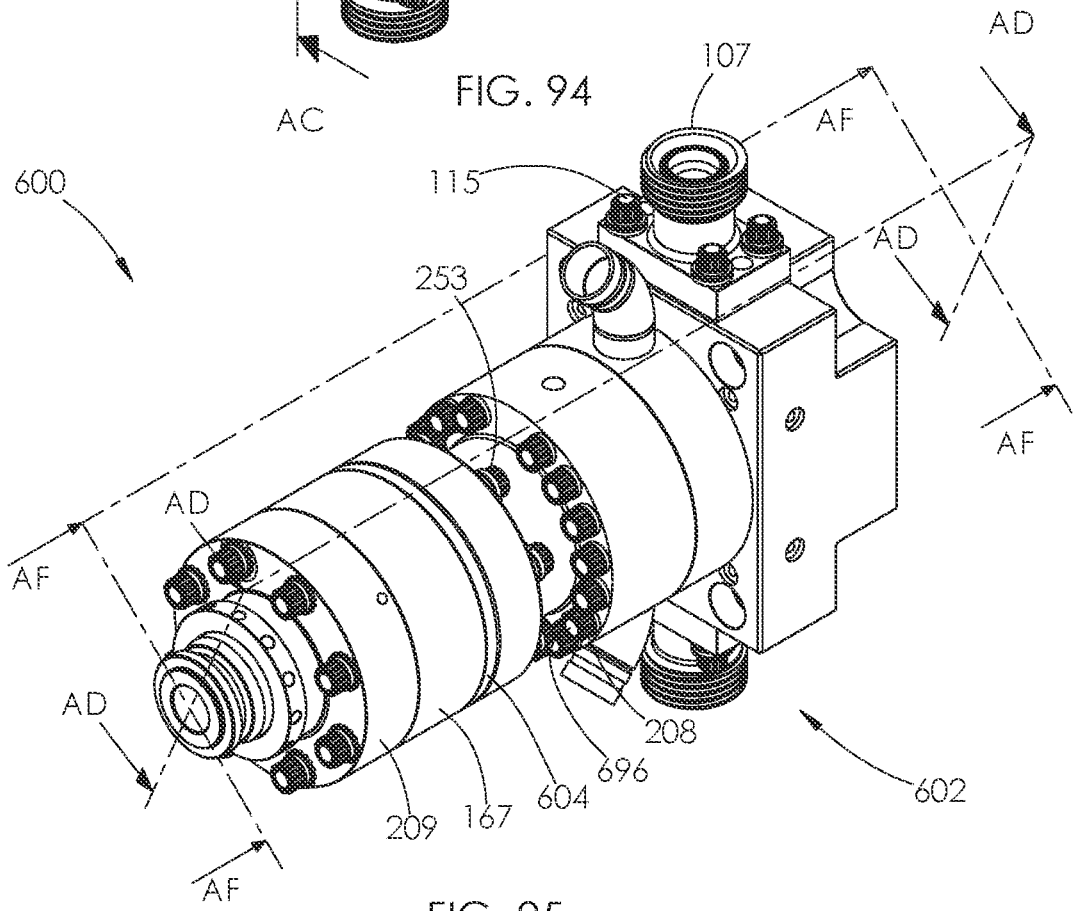
FIG. 95 is a rear perspective view of the fluid end section shown in FIG. 94.

As shown in FIGS. 94 and 95, when the fluid end section 602 is assembled, the second ends 696 of the first fasteners 624 and corresponding nuts 208 and the first ends 255 of the second fasteners 166 and corresponding blind nuts 253 are in a spaced-relationship and face each other. Both ends 696 and 255 and corresponding nuts 208 and 253 are positioned between the front and rear mounting flanges 674 and 676 and both ends and corresponding nuts overlap the medial portion 678 of the third section 622. When assembled, the second fasteners 166 extend along an axis that is parallel to a longitudinal axis 710 of the housing 602, as shown in FIG. 97.

The fluid end sections described herein have various embodiments of housings, inner components, and components attached to the various housings. While not specifically shown in a figure herein, various features from one fluid end section embodiment may be included in another fluid end section embodiment. One of skill in the art will appreciate that the various housing and components described herein may have different shapes and sizes, depending on the shape and size of the various components chosen to assemble each fluid end section.

One or more kits may be useful in assembling a fluid end assembly out of the various fluid end sections described herein. A single kit may comprise a plurality of one of the various embodiments of housings and fasteners described herein. The kit may further comprise a plurality of one or more of the various inner components described herein. The kit may even further comprise a plurality of one or more of the various components attached to the various housings described herein.

The various features and alternative details of construction of the apparatuses described herein for the practice of the present technology will readily occur to the skilled artisan in view of the foregoing discussion. It is to be understood that even though numerous characteristics and advantages of various embodiments of the present technology have been set forth in the foregoing description, together with details of the structure and function of various embodiments of the technology, this detailed description is illustrative only. Changes may be made in detail, especially in matters of structure and arrangements of parts within the principles of the present technology to the full extent indicated by the broad general meaning of the terms in which the appended claims are expressed.

The invention claimed is:

1. A fluid end section, comprising:

a housing having a longitudinal axis and opposed front and rear surfaces joined by an outer intermediate surface, the housing comprising a first section joined to a second section by a first plurality of fasteners, in which the first section comprises the front surface and the second section comprises the rear surface;

a horizontal bore formed within the housing and interconnecting the front and rear surfaces, the horizontal bore extending along the longitudinal axis of the housing and configured to receive a fluid routing plug; and a stuffing box attached to the second section of the housing by a second plurality of fasteners;

in which an end of each of the first plurality of fasteners faces an end of each of the second plurality of fasteners.

2. The fluid end section of claim 1, further comprising:

a retainer attached to the stuffing box opposite the housing using the second plurality of fasteners.

3. The fluid end section of claim 2, in which the end of each of the second plurality of fasteners is characterized as a first end of each of the second plurality of fasteners; and in which an opposed second end of each of the second plurality of fasteners projects from a rear surface of the retainer.

4. The fluid end section of claim 3, further comprising:

a plurality of first threaded nuts, each of the plurality of first threaded nuts installed on the first end of each of the second plurality of fasteners in a one-to-one relationship; and a plurality of second threaded nuts, each of the plurality of second threaded nuts installed on the second end of each of the second plurality of fasteners in a one-to-one relationship.

5. The fluid end section of claim 2, further comprising:

a plunger packing installed within the stuffing box; and a packing nut installed within the retainer and engaging the plunger packing.

6. The fluid end section of claim 1, further comprising:

a spacer sleeve positioned intermediate at least a portion of the second section of the housing and at least a portion of the stuffing box;

in which the second plurality of fasteners extend through the spacer sleeve.

7. A fluid end section, comprising:

a housing having a longitudinal axis and opposed front and rear surfaces joined by an outer intermediate surface, the housing comprising a flanged section positioned adjacent the rear surface;

a horizontal bore formed within the housing and interconnecting the front and rear surfaces, the horizontal bore extending along the longitudinal axis of the housing and configured to receive a fluid routing plug;

a stuffing box attached to the rear surface of the housing using a plurality of fasteners;

a retainer attached to the stuffing box using the plurality of fasteners;

in which the plurality of fasteners extend through the flanged section of the housing, the stuffing box, and the retainer such that a first end of each of the plurality of fasteners projects from the flanged section and an opposed second end of each of the plurality of fasteners projects from the retainer.

8. The fluid end section of claim 7, further comprising:

a plurality of first threaded nuts, each of the plurality of first threaded nuts installed on the first end of each of the plurality of fasteners in a one-to-one relationship; and a plurality of second threaded nuts, each of the plurality of second threaded nuts installed of the second end of each of the plurality of fasteners in a one-to-one relationship.

9. The fluid end section of claim 7, further comprising:

a rear spacer sleeve positioned intermediate the flanged section of the housing and at least a portion of the stuffing box;

in which the plurality of fasteners extend through the rear spacer sleeve.

10. The fluid end section of claim 9, in which the stuffing box engages the rear surface of the housing and a rear surface of the spacer sleeve.

11. The fluid end section of claim 7, in which the plurality of fasteners is characterized as a second plurality of fasteners; and in which housing comprises a first section joined to a second section by a first plurality of fasteners, the first section comprising the front surface and the second section comprising the rear surface and the flanged section of the housing.

12. The fluid end section of claim 11, in which the flanged section of the housing is characterized as a rear flanged section of the housing, the second section of the housing further comprising a front flanged section; and in which the first plurality of fasteners extend through the front flanged section and into the first section of the housing.

13. The fluid end section of claim 12, further comprising:

a front spacer sleeve positioned between the first section of the housing and the front flanged section of the second section of the housing; in which the first plurality of fasteners extend through the front spacer sleeve.

14. A fluid end section, comprising:

a housing having a longitudinal axis and opposed front and rear surfaces joined by an outer intermediate surface, the housing comprising a front flanged section and a rear flanged section;

a horizontal bore formed within the housing and interconnecting the front and rear surfaces, the horizontal bore extending along the longitudinal axis of the housing;

a first plurality of fasteners extending through the front flanged section; and a second plurality of fasteners extending through the rear flanged section;

in which an end of each of the first plurality of fasteners faces an end of each of the second plurality of fasteners.

15. The fluid end section of claim 14, further comprising:

a stuffing box attached to the rear surface of the housing; in which the second plurality of fasteners extend through the stuffing box; and a plunger packing installed within the stuffing box.

16. The fluid end section of claim 15, further comprising:

a rear spacer sleeve positioned between the rear flanged section of the housing and at least a portion of the stuffing box; in which the second plurality of fasteners extend through the rear spacer sleeve.

17. The fluid end section of claim 16, in which the rear spacer sleeve surrounds a portion of the housing.

18. The fluid end section of claim 14, further comprising:

a retainer attached to the rear surface of the housing; in which the second plurality of fasteners extend through the retainer; and a packing nut installed within the retainer.

19. The fluid end section of claim 14, further comprising:

a wear ring installed within the housing at the rear surface of the housing and engaging the stuffing box.

20. The fluid end section of claim 19, further comprising:

an annular seal installed within the housing at the rear surface of the housing and engaging the stuffing box; in which the wear ring surrounds the annular seal.

* * * * *